US005593818A

United States Patent [19]

Kawamoto

[11] Patent Number: 5,593,818

[45] Date of Patent: Jan. 14, 1997

[54] SILVER HALIDE PHOTOGRAPHIC MATERIAL

[75] Inventor: Fumio Kawamoto, Minami-ashigara, Japan

[73] Assignee: Fuji Photo Film Co., Ltd., Kanagawa, Japan

[21] Appl. No.: 536,493

[22] Filed: Oct. 2, 1995

Related U.S. Application Data

[63] Continuation of Ser. No. 263,893, Jun. 22, 1994, abandoned.

[30] Foreign Application Priority Data

Jun. 22, 1993 [JP] Japan ..... 5-173574
Jun. 23, 1993 [JP] Japan ..... 5-174623

[51] Int. Cl.[6] ..... G03C 1/815; G03C 1/825

[52] U.S. Cl. ..... 430/512; 430/507; 430/523; 430/531; 430/533; 430/931

[58] Field of Search ..... 430/507, 512, 430/523, 531, 533, 931

[56] References Cited

U.S. PATENT DOCUMENTS

| | | | |
|---|---|---|---|
| 3,707,375 | 12/1972 | Ohi et al. | 430/517 |
| 4,141,735 | 2/1979 | Schrader et al. | 430/141 |
| 4,220,711 | 9/1980 | Nakamura et al. | 430/502 |
| 4,360,588 | 11/1982 | Postle | 430/512 |
| 5,326,689 | 7/1994 | Murayama | 430/533 |
| 5,496,687 | 3/1996 | Kawamoto | 430/496 |

FOREIGN PATENT DOCUMENTS

| | | |
|---|---|---|
| 0439069 | 7/1991 | European Pat. Off. . |
| 1576796 | 8/1969 | France . |
| 2198172 | 3/1974 | France . |
| 2266191 | 10/1975 | France . |
| 58-181040 | 10/1983 | Japan . |
| 1198337 | 7/1970 | United Kingdom . |

OTHER PUBLICATIONS

Patent Abstracts of Japan, vol. 13, No. 149 (P–855) (3497) 12 Apr. 1989.

*Primary Examiner*—Geraldine Letscher
*Attorney, Agent, or Firm*—Sughrue, Mion, Zinn, Macpeak & Seas

[57] ABSTRACT

There is disclosed a silver halide photographic material having a support and at least one silver halide emulsion layer on at least one side of the support, which comprises a layer containing at least one ultraviolet absorbent that is present on one or both surfaces or a support containing at least one ultraviolet absorbent, the total content of the ultraviolet absorbent being 0.01 to 10 g/m$^2$, and the support being made of a polyethylene naphthalate or its derivative. As the ultraviolet absorbent, at least one of compounds represented by formula (I) to (VI) is preferably used.

20 Claims, No Drawings

SILVER HALIDE PHOTOGRAPHIC MATERIAL

This is a Continuation of application Ser. No. 08/263,893 filed Jun. 22, 1994, now abandoned.

FIELD OF THE INVENTION

The present invention relates to a silver halide photographic material excellent in storage stability.

BACKGROUND OF THE INVENTION

Conventionally, for a silver halide photographic material (hereinafter referred to as a photographic material), its support is required to be transparent and excellent in film strength. As materials that meet these requirements, nitrocellulose and triacetyl cellulose belonging to cellulose series, are used, and in recent years, polyethylene terephthalates have been rapidly introduced.

Since polyethylene terephthalates are excellent in water-resistance and film strength, they are useful for attaining dimensional stability and reduction in film thickness.

However, polyethylene terephthalates have the defect that when the film of a polyethylene terephthalate is kept in a rolled state for a long period of time or is exposed to a high temperature (e.g., in a car in midsummer), it is highly apt to undergo a core set curl.

To eliminate this defect, JP-A ("JP-A" means unexamined published Japanese patent application) No. 51174/1975 describes that a roll of a polyethylene terephthalate film is exposed for 24 hours or more to an atmosphere whose temperature is kept 15° to 35° C. higher than the temperature at which the film has been rolled on a slit roll. Further, JP-A No. 95374/1975 suggests that a polyester film (a polyethylene terephthalate film is described), which has been biaxially stretched and then heat set, is aged by heating it at a temperature ranging from 40° to 130° C., so that the flatness may be improved. However, even if it is attempted to eliminate core set curl by these heat treatments, when the roll is left for a long period of time at the above-described high temperature (80° C. or over), the attempt has no effect at all, which is a practical problem. That is, when a color negative film, whose support is made of a polyethylene terephthalate that has been heat-treated under the above-described conditions, is wound into a cartridge (magazine or Patrone) for usual 35-mm film, and then it is allowed to stand at 80° C. for 2 hours and is cooled, the film removed from the cartridge has core set curl resembling the shape of the cartridge, showing no effect of the heat treatment at all. As a result, it causes transportation trouble in an automatic processor and is apt to curl during the printing, which may cause problems.

U.S. Pat. No. 4,141,735 and JP-A No. 95374/1975 suggest means of further eliminating core set curl by heat treatment. These techniques are clearly effective against core set curl, especially in the case of storage at high temperatures, and they resolve substantially the problem of core set curl.

However, the polyethylene naphthalate, which was used in the means described in U.S. Pat. No. 4,147,735, has the problem that it has absorption and fluorescence-emission in the ultraviolet region, leading to discoloration such as yellowing over time and fogging with regard to photographic properties.

Although, as means of incorporating an ultraviolet absorbent in a polyester, JP-A Nos. 247451/1989 and 247452/1989 describe specific compounds, the compounds are very poor in transparency and cannot be used for photography at all.

SUMMARY OF THE INVENTION

The first object of the present invention is to provide a photographic material that will hardly undergo core set curl and that is hardly discolored over time.

The second object of the present invention is to provide a photographic material that will hardly undergo core set curl and that will cause little fogging.

The third object of the present invention is to provide a photographic material that is excellent in passability through compact labs and that will hardly undergo core set curl.

Other and further objects, features, and advantages of the invention will appear more evident from the following description.

DETAILED DESCRIPTION OF THE INVENTION

These objects have been attained by providing (1) a silver halide photographic material having a support and at least one silver halide emulsion layer on at least one side of the support, which comprises a layer containing at least one ultraviolet absorbent on one or both surfaces, the total content of the ultraviolet absorbent being 0.01 to 3 g/m$^2$, and the support being made of a polyethylene naphthalate or its derivative (hereinafter referred to as first embodiment of the present invention), and (2) a silver halide photographic material having a support and at least one silver halide emulsion layer on at least one side of the support, wherein the support is made of a polyethylene naphthalate or its derivative and contains 0.02 to 10 g/m$^2$ of at least one ultraviolet absorbent, with a thickness of 40 to 500 μm (hereinafter referred to as second embodiment of the present invention).

In this specification, "the present invention" means both the above first and second embodiments, unless otherwise specified.

Now, the ultraviolet absorbent for use in the present invention will be described below.

There are no particular restrictions on the ultraviolet absorbent for use in the present invention, as long as the ultraviolet absorbent has an absorption peak in the ultraviolet region (200 to 400 nm).

However, in particular, an ultraviolet absorbent having satisfactory absorption reaching to the long wavelength region (300 to 400 nm) is preferable, because the absorption wavelength of the polyethylene naphthalates for use in the present invention extends to 380 nm.

Particularly preferable ultraviolet absorbents are represented by the following formulae (I) to (VI):

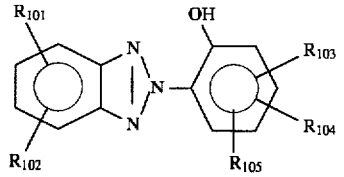

formula (I)

-continued formula (II)

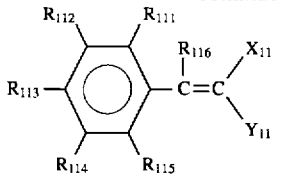

formula (III)

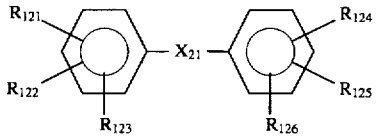

formula (IV)

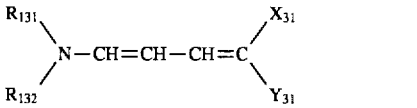

formula (V)

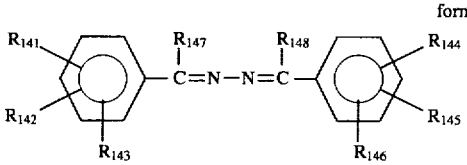

formula (VI)

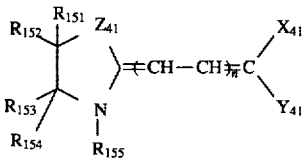

In the formulae, $R_{101}$, $R_{102}$, $R_{103}$, $R_{104}$, and $R_{105}$, which are the same or different, each represent a hydrogen atom, a halogen atom, an alkyl group, a cycloalkyl group, an alkoxy group, an aryl group, an aryloxy group, an alkenyl group, a nitro group, a carboxyl group, a sulfonic group, or a hydroxyl group.

$R_{111}$ to $R_{115}$, which are the same or different, each represent a hydrogen atom, a halogen atom, an alkyl group, an aryl group, an alkoxy group, an aryloxy group, an alkylthio group, an arylthio group, an amino group, a hydroxyl group, a cyano group, a nitro group, a carbamoyl group, a sulfonyl group, a sulfamoyl group, a sulfonamido group, a carboxyl group, a sulfonic group, an acyloxy group, or an oxycarbonyl group, $R_{116}$ represents a hydrogen atom or an alkyl group, $X_{11}$ and $Y_{11}$ each represent a cyano group, —$COOR_{117}$, —$CONHR_{117}$, —$COR_{117}$, —$SO_2R_{117}$, or —$SO_2NHR_{117}$, wherein $R_{117}$ represents an alkyl group or an aryl group, and $X_{11}$ and $Y_{11}$ may bond together to form a 5- to 7-membered ring.

$R_{121}$ to $R_{126}$, which are the same or different, each represent a hydrogen atom, a halogen atom, an alkyl group, an aryl group, an alkoxy group, an aryloxy group, an alkylthio group, an arylthio group, an amino group, a hydroxyl group, a cyano group, a nitro group, a carbonamido group, a carbamoyl group, a sulfonamido group, a sulfamoyl group, a carboxyl group, a sulfonic group, an acyloxy group, or an oxycarbonyl group. $X_{21}$ represents —CO— or —COO—.

$R_{131}$ and $R_{132}$, which are the same or different, each represent a hydrogen atom, an alkyl group, or an aryl group or a group of nonmetallic atoms required to form a 5- or 6-membered ring by bonding together, $X_{31}$ and $Y_{31}$, which are the same or different, have the same meanings as those $X_{11}$ and $Y_{11}$ in formula (II).

$R_{141}$ to $R_{146}$, which are the same or different, have the same meaning as those $R_{111}$ to $R_{115}$ in formula (II), $R_{147}$ and $R_{148}$, which are the same or different, each represent a hydrogen atom, an alkyl group, or an aryl group, and $R_{147}$ and $R_{148}$ may bond together to form a 5- or 6-membered ring.

$R_{151}$ to $R_{154}$, which are the same or different, each represent a hydrogen atom, an alkyl group, or an aryl group, $R_{151}$ and $R_{154}$ may bond together to form a double bond, and when $R_{151}$ and $R_{154}$ bond together to form a double bond, $R_{152}$ and $R_{153}$ may bond together to form a benzene ring or a naphthalene ring. $R_{155}$ represents an alkyl group or an aryl group, $Z_{41}$ represents an oxygen atom, a sulfur atom, a methylene group, an ethylene group,

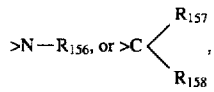

$R_{156}$ represents an alkyl group or an aryl group, and $R_{157}$ and $R_{158}$, which are the same or different, each represent a hydrogen atom or an alkyl group. n is 0 or 1. $X_{41}$ and $Y_{41}$, which are the same or different, have the same meaning as those of $X_{11}$ and $Y_{11}$ in formula (II).

In formulae (I) to (IV), preferably the alkyl groups represented by $R_{101}$ to $R_{105}$, $R_{111}$ to $R_{117}$, $R_{121}$ to $R_{126}$, $R_{131}$, $R_{132}$, $R_{141}$ to $R_{148}$, and $R_{151}$ to $R_{155}$ have 1 to 20 carbon atoms and may be substituted [examples of the substituent include a hydroxyl group, a cyano group, a nitro group, a halogen atom (e.g., chlorine, bromine, and fluorine), an alkoxy group (e.g., methoxy, ethoxy, butoxy, and octyloxy), an aryloxy group (e.g., phenoxy), an ester group (e.g., methoxycarbonyl, ethoxycarbonyl, octyloxycarbonyl, and dodecyloxycarbonyl), a carbonyloxy group (e.g., ethylcarbonyloxy, heptylcarbonyloxy, and phenylcarbonyloxy), an amino group (e.g., dimethylamino, ethylamino, and diethylamino), an aryl group (e.g., phenyl), a carbonamido group (e.g., methylcarbonylamido and phenylcarbonylamido), a carbamoyl group (e.g., ethylcarbamoyl and phenylcarbamoyl), a sulfonamido group (e.g., methanesulfonamido and benzenesulfonamido), a sulfamoyl group (e.g., butylsulfamoyl, phenylsulfamoyl, and methyloctylaminosulfonyl), a cyano group, a carboxyl group, and a sulfonic group]. Specific examples are a methyl group, an ethyl group, a propyl group, an iso-propyl group, a butyl group, a sec-butyl group, a t-butyl group, a pentyl group, a t-pentyl group, a hexyl group, an octyl group, a 2-ethylhexyl group, a t-octyl group, a decyl group, a dodecyl group, a hexadecyl group, an octadecyl group, a benzyl group, and a phenetyl group, and groups having the above substituent.

As the cycloalkyl group, a cyclopropyl group, a cyclopentyl group, a cyclohexyl group, and a bicyclo[2,2,2]octyl group can be mentioned, which may be substituted by those substituents mentioned above as examples of a substituent on the alkyl group.

Preferably the aryl group has 6 to 10 carbon atoms and may be substituted [examples of the substituent are an alkyl group (e.g., methyl, ethyl, propyl, iso-propyl, butyl, sec-butyl, t-butyl, pentyl, t-pentyl, octyl, decyl, dodecyl, tetradecyl, and hexadecyl) and those groups that are mentioned above as examples of a substituent that the alkyl group may have]. Specifically as the aryl group, a phenyl group and a naphthyl group can be mentioned.

As examples of the alkenyl group, a 2-butenyl group, a 3-butenyl group, and an oleyl group can be mentioned, which may be substituted by those substituents mentioned above as examples of a substituent on the alkyl group.

Specific examples of the ultraviolet absorbents represented by formula (I) to (VI) are shown below, but the present invention is not limited to them.

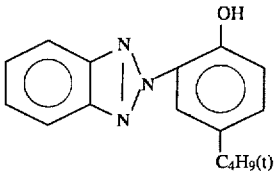
I-1
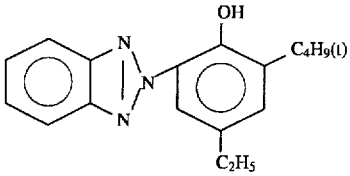
I-2
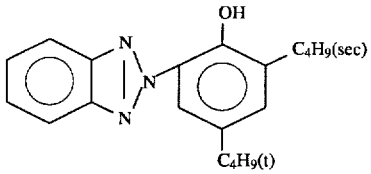
I-3
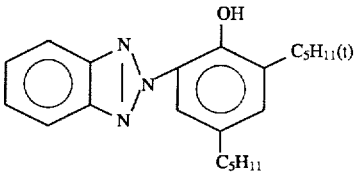
I-4
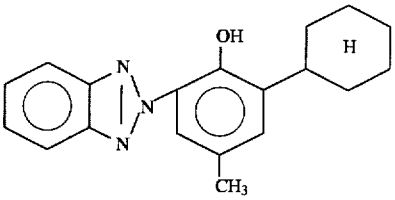
I-5
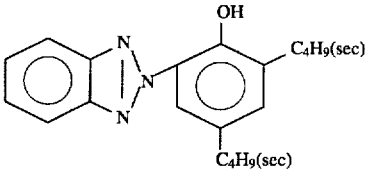
I-6
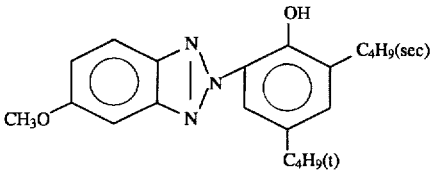
I-7
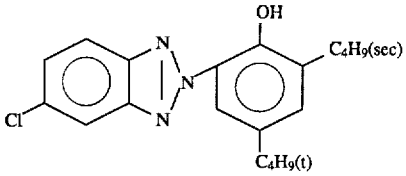
I-8
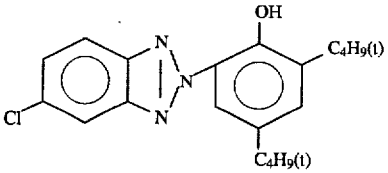
I-9

-continued
I-10
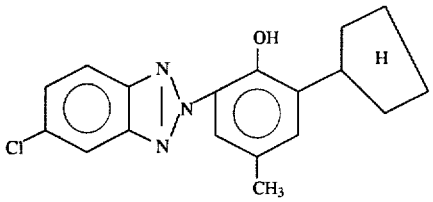
I-11
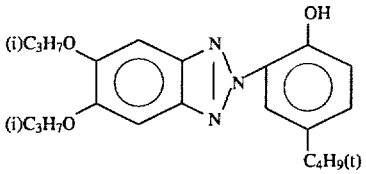
I-12
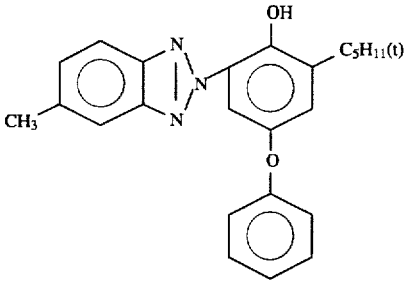
I-13
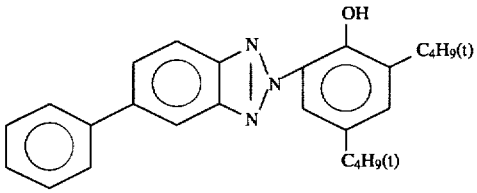
I-14
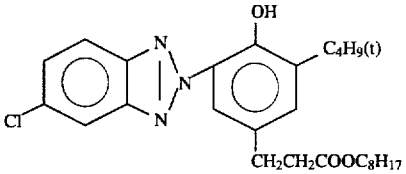
I-15
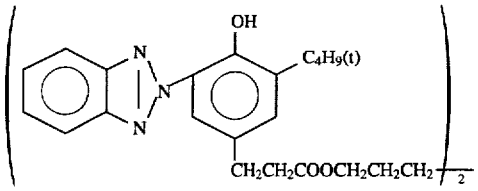
I-16
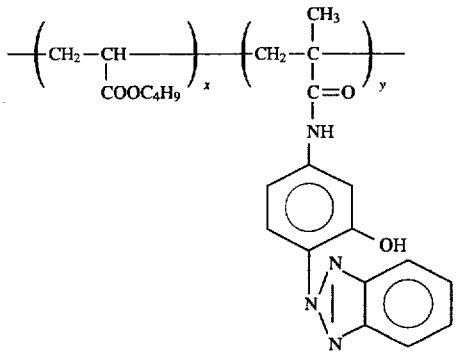

-continued
I-17
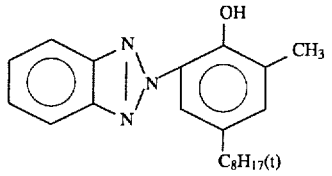
I-18
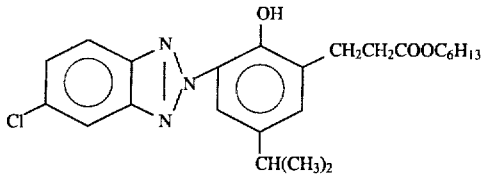
II-1
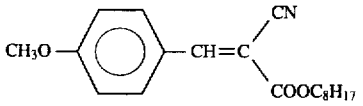
II-2
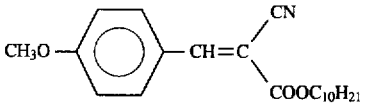
II-3
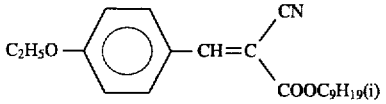
II-4
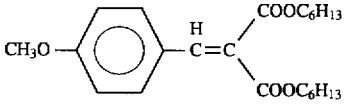
II-5
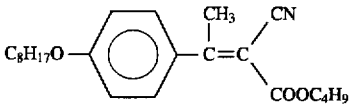
II-6
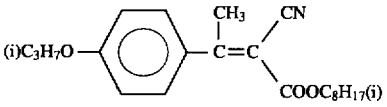
II-7
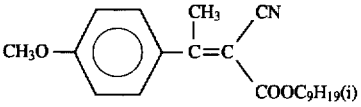
II-8
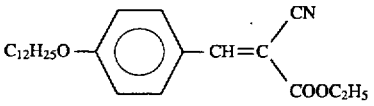
II-9
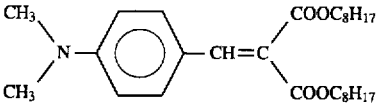
II-10
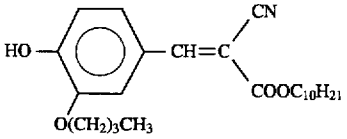

-continued
II-11
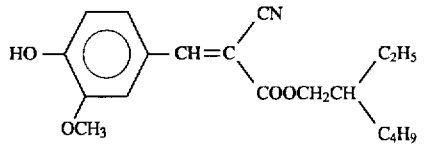
II-12
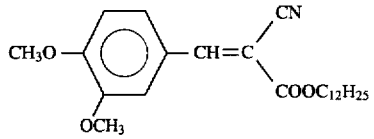
II-13
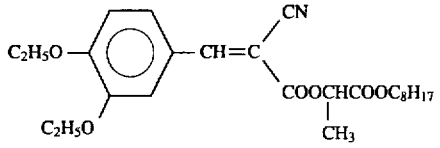
II-14
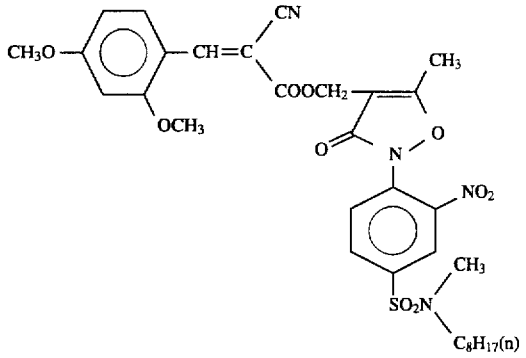
II-15
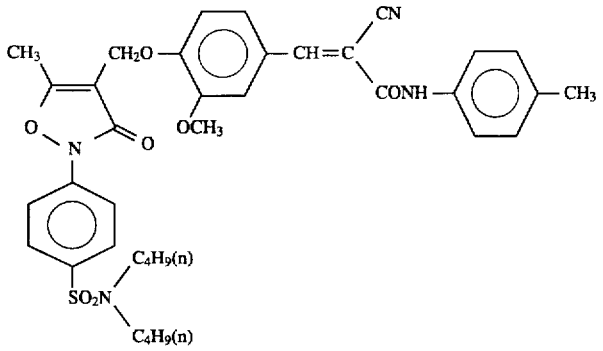
II-16
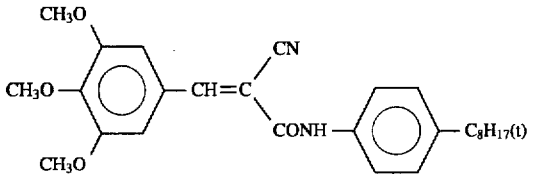
II-17
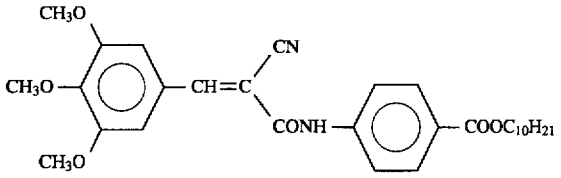
II-18
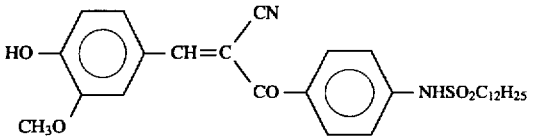

-continued
II-19
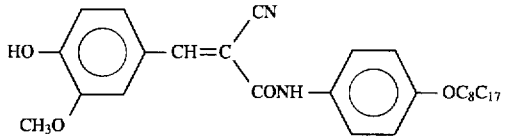
II-20
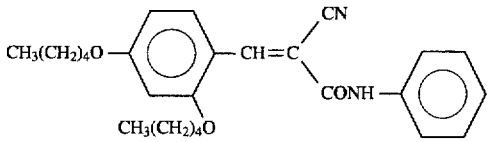
II-21
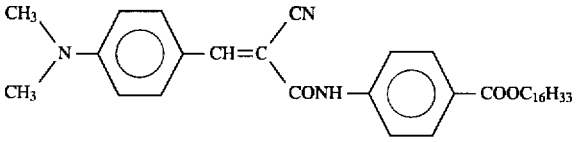
II-22
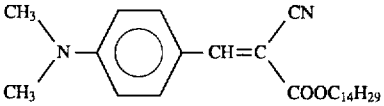
II-23
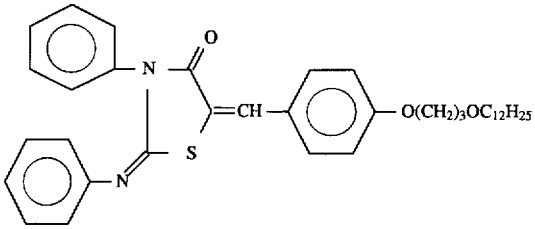
II-24
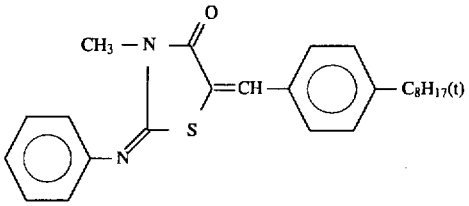
II-25
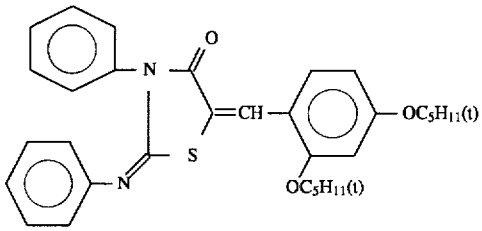
II-26
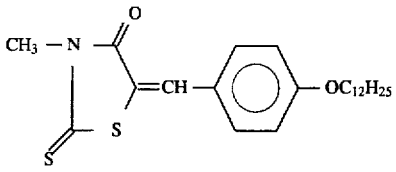

-continued
II-27
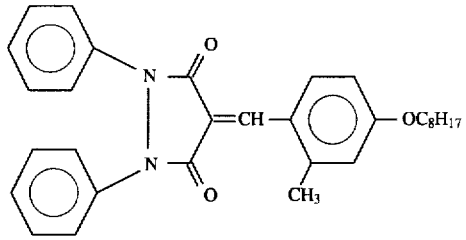
II-28
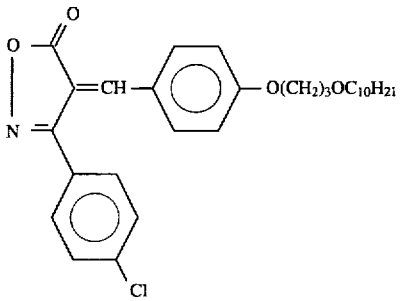
II-29
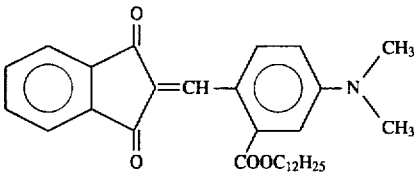
II-30
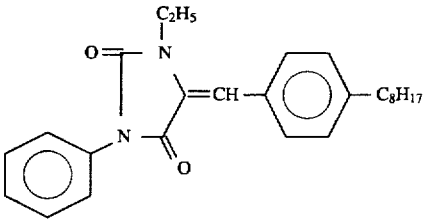
II-31
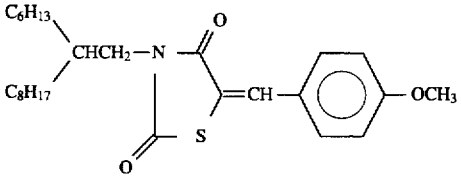
II-32
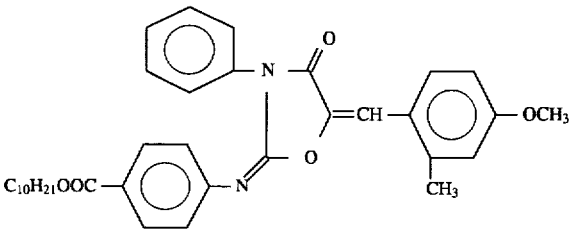
II-33
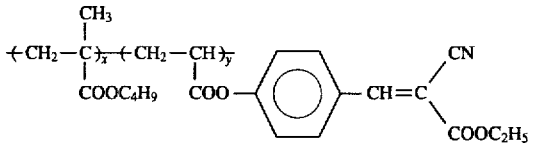
x:y = 30:70(wt%)

-continued
II-34
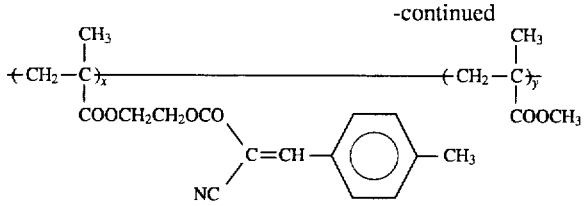
x:y = 70:30(wt%)
II-35
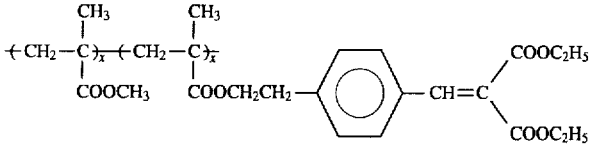
x:y = 25:75(wt%)
II-36
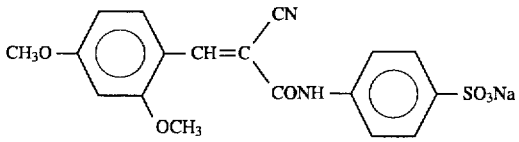
II-37
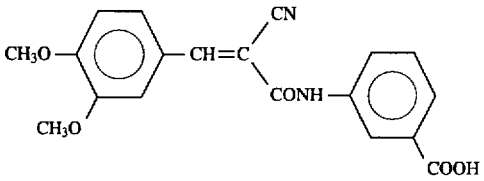
III-1
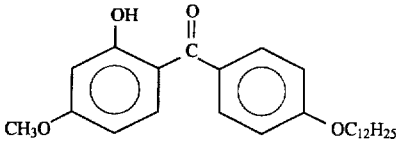
III-2
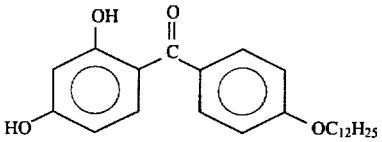
III-3
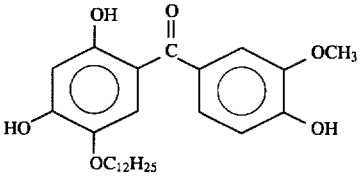
III-4
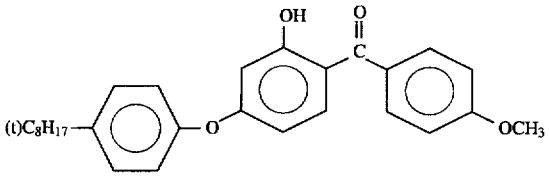
III-5
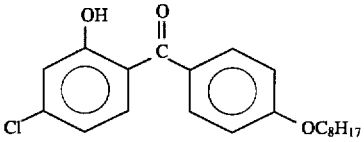

-continued
III-6
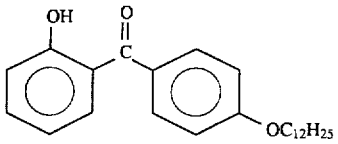
III-7
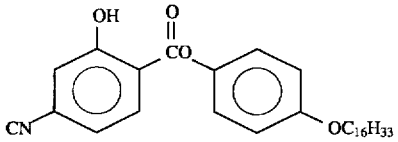
III-8
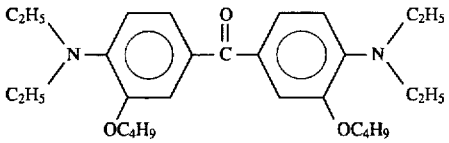
III-9
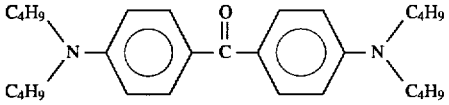
III-10
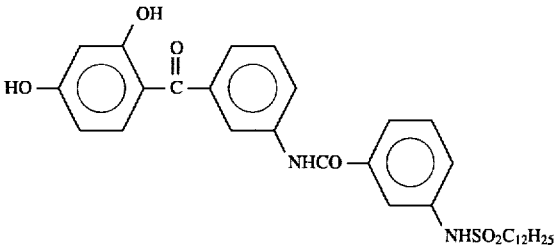
III-11
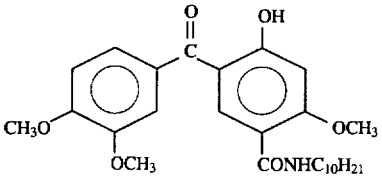
III-12
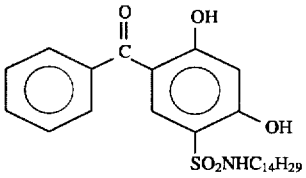
III-13
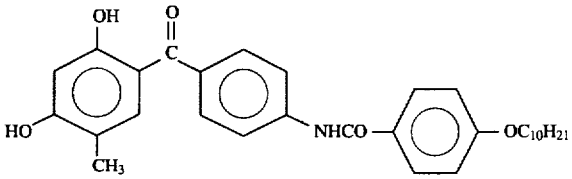
III-14
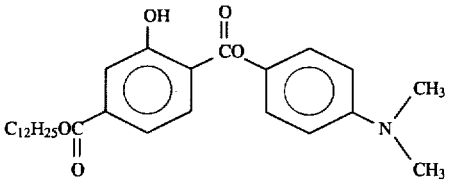

-continued
III-15
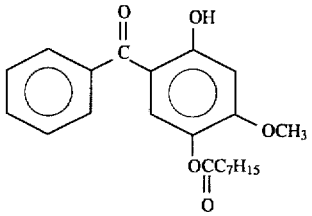
III-16
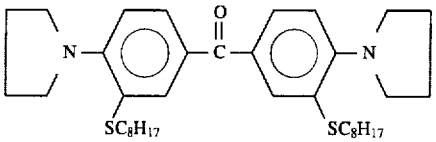
III-17
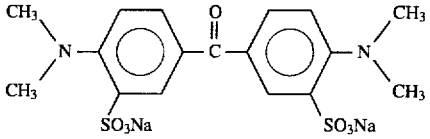
IV-1
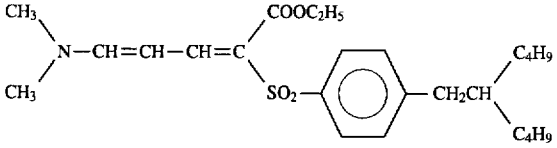
IV-2
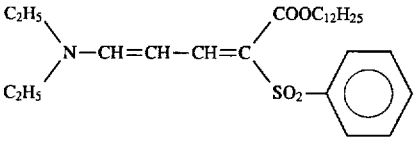
IV-3
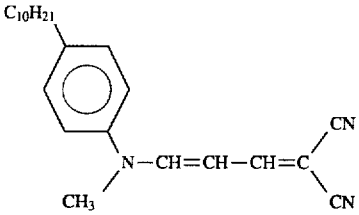
IV-4
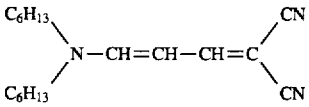
IV-5
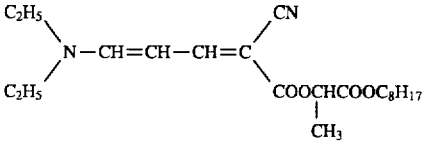
IV-6
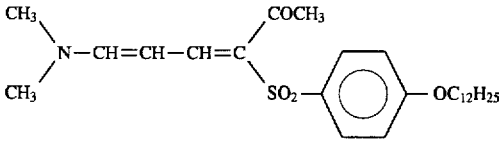
IV-7
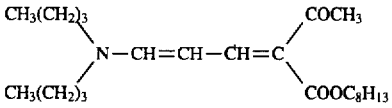

-continued
IV-8
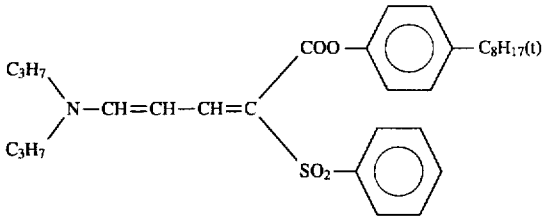
IV-9
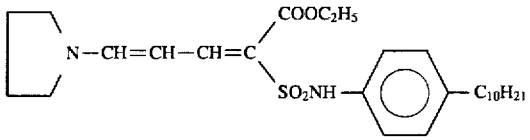
IV-10
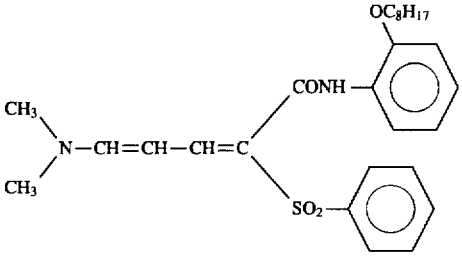
IV-11
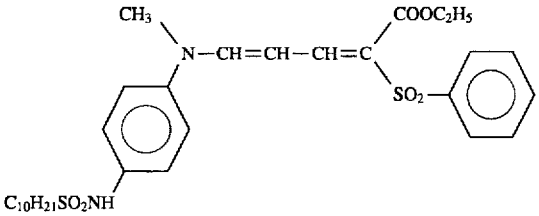
V-1
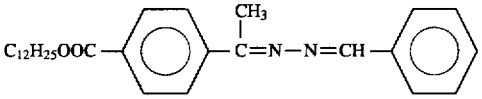
V-2
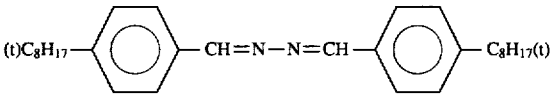
V-3
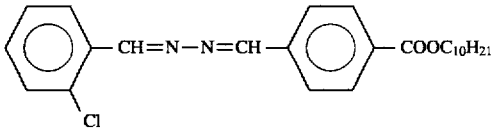
V-4
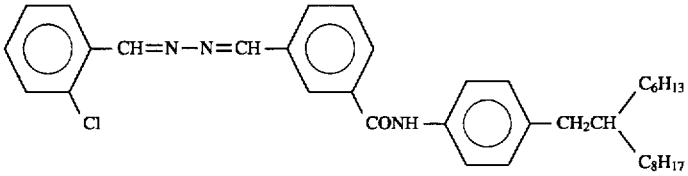
V-5
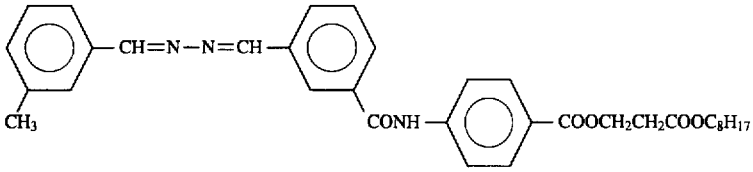

-continued
V-6
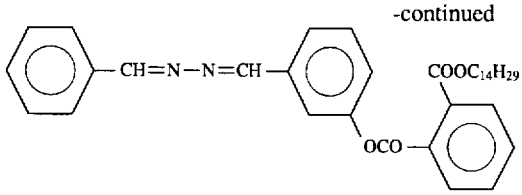
V-7
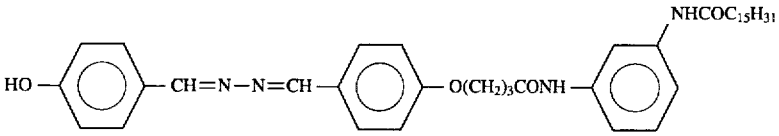
VI-1
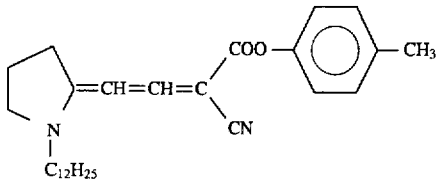
VI-2
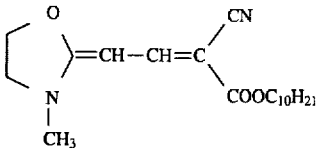
VI-3
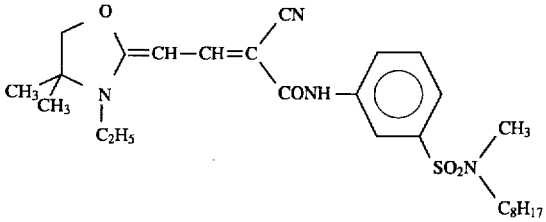
VI-4
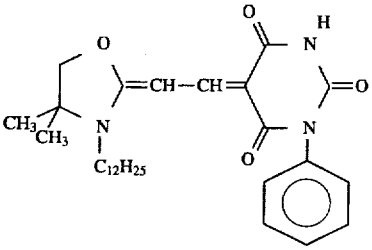
VI-5
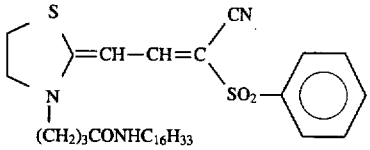
VI-6
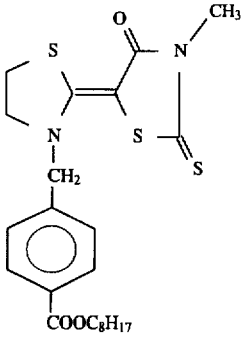

-continued

VI-7

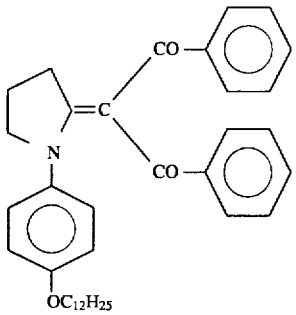

VI-8

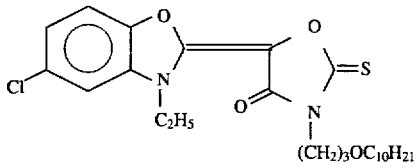

VI-9

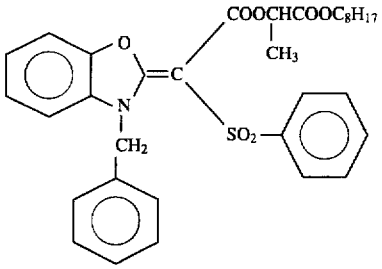

VI-10

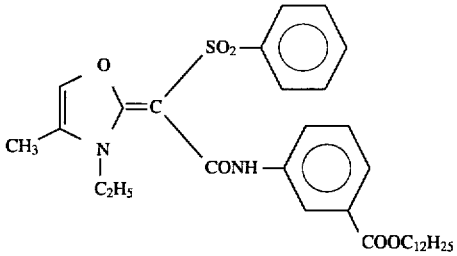

VI-11

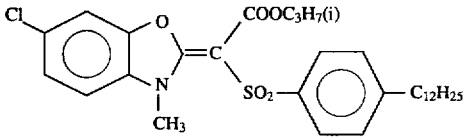

The 2-(2'-hydroxyphenyl)benzotriazole series ultraviolet absorbent represented by formula (I) for use in the present invention may be solid or liquid at ordinary temperatures. Specific examples of the liquid 2-(2'-hydroxyphenyl)benzotriazole series ultraviolet absorbent are described, for example, in JP-B ("JP-B" means examined Japanese patent publication) Nos. 36984/1980 and 12587/1980 and JP-A No. 214152/1983. Details of the ultraviolet absorbent represented by formula (I) are also described, for example, in JP-A Nos. 221844/1983, 46646/1984, and 109055/1984, JP-B Nos. 10466/1961, 26187/1967, 5496/1973, 41572/1973, and U.S. Pat. No. 3,754,919 and 4,220,711.

The ultraviolet absorbent represented by formula (II) can be synthesized by methods, or in accordance with methods, described, for example, in JP-B Nos. 31255/1973 and 10726/1975 and U.S. Pat. Nos. 2,719,086, 3,214,463, and 3,284,203.

The ultraviolet absorbent represented by formula (III) can be synthesized by methods, or in accordance with methods, described, for example, in U.S. Pat. No. 3,707,375, JP-B No. 30492/1973, and JP-A Nos. 10537/1972,111942/1973, 19945/1984, and 53544/1988.

The ultraviolet absorbent represented by formula (IV) can be synthesized in accordance with methods described, for example, in JP-A Nos. 56620/1976, 128333/1978, and 181040/1983.

The ultraviolet absorbent represented by formula (V) can be synthesized by methods, or in accordance with methods, described, for example, in British Pat. No. 1,198,337 and JP-A No. 53544/1988.

The ultraviolet absorbent represented by formula (VI) can be synthesized by methods, or in accordance with methods, described, for example, in U.S. Pat. No. 4,360,588 and JP-A Nos. 53544/1988.

It is a feature of the first embodiment of the present invention that these ultraviolet absorbents of the present invention are contained in at least one of the photographic constitutional layers of the silver halide photographic material, and that constitutional layer is not particularly restricted, and it includes, for example, a protective layer, an intermediate layer, an emulsion layer, an antihalation layer, a yellow-filter layer, a dye layer, an undercoat layer, and an antistatic layer, which the constitutional layer is on the side of the emulsion layer. If there are back layers, they include, for example, an undercoat layer, an antistatic layer, a protective layer, a dye layer, and a mar-resistance-imparting layer. Among them, the protective layer and the antihalation layer on the emulsion layer side, and the protective layer and the undercoat layer on the back side, are preferable.

When the ultraviolet absorbent of the present invention is added, the manner of the addition is not particularly restricted, and if the ultraviolet absorbent is an oil, it may be added as finely dispersed particles, or if the ultraviolet absorbent is a powder, it may be used after being pulverized mechanically. Further, generally, the ultraviolet absorbent is dissolved in a low-boiling organic solvent that can dissolve it, and it is added after being superpulverized in water or a binder, such as gelatin, in the presence of a surface-active agent. At that time, by using a high-boiling organic solvent (preferably one having a boiling point of 175° C. or over at an atmospheric pressure), the dispersion stability can be improved considerably.

Surface-active agents that are preferably used are not restricted, for example, to anionic, cationic, nonionic, and betaine surface-active agents and anionic and nonionic surface-active agents are preferred. Among them, sulfonic acid type surface-active agents (e.g., sodium dodecylbenzenesulfonate, sodium triisopropylnaphthalenesulfonate, sodium di(2-ethylhexyl) α-sulfosuccinate, sodium dihexyl α-sulfosuccinate, sodium dodecyl bisphenyl ether sulfonate, sodium N-dodecanoyl-N-methyl taurate, and sodium p-octylphenyl ethoxyethoxyethane sulfonate), sulfate type surface-active agents (e.g., sodium dodecylsulfate and sodium sulfate of a polyoxyethylene-p-nonylphenyl ether (the polyoxyethylene has a degree of polymerization of 4)), phosphoric acid type surface-active agents (e.g. sodium phosphate of a polyoxyethylene-p-nonylphenyl ether (the polyoxyethylene has a degree of polymerization of 4)), carboxylic acid type surface-active agents (e.g., potassium N-dodecanoylglycine), and polyoxyethylene type surface-active agents (e.g., $C_{12}H_{25}O—(CH_2CH_2O)_{10}—H$, $C_{16}H_{33}O—(CH_2CH_2O)_{10}—H$, $C_9H_{19}—C_6H_4—O—(CH_2CH_2O)_{8.5}—H$, and Tween 80) are particularly preferable.

As specific examples of a high-boiling organic solvent having a boiling point of 175° C. or over at ordinary pressures used in the oil-in-water dispersion method, for example, phthalates, phosphates, phosphonates, benzoates, amides, alcohols, phenols, aliphatic carboxylates, aniline derivatives, and hydrocarbons can be mentioned. As a co-solvent, an organic solvent having a boiling point of 30° C. or over, preferably 50° C. or over but about 160° C. or below, can be used, and typical examples include ethyl acetate, butyl acetate, ethyl propionate, methyl ethyl ketone, cyclohexane, 2-ethoxy ethyl acetate, and diethylformaldehyde.

The amount of the ultraviolet absorbent for use in the first embodiment of the present invention to be added to at least one of the photographic constitutional layers is 0.01 to 3 $g/m^2$ preferably 0.02 to 2 $g/m^2$, more preferably 0.05 to 1.5 $g/m^2$, and particularly preferably 0.1 to 1.5 $g/m^2$. The ultraviolet absorbent for use in the first embodiment of the present invention may not be added necessarily to one layer only, and generally it is added to two or more layers; for example, to both a protective layer and an antihalation layer or an intermediate layer on the emulsion side, and preferably also to any layer of back layers.

The polyester composed of mainly polyethylene naphthalate and its derivative for use in the present invention will now be described below.

The support for use in the present invention is made of a polyester made up of naphthalenedicarboxylic acid as a major acid component and a compound having two alcoholic hydroxyl groups as a major glycol component.

The acid component of the polyester is mainly naphthalenedicarboxylic acid, but a part (generally less than 50 mol %, preferably less than 30 mol %) of the naphthalenedicarboxylic acid may be replaced by one or more other difunctional carboxylic acids, for example, aromatic dicarboxylic acids, such as terephthalic acid, isophthalic acid, diphenyldicarboxylic acid, diphenyl ether dicarboxylic acid, diphenylsulfonedicarboxylic acid, and diphenoxyethanedicarboxylic acid; aliphatic dicarboxylic acids, such as adipic acid and sebacic acid; and oxy acids, such as oxybenzoic acid and ε-oxycaproic acid.

As the naphthalenedicarboxylic acid, for example, 2,6-naphthalenedicarboxylic acid, 2,7-naphthalenedicarboxylic acid, and 1,5-naphthalenedicarboxylic acid are preferably used.

As the glycol component, can be used a compound having two alcoholic hydroxyl groups, for example, an aliphatic glycol, such as ethylene glycol, propylene glycol, trimethylene glycol, butanediol, neopentylene glycol, hexanediol, decanediol, and diethylene glycol; a cycloaliphatic glycol, such as cyclohexanedimethylol and tricyclodecanediol, and an aromatic diol, such as 2,2-bis(4-β-hydroxyethoxyphenyl) propane, 1,1-bis(4-β-hydroxyethoxyphenyl)cyclohexane, and 4,4'-bis(β-hydroxyethoxy)diphenylsulfone, which may be used alone or as a mixture of one or more. A small amount of a compound having two phenolic hydroxyl groups, such as bisphenol A and bisphenol Z, can be additionally used.

The combination of said acid component with said glycol component is selected such that the obtained polyester has a parallel transmission coefficient of 80% or more when the polyester has thickness of 100 μm.

For example, a copolyester wherein the acid component comprises 2,6-naphthalenedicarboxylic acid and the glycol component comprises 50 to 93.4 mol % of ethylene glycol and 0.6 to 50 mol % of neopentyl glycol, and a copolyester wherein the ethylene-2,6-naphthalenedicarboxylate repeating unit accounts for 10 to 99.4%, preferably 20 to 98%, of all the repeating units, are preferable. As a third component of that copolyester, out of the above acid components and glycol components, for example, terephthalic acid, isophthalic acid, neopentylene glycol, 4,4'-bis(β-hydroxyethoxy-)diphenylsulfone, 2,2-bis(β-hydroxyethoxyphenyl)propane, diethylene glycol, and cyclohexanedimethylol are particularly preferable.

Such a polyester can be produced in accordance with the conventionally known polyester production method. For example, 2,6-naphthalenedicarboxylic acid or its ester forming derivative (e.g., its lower alkyl ester, such as its methyl ester, and its phenyl ester), ethylene glycol and neopentylene glycol or their ester forming derivative are reacted to form a bisglycol ester and/or its oligomer and the bisglycol ester and/or its oligomer is subjected to the polycondensation reaction to obtain a polyester having a prescribed degree of polymerization.

Further, the polyethylene naphthalate and its derivative for use in the present invention may be blended with other polyester.

For example, the acid component and the glycol component are subjected directly to an esterification reaction, or if a dialkyl ester is used as an acid component, the dialkyl ester is first subjected to a transesterification reaction with the glycol component, followed by heating under reduced pressure to remove the excess glycol component, thereby synthesizing the intended polyester. Alternatively, it is possible that, as the acid component, an acid halide is used and it is reacted with a glycol. At that time, if necessary, a transesterification reaction catalyst, or a polymerization reaction catalyst can be used, or a heat-resistant stabilizer may be added. With respect to the method for synthesizing these polyester, reference is made, for example, to *Kobunshi Jikken-gaku*, Vol. 5, "Jushukugo to Jufuka" (Kyoritsu-shuppan, 1980), pages 103 to 136 and "*Goseikobunshi V*" (Asakura-shoten, 1971), pages 187 to 286. A preferable range of the average molecular weight of these polyesters is about 10,000 to 500,000.

Polymer blends of the polymers thus obtained can be formed easily in accordance with methods described in JP-A Nos. 5482/1974, 4325/1989, and 192718/1991, *Research Disclosure* Nos. 283,739–41, 284,779–82, 294,807–14, and 294,807–14.

The glass transition point of the polyester for use in the present invention is preferably 90° C. or over but 200° C. or below.

Preferable specific examples of the polyesters for use in the present invention are shown below, but the present invention is not restricted to them.

Polyester compound examples:

Homopolymer:

PBC-1: [2,6-naphthalenedicarboxylic acid (NDCA)/ethylene glycol (EG) (100/100)](Tg=119° C.)

Copolymers (the entry in the parentheses represents the molar ratio):

PBC-2: 2,6-NDCA/TPA(terephthalic acid)/EG (50/50/100) (Tg=92° C.)

PBC-3: 2,6-NDCA/TPA/EG (75/25/100) (Tg=102° C.)

PBC-4: 2,6-NDCA/TPA/EG/BPA (bisphenol A) (50/50/75/25) (Tg=112° C.)

PBC-5: NDCA/sulfoterephthalic acid/EG (98/2/100) (Tg=117° C.)

Polymer blends (the entry in the parentheses represents the molar ratio):

PBC-6: PBC-1/PET (80/20) (Tg=104° C.)

PBC-7: PAr/PBC-1 (50/50) (Tg=142° C.) (PAr: TPA/BPA=100/100 (Tg=192° C.)) (PET: TPA/EG=100/100 (Tg=80° C.)

PBC-8: PEN/PET/PAr (50/25/25) (Tg=108° C.)

These films may have a polar group (e.g., epoxy, $COO_2M$, OH, $NR_2$, $NR_3X$, $SO_3M$, $OSO_3M$, $PO_3M_2$, and $OP_3M_2$, wherein M represents H, an alkali metal, or ammonia, and R represents H or an alkyl group having 1 to 20 carbon atoms).

The thickness of such a support for use in the first embodiment of the present invention is not particularly restricted, and the usual thickness of support is used.

The thickness of such a support for use in the second embodiment of the present invention is 40 to 500 μm, preferably 60 to 200 μm. If it is too thin, occurrence of gutter-like curl due to shrinkage stress in emulsion layer during drying becomes remarkable and the evenness of film is apt to be deteriorated; and if it is too thick, although the film strength becomes large, not only a large number of sheets of film cannot filled in a cartridge, but also failure of transportation of film in a development processing occurs due to high rigidity of film.

Further, when polyesters composed of mainly polyethylene naphthalate and its derivative are used for a support for photographic materials, it can be mentioned that one of the properties of the support causing a problem, is its high refractive index, which causes the problem of edge fogging.

While the refractive index of polyester, particularly of aromatic polyester, such as polyethylene naphthalates and their derivatives, is as high as 1.6 to 1.7, the refractive index of gelatin, which is the major component of the photosensitive layer applied on the support, is 1.50 to 1.55, which is lower than the former. As a result, when light enters from an film edge, the light is liable to be reflected at the interface between the base and the emulsion layer. Therefore, in the case of polyester-type films, so-called light piping (edge fogging) will take place.

As means of obviating such light piping, for example, a method in which inactive inorganic particles or the like are contained in a film, and a method in which a dye is added, are known. In the present invention, to prevent light piping, preferably a method in which a dye that does not extremely increase the film haze is added, is used.

As fogging mentioned in this specification, it includes fogging resulting from discoloration of support, and further includes fogging resulting from optical interaction of support (such as above mentioned edge fogging), and fogging resulting from physical factors (especially at the time of core set).

There are no particular restrictions on the dye used for dying the film, but the hue for dying is preferably gray, in view of the general properties of the photographic material, and preferably the dye is one excellent in heat resistance in the temperature range at which the polyester film is formed, and it is also preferably excellent in compatibility with the polyester.

From the above point of view, the dye will be made by mixing commercially available dyes for polyesters; for example, by mixing Diaresin, manufactured by Mitsubishi Chemical Industries, Ltd., or Kayaset, manufactured by Nippon Kayaku Co., Ltd.

The dyeing density is required to be at least 0.01 or more, more preferably 0.03 or more, when the color density in the visible region is measured by a color densitometer manufactured by Macbeth Co.

The polyester film according to the present invention may be able to impart slidability depending upon the application, and there are no particular restriction on the slidability imparting means; as the slidability imparting means, a general means, such as incorporation of an inactive inorganic compound or application of a surface-active agent, is used.

That inactive inorganic compound as particles, can be exemplified by $SiO_2$, $TiO_2$, $BaSO_4$, $CaCO_2$, talc, and kaolin. In addition to the slidability impartation by the outer particle system by the addition of inactive particles to the above polyester synthesis reaction system, a means of imparting slidability by an inner particle system can be used in which inner system, when the polymerization reaction for the polyester is carried out, the catalyst to be added or the like is allowed to be deposited.

Although there are no particular restrictions on the slidability imparting means, since the transparency of the support for photographic materials is an important requirement, in the case of the above slidability imparting means, it is desirable that use is made of, as an outer particle system, $SiO_2$ having a refractive index comparatively near that of polyester films, or it is desirable that an inner particle system, in which the particle diameter of the particles that will be deposited can be made relatively small is selected.

Further, if the slidability is imparted by mixing and kneading, it is also preferable to use a technique in which a layer, to which a function for obtaining further transparency of the film has been given, is laminated. Specifically, as that means, in which multiple extruders and feed blocks are used or a multi-manifold die by a co-extrusion technique is used, can be mentioned, for example.

Further, the polyester composed of mainly polyethylene naphthalate or its derivative for use in the first embodiment of the present invention may contain the ultraviolet absorbents, such as at least one of the ultraviolet absorbents of formulae (I) to (IV), and the method for the preparation of them is described below.

The amount of the ultraviolet absorbent for use in the first embodiment of the present invention that will be added to the polyethylene naphthalate and its derivative is in the range of 0.01 to 10%, preferably 0.02 to 3%, based on the weight of all the polyesters. On the other hand, the amount of the ultraviolet absorbent to be added to the polyethylene naphthalate and its derivatives in the second embodiment of the present invention is in the range of 0.02 to 10 $g/m^2$, preferably 0.02 to 5 $g/m^2$, more preferably 0.02 to 3 $g/m^2$. In both embodiments, incorporation of the ultraviolet absorbent into the polyester can be attained in such a manner that, when polyester pellets are formed into a film, the ultraviolet absorbent is added thereto and the pellets are melted (for example, at a temperature in the range of 250° to 300° C.).

The support for use in the present invention can be obtained in such a manner that the polyethylene naphthalate and its derivative are formed into a film in the usual manner, and the film is stretched uniaxially or biaxially, to have the intended thickness. Preferably the thickness of the support for use in the present invention is 40 to 500 μm, more preferably 50 to 250 μm, and particularly preferably 60 to 200 μm.

The support of the polyethylene naphthalate or its derivative for use in the present invention, when used for photography, is subjected to various surface treatments or undercoat treatments, so as to improve adhesion to an emulsion layer (mainly made of a gelatin binder) or a backing layer (made of a gelatin-type binder, a cellulose type binder, a polyester-type binder, or a vinyl polymer-type binder).

For instance, after the support is subjected to a surface-activation treatment, such as a chemical treatment, a mechanical treatment, a corona discharge treatment, a flame treatment, an ultraviolet treatment, a high-frequency treatment, a glow discharge treatment, an active-plasma treatment, a laser treatment, a mixed-acid treatment, and an ozone oxidation treatment, and then a photographic emulsion may be applied directly, thereby securing the adhesion, or, after the support is subjected to these surface treatments or without these surface treatments, an undercoat layer is arranged, and a photographic emulsion layer may be applied thereon.

The undercoat solution may contain various additives, as required, such as a surface-active agent, an antistatic agent, a dye for coloring an antihalation agent, a pigment, a coating aid, and an antifoggant. When the undercoat solution of the present invention is used, the undercoat solution can contain an etching agent, such as resorcin, chloral hydrate, and chlorophenol.

The underlayer can contain inorganic fine particles, for example, of $SiO_2$ or $TiO_2$, or polymethyl methacrylate copolymer fine particles (1 to 10 μm), as a matting agent.

The undercoat solution for use in the present invention can be applied by the generally well-known methods, such as the dip coating process, the air knife coating process, the curtain coating process, the roller coating process, the wire bar coating process, and the gravure coating process, or, for example, by an extrusion coating process that uses a hopper, as described in U.S. Pat. No. 2,681,294. If necessary, two or more layers can be applied simultaneously by techniques described, for example, in U.S. Pat. Nos. 2,761,791, 3,508,947, 2,941,898, and 3,526,528, or written by Yuji Harasaki in *Coating Engineering*, page 253 (published by Asakura-shoten, 1973).

After the formation of a film, the undercoat solution may be biaxially stretched (e.g., three times longitudinally and laterally, respectively), or it is also possible that after a uniaxially stretched polyester film is coated with an undercoat solution, the film may be stretched in the direction orthogonal to the direction of the first stretching to obtain the intended thickness of the support of the present invention that has the undercoat layer.

As a preferable undercoat binder, a polymer or a latex, containing 35 to 96 wt % of nitrocellulose and gelatin vinylidene chloride, 3.5 to 64.5 wt % of an ethylenically unsaturated ester, and 0.5 to 25 wt % of an acid component (e.g., itaconic acid, an itaconic acid half ester, acrylic acid, and methacrylic acid) can be mentioned.

The ethylenically unsaturated ester includes acrylonitrile, methacrylonitrile, styrenevinyl chloride, an acrylate (whose alkyl has 1 to 18 carbon atoms), a methacrylate (whose alkyl has 1 to 18 carbon atoms), and butadiene, with preference given to acrylonitrile, vinyl chloride, styrene, methyl acrylate, ethyl acrylate, butyl acrylate, methyl methacrylate, ethyl methacrylate, butyl methacrylate, and butadiene.

Preferable examples of the polymer for the undercoat are methyl acrylate/vinylidene chloride/itaconic acid (15/83/2 wt %), styrene/butadiene/methacrylic acid (65/30/5 wt %), nitrocellulose, and gelatin.

By heat-treating the polyethylene naphthalate film for use in the present invention after the formation of the film or the undercoating, or after the application of the emulsion, even when the polyethylene naphthalate film is stored in a rolled state, the film hardly undergo core set curl, and it is remarkably excellent in transportability in compact labs and flatness at the time of printing.

Further, since the polyester film for use in the present invention is apt to undergo core set curl as it is in the state of film formed under various circumstances, a heat treatment as a counter-measure for the curl is preferably conducted. For example, in the case of polyethylene terephthalate, polyethylene naphthalate, polyacrylate, or copolymer or polymer blend thereof, for use as a preferable support, a heat fixation-treatment after biaxial stretching is preferably used, or, if necessary, a heat relaxation treatment may be conducted. Further, in order to reduce the core set curl, the support is preferably subjected to a heat treatment at a temperature lower than the glass transition temperature (Tg) of the film.

The film is previously heat-treated at an arbitrary temperature, ranging preferably from 50° C. to Tg, for 0.5 to 1,500 hours, more preferably from (Tg—35° C.) to Tg for 6 to 400 hours. In the case of polyethylene naphthalate (Tg= 119° C.), optimally the treatment should be carried out at a temperature in the range of 90° to 115° C., for 12 to 100 hours. For example, since the Tg of polyethylene naphthalate is about 120° C., polyethylene naphthalate film is heat-treated preferably at a temperature lower than 119° C. for 0.2 to 48 hours, more preferably at 115° C. for 24 hours.

In particular, in order to carry out the heat-treatment in a short period of time, the film is heated to Tg or over and then is cooled gradually around the Tg, which is preferable because the efficiency is improved greatly. For example, in the case of polyethylene naphthalate, a method in which after it is once kept at a temperature from 130° C. or over to 200° C., it is cooled to 125° C., and thereafter it is cooled gradually to 100° C. in a time period for 40 min to 1 hour, can extremely shorten the heat-treatment time.

When the support subjected to such a heat-treatment is analyzed by a differential thermal analyzer, an endothermic peak appears at a temperature near the Tg, and the higher the peak is, the harder the core set curl undergoes. The heat-treatment is carried out preferably at 100 mcal/g or over, more preferably at 200 mcal/g.

Now, the silver halide photographic material according to the present invention is briefly described, and the photographic material is the same one with usual photographic materials except that the photographic material contains ultraviolet absorbent in accordance with the first or second embodiment of the present invention.

The backing layer of the photographic material desirably contains, for example, a matting agent and a slipping agent, solely or in some combination.

Preferable specific examples of the slipping agents (S-1 to S-12) and the matting agents (M-1 to M-9) are shown below, but the present invention is not restricted to them:

Compound examples:

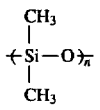

S-1

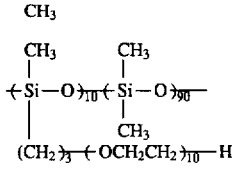

S-2

$C_{15}H_{31}COOC_{16}H_{33}$ S-3

$C_{15}H_{31}COOC_{40}H_{81}(n)$ S-4

$(n)C_{27}H_{55}COOC_{50}H_{101}(n)$ S-5

$(iso)C_{17}H_{35}COOC_{34}H_{69}(iso)$ S-6

$(iso)C_{17}H_{35}COOC_{40}H_{81}(n)$ S-7

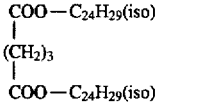

S-8

$(iso)C_{27}H_{55}COO(CH_2)_4OCOC_{27}H_{55}(iso)$ S-9

Erucic amide S-10

$C_{33}H_{67}COOH$ S-11

Liquid paraffin S-12

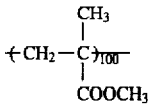

M-1 av. particle diameter: 1.5 μm

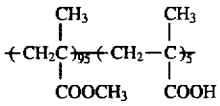

M-2 av. particle diameter: 2.1 μm

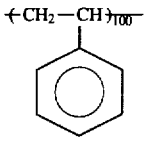

M-3 av. particle diameter: 2.6 μm

-continued

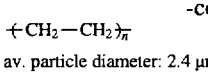

M-4 av. particle diameter: 2.4 μm

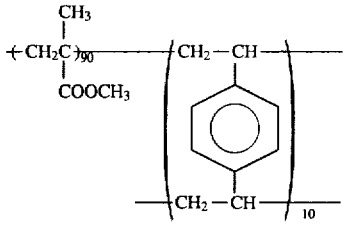

M-5 av. particle diameter: 1.4 μm

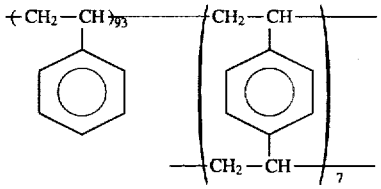

M-6 av. particle diameter: 2.2 μm

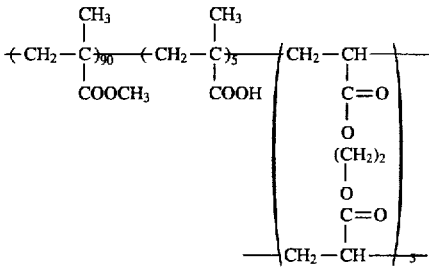

M-7 av. particle diameter: 2.2 μm

Silica (spherical) M-8

Silica (amorphous) M-9

The photographic material of the present invention comprises a silver halide emulsion layer, a backing layer, a protective layer, an intermediate layer, and an antihalation layer, etc., which are mainly hydrophilic colloid layers.

As the binder used in the hydrophilic colloid layers in that case, can be mentioned, for example, proteins, such as gelatin, colloidal albumin, and casein; cellulose compounds, such as carboxymethylcellulose and hydroxyethylcellulose; saccharide derivatives, such as agar, sodium alginate, and starch derivatives; synthetic hydrophilic colloids, such as poly(vinyl alcohol), poly-N-vinylpirrolidone, polyacrylic acid copolymer, polyacrylamide, and their derivatives and partial hydrolyzates; dextran, poly(vinyl acetate), polyacrylate, and rosin, which may be used as a mixture of two or more, if required.

Among them, gelatin and its derivatives are used in most cases, and herein the gelatin includes so-called lime-processed gelatin, acid-processed gelatin, and enzyme-processed gelatin.

In the present invention, anionic surface-active agents, nonionic surface-active agents, cationic surface-active agents, and betaine type fluorine-containing surface-active agents can be additionally used. These fluorine-containing surface-active agents are described, for example, in JP-A No. 10722/1974, British Patent No. 1,330,356, JP-A Nos. 84712/1978, 14224/1979, and 113221/1975, U.S. Pat. Nos. 4,335,201 and 4,347,308, British Patent No. 1,417,915, JP-B Nos. 26687/1977, 26719/1982, and 38573/1984, JP-A Nos. 149938/1980, 48520/1979, 14224/1979, 200235/1983, 146248/1982, and 196544/1983, and British Patent No. 1,439,402.

Preferable specific examples of fluorine-containing surface-active agents are given below:

$C_8F_{17}SO_3K$ A-1

$C_7F_{15}COONa$ A-2

$C_8F_{17}SO_3N(C_3H_7)-CH_2COOK$ A-3

$C_8F_{17}SO_3N(C_3H_7)-(CH_2CH(OH)CH_2O)_3-(CH_2)_4-SO_3Na$ A-4

$C_8F_{17}SO_3N(C_3H_7)-(CH_2CH_2O)_4-(CH_2)_4-SO_3Na$ A-5

$C_8F_{17}SO_3NCH_2CH_2O-P(=O)(ONa)-ONa$ A-6

$C_8F_{17}CH_2CH_2OOC-CH_2$
$C_8H_{17}OOC-CH-SO_3Na$ A-7

$C_8F_{17}SO_2N(H)CH_2CH_2CH_2(OCH_2CH_2)_3{}^+N(CH_3)_2-CH_2COO^-$ A-8

$C_8F_{17}SO_2N(H)CH_2CH_2{}^+N(CH_3)_2-CH_3.I^-$ A-9

$C_8F_{17}SO_2N(H)CH_2CH_2CH_2(OCH_2CH_2)_3{}^+N(CH_3)_2-CH_3.CH_3-C_6H_4-SO_3^-$ A-10

$C_8F_{17}SO_2N(C_{10}H_{21})-(CH_2CH_2O)_{16}-H$ A-11

In the present invention, nonionic surface-active agents may be used.

Specific examples of the nonionic surface-active agents preferably used in the present invention are shown below:

$C_{11}H_{33}COO-(CH_2CH_2O)_8-H$ N-1

$C_{17}H_{35}COO-(CH_2CH_2O)_5-(CH_2-CH(OH)-CH_2)_3-(CH_2CH_2O)_5-H$ N-2

$C_{16}H_{33}CO-(CH_2CH_2O)_{12}-H$ N-3

$C_9H_{19}-C_6H_4-O-(CH_2CH_2O)_{10}-H$ N-4

$H-(OCH_2CH_2)_{10}-O$, $CH_3$, $CH$, $O-(CH_2CH_2O)_{10}-H$, $t\text{-}C_5H_{11}$, $C_5H_{11}\text{-}t$, $C_5H_{11}\text{-}t$, $C_5H_{11}\text{-}t$ N-5

The layer to which the fluorine-containing surface-active agent and the nonionic surface-active agent are coated for use in the present invention is not particularly restricted, as long as it comprises at least one layer of the photographic material and the layer includes, for example, a surface-protective layer, an emulsion layer, an intermediate layer, an undercoat layer, and a backing layer.

The amount of the fluorine-containing surface-active agent for use in the present invention is preferably 0.0001 to 1 g, more preferably 0.0005 to 0.5 g, and particularly preferably 0.0005 to 0.2 g, per square meter of the photographic material. These surface-active agents may be used as a mixture of two or more.

Polyol compounds, such as ethylene glycol, propylene glycol, 1,1,1-trimethylolpropane, and as described in JP-A No. 89626/1979, can be added to the protective layer or other layers of the photographic material of the present invention.

To the photographic constitutional layers according to the present invention, other known surface-active agents may be added, solely or in some combination. They are used as a coating aid, but in some cases they can also be used for other purposes; for example, for the purpose of emulsification and dispersion, sensitization, and other improvements in photographic properties.

Further, in the present invention, a slipping composition, such as denatured silicones, as described, for example, in U.S. Pat. Nos. 3,079,837, 3,080,317, 3,545,970, and 3,284,537 and JP-A No. 129520/1977, can be contained in the photographic constitutional layers. Further, higher aliphatic acid esters are also effective.

The photographic material of the present invention can contain, in the photographic constitutional layers, polymer latices, as described, for example, in U.S. Pat. Nos. 3,411,911 and 3,411,912 and JP-B No. 5331/1970.

The silver halide emulsion layer and the other hydrophilic colloid layers in the photographic material of the present invention can be hardened with various organic or inorganic hardeners (solely or in some combination).

As particularly preferable typical examples of the silver halide color photographic material in the present invention, color reversal films and color negative films can be mentioned. In particular, general-purpose color negative films are preferable color photographic materials.

Descriptions will be made hereinbelow with reference to general-purpose color negative films.

It is sufficient that the photographic material, utilizing polyester film, of the present invention has on a support at least one silver halide emulsion layer of a blue-sensitive layer, a green-sensitive layer, or a red-sensitive layer, and there is no particular restriction on the number of silver halide emulsion layers and nonsensitive layers or on the order of these layers. A typical example is a silver halide photographic material having on a support at least one photosensitive layer comprising multiple silver halide emulsion layers that have substantially the same color sensitivity but are different in photographic sensitivity, wherein said photosensitive layer is a unit photosensitive layer having color sensitivity to any one of blue light, green light, and red light. In the case of a multilayer silver halide color photographic material, generally the arrangement of unit photosensitive layers is such that a red-sensitive layer, a green-sensitive layer, and a blue-sensitive layer are placed in the stated order from the support side. However, the order of the arrangement may be reversed in accordance with the purpose, and between layers having the same color sensitivity there may be placed a different photosensitive layer.

A nonphotosensitive layer, such as various intermediate layers, may be placed between or on top of or beneath the above-mentioned silver halide photosensitive layers.

Said intermediate layers may contain couplers and DIR compound as described, for example, in JP-A Nos. 43748/

1986, 113438/1984, 113440/1984, 20037/1986, and 20038/1986, and also may contain color-mix preventing layers as usually used.

Multiple silver halide emulsion layers constituting each unit photosensitive layer are described, for example, in West German Patent No. 1,121,470 or British Patent No. 923,045, or in JP-A Nos. 112751/1982, 200350/1987, 206541/1987, 206543/1987, 25738/1981, 63936/1987, and 202464/1984, and JP-B Nos. 34932/1980 and 15495/1974.

The silver halide grains may have a regular crystal form, such as a cubic shape, an octahedral shape, and a tetradecahedral shape, or an irregular crystal shape, such as spherical shape or a tabular shape, or they may have a crystal defect, such as twin planes, or they may have a composite crystal form.

The silver halide grains may be fine grains having a diameter of about 0.2 μm or less, or coarse grains with the diameter of the projected area being down to about 10 μm, and they may be a polydisperse emulsion or a monodisperse emulsion.

The silver halide emulsions that can be used in the present invention may be prepared suitably by known means, for example, by the methods described in *I. Emulsion Preparation and Types*, in *Research Disclosure* (RD) No. 17643 (December 1978), pp. 22–23, and ibid. No. 18716 (November 1979), p. 648; the methods described in P. Glafkides, *Chimie et Phisique Photographique*, Paul Montel. (1967), in G. F. Duffin, *Photographic Emulsion Chemistry*, Focal Press (1966), and in V. L. Zelikman et al., *Making and Coating Photographic Emulsion*, Focal Press (1964).

A monodisperse emulsion, such as described in U.S. Pat. Nos. 3,574,628 and 3,655,394, and in British Patent No. 1,413,748, is also preferable.

Tabular grains having an aspect ratio of about 5 or greater can be used in the emulsion of the present invention. Tabular grains can be easily prepared by the methods described in, for example, Gutoff, *Photographic Science and Engineering*, Vol. 14, pp. 248–257 (1970), U.S. Pat. Nos. 4,434,226, 4,414,310, 4,433,048, and 4,439,520, and British Patent No. 2,112,157.

The crystal structure of silver halide grains may be uniform, the outer halogen composition of the crystal structure may be different from the inner halogen composition, or the crystal structure may be layered. Silver halides whose compositions are different may be joined by the epitaxial joint, or a silver halide may be joined, for example, to a compound other than silver halides, such as silver rhodanide, lead oxide, etc.

Further, a mixture of grains having various crystal forms may be used.

The silver halide emulsion may be used generally that has been physically ripened, chemically ripened, and spectrally sensitized. When an emulsion sensitized by a gold compound and sulfur-containing compound is used, the efficiency of the present invention can be particularly remarkably found. Additives that will be used in these steps are described in *Research Disclosure* No. 17643, and No. 18716, and involved sections are listed in the Table shown below.

Known photographic additives that can be used in the present invention are also described in the above-mentioned two Research Disclosures, and involved sections are listed in the same Table below.

| Kind of Additive | RD 17643 | RD 18716 |
|---|---|---|
| 1 Chemical sensitizer | p. 23 | p. 648 (right column) |
| 2 Sensitivity-enhancing agent | — | p. 648 (right column) |
| 3 Spectral sensitizers and Supersensitizers | pp. 23–24 | pp. 648 (right column)–649 (right column) |
| 4 Brightening agents | p. 24 | |
| 5 Antifogging agents and Stabalizers | pp. 24–25 | p. 649 (right column)– |
| 6 Light absorbents, Filter dyes and Ultraviolet absorbents | pp. 25–26 | p. 649 (right column)–650 (left column) |
| 7 Stain-preventing agent | p. 25 (right column) | p. 650 (left to right column) |
| 8 Color-image stabilizers | p. 25 | |
| 9 Film hardeners | p. 26 | p. 651 (left column) |
| 10 Binders | p. 26 | p. 651 (left column) |
| 11 Plasticizers and Lubricants | p. 27 | p. 650 (right column) |
| 12 Coating aids and Surface-active agents | pp. 26–27 | p. 650 (right column) |

Further, in order to prevent the lowering of photographic characteristics due to formaldehyde gas, a compound described in, for example, U.S. Pat. Nos. 4,411,987 and 4,435,503 that is able to react with formaldehyde to immobilize is preferably added to the photographic material.

In the present invention, various color couplers can be used, and concrete examples of them are described in patents cited in the above-mentioned *Research Disclosure* No. 17643, VII-C to G.

As yellow couplers, compounds described in, for example, U.S. Pat. Nos. 3,933,501, 4,022,620, 4,326,024, 4,401,752, and 4,248,961, JP-B No. 10739/1983, British Patent Nos. 1,425,020 and 1,476,760, U.S. Pat. Nos. 3,973,968, 4,314,023, and 4,511,649, and European Patent No. 249,473A are preferable.

As magenta couplers, 5-pyrazolone series and pyrazoloazole series compounds are preferable, and compounds described in, for example, U.S. Pat. Nos. 4,310,619 and 4,351,897, European Patent No. 73,636, U.S. Pat. Nos. 3,061,432 and 3,725,067, *Research Disclosure* No. 24220 (June 1984), JP-A No. 33552/1985, *Research Disclosure* No. 24230 (June 1984), JP-A Nos. 43659/1985, 72238/1986, 35730/1985, 118034/1980, and 185951/1985, U.S. Pat. Nos. 4,500,630, 4,540,654, and 4,556,630, and WO (PCT) No. 88/04795 are preferable, in particular.

As cyan couplers, phenol series couplers and naphthol series couplers can be mentioned, and those described in U.S. Pat. Nos. 4,052,212, 4,146,396, 4,228,233, 4,296,200, 2,369,929, 2,801,171, 2,772,162, 2,895,826, 3,772,002, 3,758,308, 4,334,001, and 4,327,173, West German Patent Application (OLS) No. 3,329,729, European Patent Nos. 121,365A and 249,453A, U.S. Pat. Nos. 3,446,622, 4,333,999, 4,753,871, 4,451,559, 4,427,767, 4,690,889, 4,254,212, and 4,296,199, and JP-A No. 42658/1986 are preferable.

As a colored coupler to rectify the unnecessary absorption of color-forming dyes, those described in, paragraph VII-G of *Research Disclosure* No. 17643, U.S. Pat. No. 4,163,670, JP-B No. 39413/1982, U.S. Pat. Nos. 4,004,929 and 4,138,258, and British Patent No. 1,146,368 are preferable.

As a coupler having moderate diffusibility for color-forming dyes, those described in U.S. Pat. No. 4,366,237, British Patent No. 2,125,570, European Patent No. 96,570, and West German Patent Application (OLS) No. 3,234,533 are preferable.

Typical examples of polymerized dye-forming coupler are described in, for example, U.S. Pat. Nos. 3,451,820, 4,080,211, 4,367,282, 4,409,320, and 4,576,910, and British Patent No. 2,102,173.

A coupler that releases a photographically useful residue accompanied with the coupling reaction can be used favorably in this invention. As a DIR coupler that release a development retarder, those described in patents cited in paragraph VII-F of the above-mentioned *Research Disclosure* No. 17643, JP-A Nos. 151944/1982, 154234/1982, 184248/1985, and 37346/1988, and U.S. Pat. No. 4,248,962 are preferable.

As a coupler which releases, imagewisely, a nucleating agent or a development accelerator upon developing, those described in British Patent Nos. 2,097,140 and 2,131,188, and JP-A Nos. 157638/1984 and 170840/1984 are preferable.

Other couplers that can be incorporated in the photographic material of the present invention include competitive couplers, as described in U.S. Pat. No. 4,130,427; multi-equivalent couplers, as described in U.S. Pat. Nos. 4,283,472, 4,338,393, and 4,310,618; couplers which release a DIR redox compound, couplers which release a DIR coupler, redox compounds which release a DIR coupler and redox compounds which release a DIR redox, as described in JP-A Nos. 185950/1985 and 24252/1987; couplers which release a dye to regain a color after releasing, as described in European Patent No. 173,302A; couplers which release a bleaching-accelerator, as described in *Research Disclosure* Nos. 11449 and 24241, and JP-A No. 201247/1986; couplers which release a ligand as described in U.S. Pat. No. 4,553,477; and couplers which release a leuco dye, as described in JP-A No. 75747/1988.

Couplers for use in the present invention can be incorporated into a photographic material by various known dispersion methods.

Examples of high-boiling solvent for use in oil-in-water dispersion process are described in, for example, U.S. Pat. No. 2,322,027.

As specific examples of high-boiling organic solvent having a boiling point of 175° C. or over at atmospheric pressure for use in oil-in-water dispersion process can be mentioned phthalates, esters of phosphoric acid or sulphonic acid, benzoic esters, amides, alcohols or phenols aliphatic carbonic acid esters, aniline derivatives, and hydrocarbons. Further, as a co-solvent an organic solvent having a boiling point of about 30° C. or over, preferably a boiling point in the range from 50° C. to about 160° C. can be used, and as typical example can be mentioned ethyl acetate, butyl acetate, ethyl propionate, methylethyl ketone, cyclohexanone, 2-ethoxyethyl acetate, and diethyl formamide.

Specific examples of process and effects of latex dispersion method, and latices for impregnation are described in, for example, U.S. Pat. No. 4,199,363 and West German Patent Application (OLS) Nos 2,541,274 and 2,541,230.

With regard to the photographic material to be utilized in the present invention, preferably the total layer thickness of all the hydrophilic colloid layers on the side having emulsion layers is 28 μm or below, and the film swelling speed $T_{1/2}$ is preferably 30 sec or below. The term "layer thickness" means layer thickness measured after moisture conditioning at 25° C. and a relative humidity of 55% (for two days), and the film swelling speed $T_{1/2}$ can be measured in a manner known in the art. For example, the film swelling speed $T_{1/2}$ can be measured by using a swellometer (swell-measuring meter) of the type described by A. Green et al. in *Photographic Science and Engineering*, Vol. 19, No. 2, pp. 124–129, and $T_{1/2}$ is defined as the time required to reach a film thickness of $T_{1/2}$ of the saturated film thickness that is 90% of the maximum swelled film thickness that will be reached when the film is treated with a color developer at 30° C. for 3 min 15 sec.

The film swelling speed $T_{1/2}$ can be adjusted by adding a hardening agent to the gelatin that is a binder or by changing the time conditions during the coating. Preferably the ratio of swelling is 150 to 400%. The ratio of swelling is calculated from the maximum swelled film thickness obtained under the above conditions according to the formula: (Maximum swelled film thickness −film thickness)/Film thickness.

The color photographic material to be utilized in the present invention can be subjected to the development processing by an ordinary method as described in the above-mentioned *Research Disclosure* No. 17463, pp. 28–29, ibid. No. 18716, p. 615, from left column to right column.

In the silver halide color photographic material to be utilized in the present invention, a color developing agent can be incorporated for the purpose of simplifying and shortening of processing. To incorporate the agent, preferably various precursors of color developing agent are used. As such compounds, can be mentioned, as described in Research Disclosure No. 13924, an indaniline series compound, as described in U.S. Pat. No. 3,342,597, and a Shiff basic type compound, as described in U.S. Pat. No. 3,342,597, *Research Disclosure* Nos. 14,850 and 15,159.

When the thus made photographic material is used in a rolled state, preferably it takes the form wherein it is housed in a cartridge. The most general cartridge is the patrone for the present 135 format. Also, cartridges suggested in Publication of unexamined Japanese Utility Model Application No. 67329/1983, JP-A Nos. 181035/1983 and 182634/1983, Publication of unexamined Japanese Utility Model Application No. 195236/1983, and U.S. Pat. Nos. 4,221,479, 4,846,418, 4,848,693, and 4,832,275 can be used.

The cartridge that is used is made mainly of a metal or a synthetic plastic. To mold the plastic, the plastic is mixed with a plasticizer, if required. Typical examples of the plasticizer are trioctyl phosphate, tributyl phosphate, dibutyl phthalate, diethyl sebacate, methyl amyl ketone, nitrobenzene, γ-valerolactone, di-n-octyl succinate, bromonaphthalene, and butyl palmitate.

Specific examples of the plastic material are shown below, but the present invention is not restricted to them.

Specifically there are polystyrenes, polyethylenes, polypropylenes, polymonochlorotrifluoroethylenes, vinylidene chloride resins, vinyl chloride resins, vinyl chloride/vinyl acetate copolymer resins, acrylonitrile/butadiene/styrene copolymer resins, methyl methacrylate resins, vinyl formal resins, vinyl butyral resins, polyethylene terephthalates, Teflons, nylons, phenol resins, melamine resins, polyacetals, and polybutyrals.

Particularly preferable plastic materials are, for example, polystyrenes, polyethylenes, and polypropylenes.

These cartridges may contain various antistatic agents. There are no particular restrictions on the antistatic agents and preferably carbon black, metal oxide particles, nonionic surface-active agents, anionic surface-active agents, cationic surface-active agents, and betaine type surface-active agents, nonionic polymer, anionic polymer, cationic polymer, and betaine polymer, etc., can be used. Cartridges that have been rendered antistatic are described in JP-A Nos. 312537/1989 and 312538/1989.

Generally, the cartridge is manufactured by using a plastic to which carbon black and pigments have been mixed for allowing the cartridge to cut off light.

Further, the size of the cartridge may be one presently used, but if the diameter of the cartridge, which is presently 25 m/m, is 22 m/m or below, preferably 20 m/m or below, but 8 m/m or over, it is effective for downsizing a camera.

According to the present invention, photographic materials that hardly undergo core set curl over time and that are excellent in preservability, can be obtained.

Further, photographic materials excellent in transportability through compact labs can be obtained.

Now the present invention is described in detail in accordance with examples, but the invention is not limited to them.

EXAMPLE 1

1-1) Preparation of Support

Polyethylene naphthalate prepared from ethylene glycol and dimethyl 2,6-naphthalenedicarboxylate was melt and brought to film, and then the film was stretched uniaxially. On the both sides of the film, an aqueous dispersion of poly(vinylidene chloride)/acrylonitrile/itaconic acid (92:5:3 in molar ratio)(coated amount after restretching of film: 0.1 g/m$^2$), sodium dodecylbenzenesulfonate (2 mg/m$^2$), silica particles (average particle diameter: 0.3 μm, 9 mg/m$^2$), polystyrene/divinylbenzene particles (average particle diameter: 1.0 μm, 2 mg/m$^2$), 2-hydroxy-4,6-dichloro-1,3,5-triazine (35 mg/m$^2$), and trimethylolpropanetriazilidine (10 mg/m$^2$) were coated, and the coated film was subjected to restretching treatment in the course of drying, thereby preparing a support having first undercoated layers of poly(vinilidene chloride) on the both sides thereof. The thickness of polyethylene naphthalate prepared was 75 μm.

Then, on one side of the film, after a corona discharge treatment, gelatin (0.2 g/m$^2$), polyoxyethylene dodecylether (polymerization degree: 10)(2 mg/m$^2$), and $(CH_2{=}CH{-}SO_2NHCH_2)_2$ (10 mg/m$^2$) were coated so as to be a second undercoated layer for emulsion coating side of the support. Another side was regarded as back side.

1-2) preparation of back surface

First and second backing layers having compositions shown below were given on the back side of the undercoated support prepared in 1-1).

| (a) First backing layer | |
|---|---|
| Gelatin | 0.02 g/m$^2$ |
| $SnO_2/Sb_2O_3/SiO_2$ (90/10/0.7 in wt. ratio) (average particle diameter: 0.05 μm) | 0.2 g/m$^2$ |
| $V_2O_5$ (needle, length: 2 μm, width: 0.01 μm) | 0.05 g/m$^2$ |
| Condensation product of 3 mol of toluenediisocyanate and 1 mol of trimethylolpropane | 0.005 g/m$^2$ |
| **(b) Second backing layer** | |
| Cellulose diacetate | 1.2 g/m$^2$ |
| Condensation product of 3 mol of toluenediisocyanate and 1 mol of trimethylolpropane | 0.24 g/m$^2$ |
| S-1 | 0.01 g/m$^2$ |
| S-4 | 0.005 g/m$^2$ |
| $C_{18}H_{35}OCO{-}(CH_2)_{18}{-}COOC_{18}H_{35}$ | 0.005 g/m$^2$ |
| $C_{21}H_{43}COO{-}[(CH_2)_{10}{-}OOC{-}(CH_2)_6{-}COO(CH_2)_{10}O]_2{-}OCC_{21}H_{43}$ | 0.005 g/m$^2$ |
| Ultraviolet absorbent | see Table 2 |
| Polysiloxane | 0.005 g/m$^2$ |

1-3) Preparation of emulsion layer surface

Samples were prepared by coating photographic material shown below on the undercoated layer of emulsion coating side prepared in 1-1). That is, multilayer color photographic material samples 1-1 to 1-6 were prepared by multicoating of each layers having composition shown below.

(Compositions of photosensitive layers)

Main materials used in each layer were classified as follows:

| | |
|---|---|
| ExC: cyan coupler, | ExS: sensitizing dye, |
| ExM: magenta coupler, | HBS: high-boiling organic solvent, |
| ExY: yellow coupler, | H: gelatin hardening agent, |

Figures corresponding to each component represents the coating amount in terms of g/m$^2$, and for silver halide in terms of silver. With respect to sensitizing dyes, the coating amount is shown in mol per mol of silver halide in the same layer.

| First layer (Halation-preventing layer) | |
|---|---|
| Black colloidal silver | silver 0.18 |
| Gelatin | 1.40 |
| ExM-1 | 0.18 |
| ExF-1 | $2.0 \times 10^{-3}$ |
| HBS-1 | 0.20 |
| **Second layer (intermediate layer)** | |
| Emulsion G | silver 0.065 |
| 2,5-di-t-pentadecylhydroquinone | 0.18 |
| ExC-2 | 0.020 |
| UV-absorbent | see Table 2 |
| HBS-1 | 0.10 |
| HBS-2 | 0.020 |
| Gelatin | 1.04 |
| **Third layer (Low sensitivity red-sensitive emulsion layer)** | |
| Emulsion A | silver 0.25 |
| Emulsion B | silver 0.25 |
| ExS-1 | $6.9 \times 10^{-5}$ |
| ExS-2 | $1.8 \times 10^{-5}$ |
| ExS-3 | $3.1 \times 10^{-4}$ |
| ExC-1 | 0.17 |
| ExC-3 | 0.030 |
| ExC-4 | 0.10 |
| ExC-5 | 0.020 |
| ExC-7 | 0.0050 |

-continued

| | |
|---|---|
| ExC-8 | 0.010 |
| Cpd-2 | 0.025 |
| HBS-1 | 0.10 |
| Gelatin | 0.87 |
| **Fourth layer (Medium sensitivity red-sensitive emulsion layer)** | |

| | |
|---|---|
| Emulsion D | silver 0.70 |
| ExS-1 | $3.5 \times 10^{-4}$ |
| ExS-2 | $1.6 \times 10^{-5}$ |
| ExS-3 | $5.1 \times 10^{-4}$ |
| ExC-1 | 0.13 |
| ExC-2 | 0.060 |
| ExC-3 | 0.0070 |
| ExC-4 | 0.090 |
| ExC-5 | 0.025 |
| ExC-7 | 0.0010 |
| ExC-8 | 0.0070 |
| Cpd-2 | 0.023 |
| HBS-1 | 0.10 |
| Gelatin | 0.75 |
| Fifth layer (High sensitivity red-sensitive emulsion layer) | |
| Emulsion E | silver 1.40 |
| ExS-1 | $2.4 \times 10^{-4}$ |
| ExS-2 | $1.0 \times 10^{-4}$ |
| ExS-3 | $3.4 \times 10^{-4}$ |
| ExC-1 | 0.12 |
| ExC-3 | 0.045 |
| ExC-6 | 0.020 |
| ExC-8 | 0.025 |
| Cpd-2 | 0.050 |
| HBS-1 | 0.22 |
| HBS-2 | 0.19 |
| Gelatin | 1.20 |
| Sixth layer (Intermediate layer) | |
| Cpd-1 | 0.10 |
| HBS-1 | 0.50 |
| Gelatin | 1.10 |
| Seventh layer (Low sensitivity green-sensitive emulsion layer) | |
| Emulsion C | silver 0.35 |
| ExS-4 | $3.0 \times 10^{-5}$ |
| ExS-5 | $2.1 \times 10^{-4}$ |
| ExS-6 | $8.0 \times 10^{-4}$ |
| ExM-1 | 0.010 |
| ExM-2 | 0.33 |
| ExM-3 | 0.086 |
| ExY-1 | 0.015 |
| HBS-1 | 0.30 |
| HBS-3 | 0.010 |
| Gelatin | 0.73 |
| Eighth layer (Medium sensitivity green-sensitive emulsion layer) | |
| Emulsion D | silver 0.80 |
| ExS-4 | $3.2 \times 10^{-5}$ |
| ExS-5 | $2.2 \times 10^{-4}$ |
| ExS-6 | $8.4 \times 10^{-4}$ |
| ExM-2 | 0.13 |
| ExM-3 | 0.030 |
| ExY-1 | 0.018 |
| HBS-1 | 0.16 |
| HBS-3 | $8.0 \times 10^{-3}$ |
| Gelatin | 0.90 |
| Ninth layer (High sensitivity green-sensitive emulsion layer) | |
| Emulsion E | silver 1.25 |
| ExS-4 | $3.7 \times 10^{-5}$ |
| ExS-5 | $8.1 \times 10^{-5}$ |
| ExS-6 | $3.2 \times 10^{-4}$ |
| ExC-1 | 0.010 |
| ExM-1 | 0.030 |
| ExM-4 | 0.040 |
| ExM-5 | 0.019 |
| Cpd-3 | 0.040 |
| HBS-1 | 0.25 |
| HBS-2 | 0.10 |
| Gelatin | 1.44 |
| Tenth layer (Yellow filter layer) | |
| Yellow colloidal silver | silver 0.030 |

| | |
|---|---|
| Cpd-1 | 0.16 |
| HBS-1 | 0.60 |
| Gelatin | 0.60 |
| Eleventh layer (Low sensitivity blue sensitive emulsion layer) | |
| Emulsion C | silver 0.18 |
| ExS-7 | $8.6 \times 10^{-4}$ |
| ExY-1 | 0.020 |
| ExY-2 | 0.22 |
| ExY-3 | 0.50 |
| ExY-4 | 0.020 |
| HBS-1 | 0.28 |
| Gelatin | 1.10 |
| Twelfth layer (Medium sensitivity blue-sensitive emulsion layer) | |
| Emulsion D | silver 0.40 |
| ExS-7 | $7.4 \times 10^{-4}$ |
| ExC-7 | $7.0 \times 10^{-3}$ |
| ExY-2 | 0.050 |
| ExY-3 | 0.10 |
| HBS-1 | 0.050 |
| Gelatin | 0.78 |
| Thirteenth layer (High sensitivity blue-sensitive emulsion layer) | |
| Emulsion F | silver 1.00 |
| ExS-7 | $4.0 \times 10^{-4}$ |
| ExY-2 | 0.10 |
| ExY-3 | 0.10 |
| HBS-1 | 0.070 |
| Gelatin | 0.86 |
| Fourteenth layer (First protective layer) | |
| UV-absorbent | see Table 2 |
| Emulsion G | silver 0.20 |
| HBS-1 | $5.0 \times 10^{-2}$ |
| Gelatin | 1.00 |
| Fifteenth layer (Second protective layer) | |
| H-1 | 0.40 |
| B-1 (diameter: 2.3 μm) | $5.0 \times 10^{-2}$ |
| B-2 (diameter: 2.3 μm) | 0.10 |
| B-3 | 0.10 |
| SS-1 | 0.20 |
| Gelatin | 1.20 |

Further, in order to improve preservability, processability, pressure resistance, antimold and antibacterial properties, antistatic property, and coating property, compounds of W-1 to W-3, B-4 to B-6, and F-1 to F-17, and salts of iron, lead, gold, platinum, iridium, and rhodium were suitably added in each layer.

Details of emulsions used in this Example are shown in Table 1.

In Table 1, (1) Emulsions A to F were subjected to a reduction sensitization using thiourea dioxide and thiosulfonic acid at preparation of grains, according to the Example described in JP-A No. 191938/1990.

(2) Emulsions A to F were subjected to a gold sensitization, a sulfur sensitization, and a selenium sensitization under the presence of respective sensitizing dyes described in each layer and sodium thiocyanate, according to Example described in JP-A No. 237450/1991.

(3) At the preparation of tabular grains, low-molecular-weight gelatin was used according to Example described in JP-A No. 158426/1989.

(4) Tabular grains and normal crystal grains having grain structure were observed a rearrangement line by a high-pressure electron microscope, as described in JP-A No. 237450/1991.

TABLE 1

| | Average | Grain Size | | | Ratio of silver amount | | |
|---|---|---|---|---|---|---|---|
| | AgI content (%) | Average Diameter (μm) | Deviation coefficient (%) | Ratio of Diameter/ Thickness | [core/shell] or [core/intermediate/shell] (AgI content %) | | Grain structure and shape |
| Emulsion A | 4.0 | 0.45 | 27 | 1 | [1/3] | (13/1) | Double structure octahedral grains |
| Emulsion B | 8.9 | 0.70 | 14 | 1 | [3/7] | (25/2) | Double structure octahedral grains tabular grains |
| Emulsion D | 9.0 | 0.65 | 25 | 6 | [12/59/29] | (0/11/8) | Triple structure tabular grains |
| Emulsion E | 9.0 | 0.85 | 23 | 5 | [8/59/33] | (0/11/8) | Triple structure tabular grains |
| Emulsion F | 14.5 | 1.25 | 25 | 3 | [37/63] | (34/3) | Double structure tabular grains |
| Emulsion G | 1.0 | 0.07 | 15 | 1 | — | | Uniform structure fine grains |

ExC-1

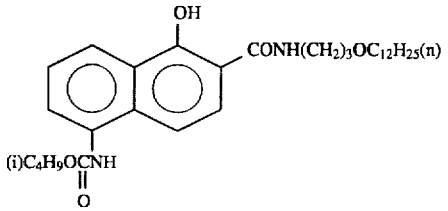

ExC-2

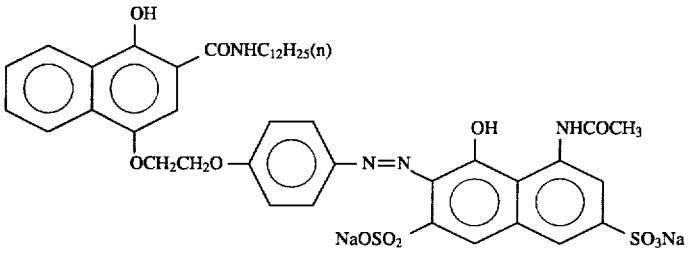

ExC-3

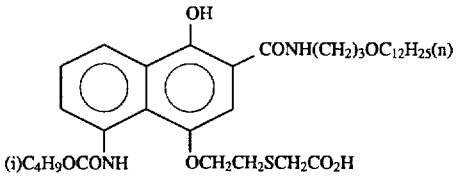

ExC-4

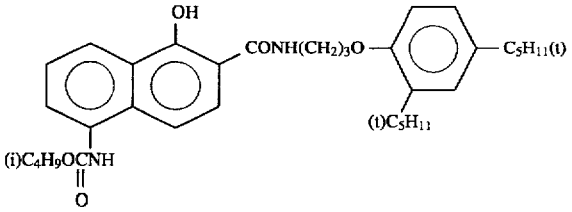

-continued
ExC-5
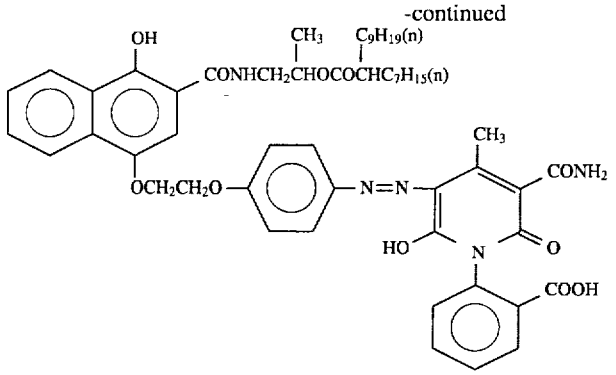
ExC-6
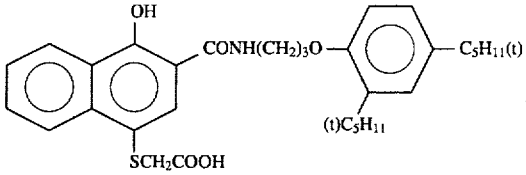
ExC-7
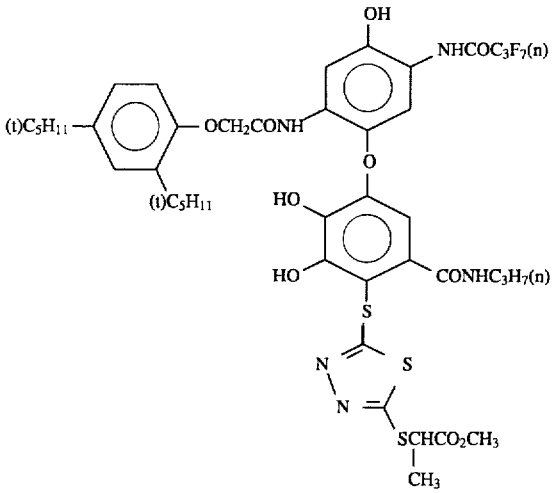
ExC-8
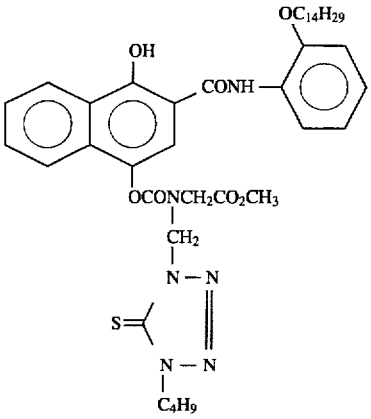

-continued
ExM-1
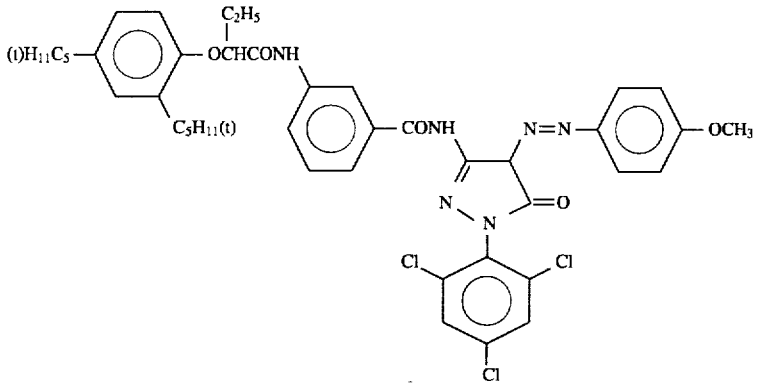
ExM-2
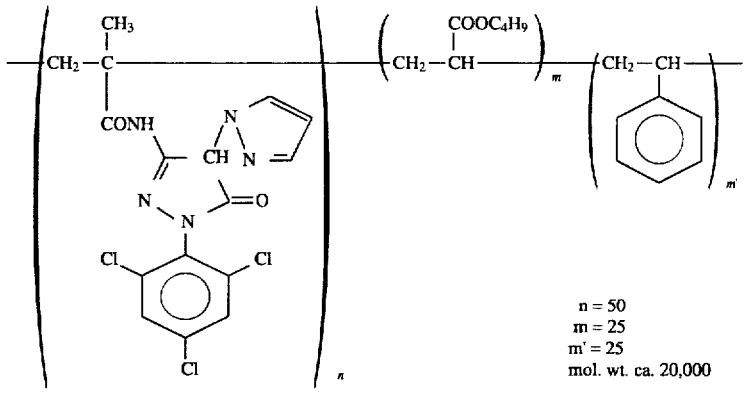
n = 50
m = 25
m' = 25
mol. wt. ca. 20,000
ExM-3
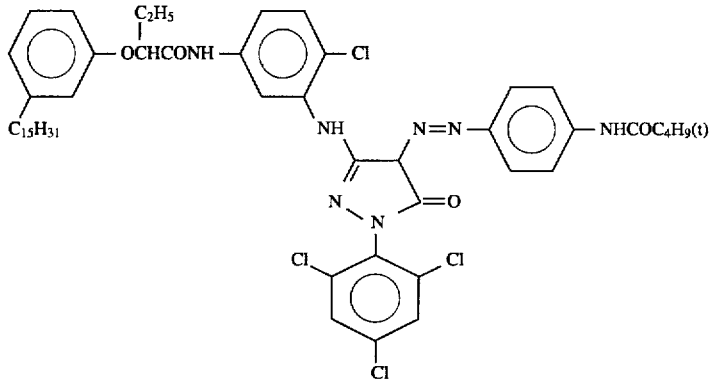
ExM-4
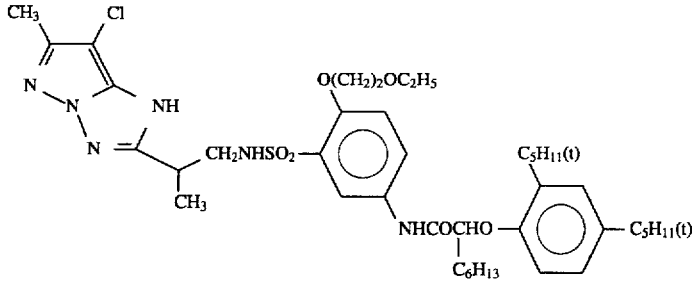

-continued
ExM-5
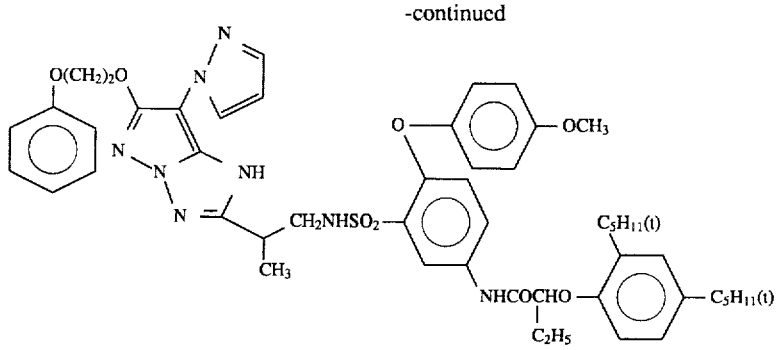
ExY-1
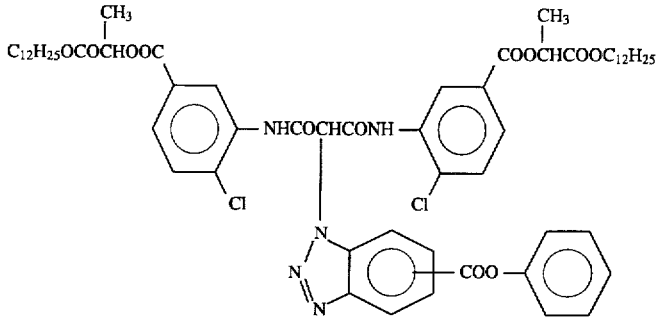
ExY-2
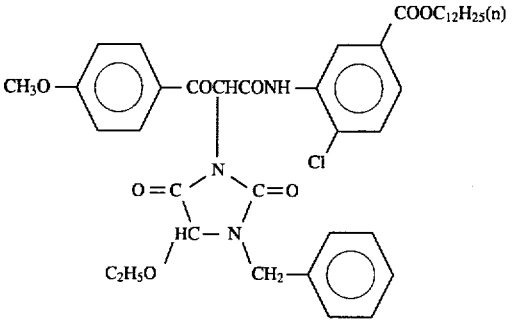
ExY-3
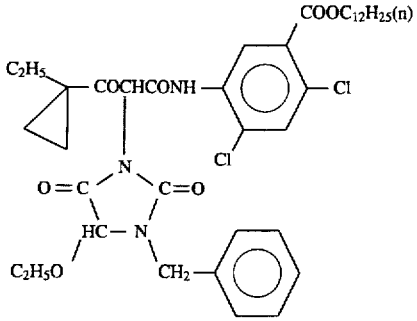
ExY-4
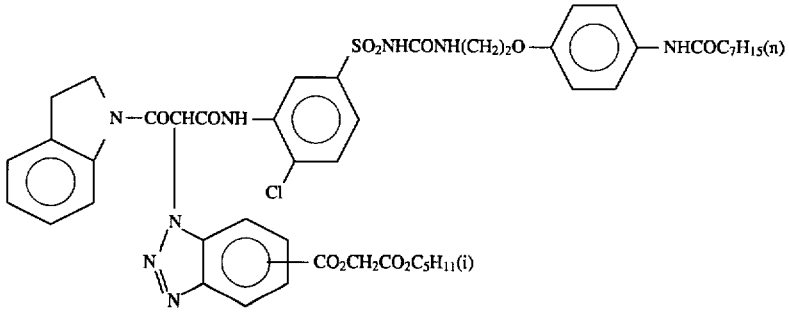

-continued
ExF-1
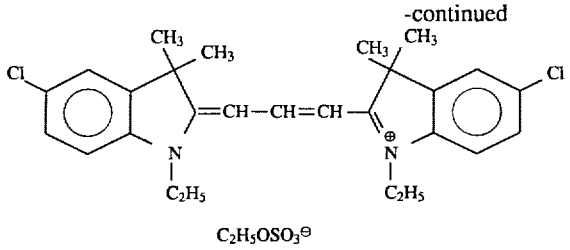
Cpd-1
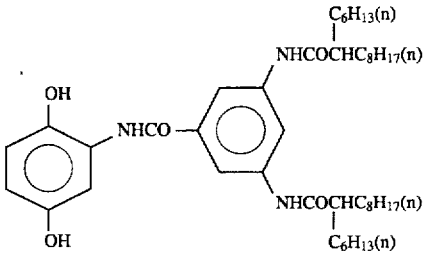
Cpd-2
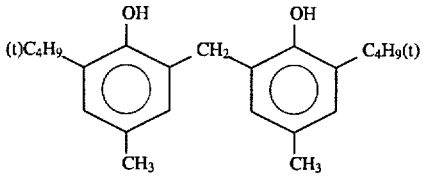
Cpd-3
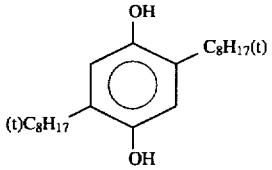
Tricresyl phosphate HBS-1
Di-n-butyl phthalate HBS-2
HBS-3
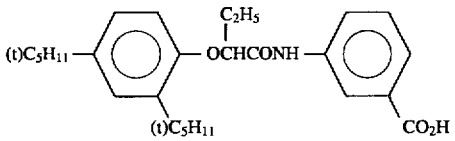
ExS-1
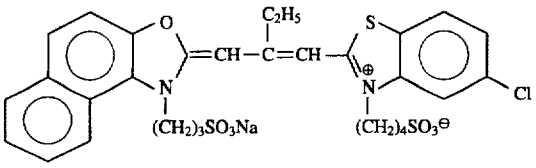
ExS-2
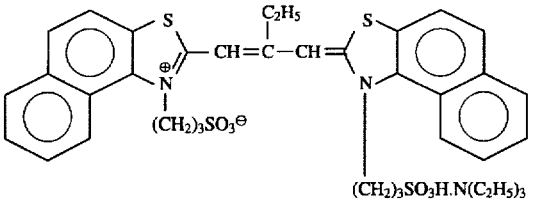
ExS-3
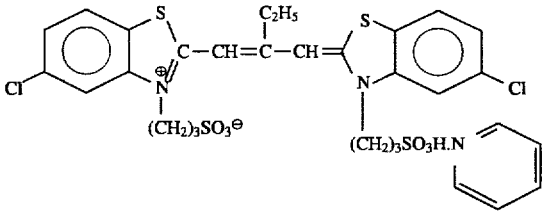

-continued
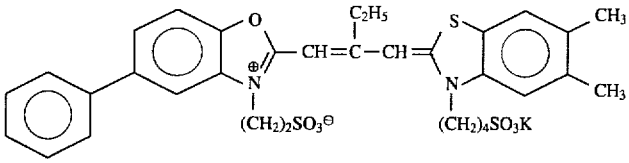
ExS-4
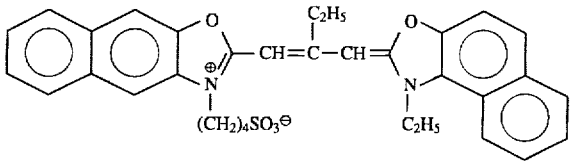
ExS-5
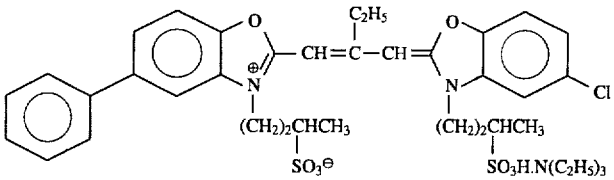
ExS-6
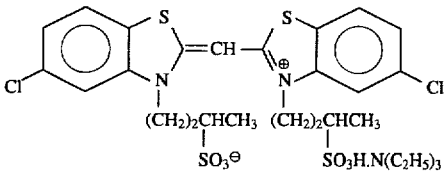
ExS-7
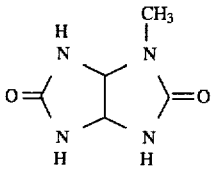
SS-1
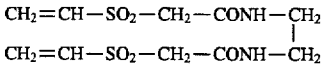
H-1
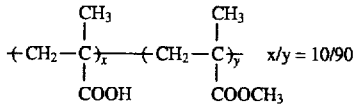
B-1
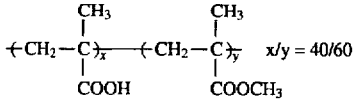
B-2
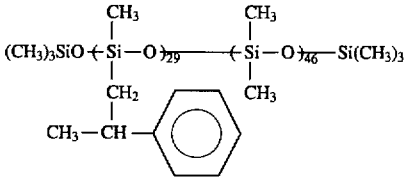
B-3
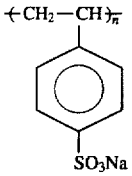
B-4

-continued
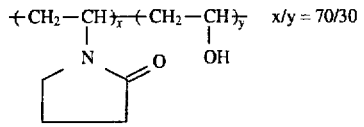
B-5
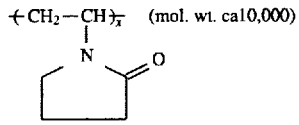
B-6
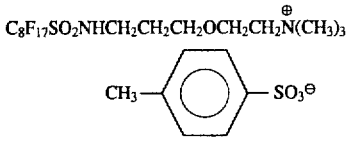
W-1
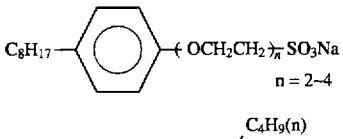
W-2
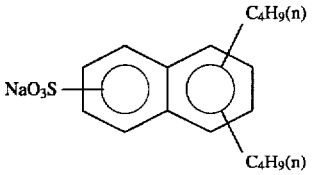
W-3
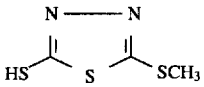
F-1
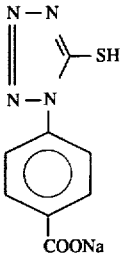
F-2
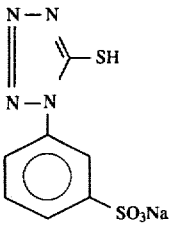
F-3
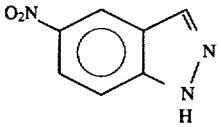
F-4
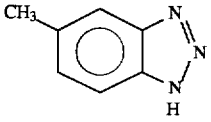
F-5
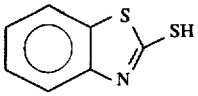
F-6

-continued

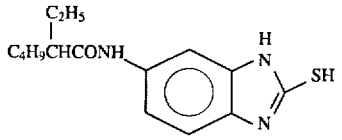

F-7

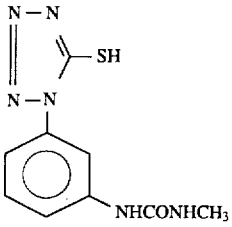

F-8

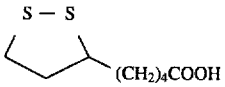

F-9

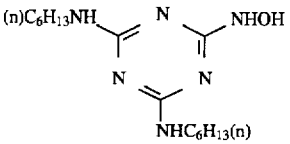

F-10

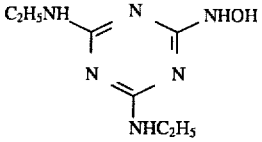

F-11

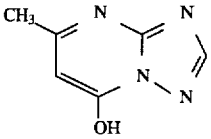

F-12

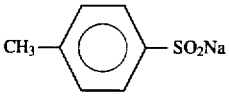

F-13

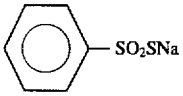

F-14

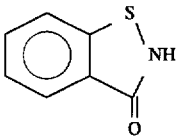

F-15

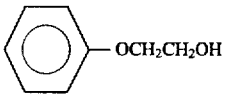

F-16

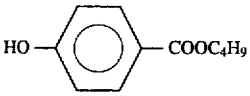

F-17

The thus prepared samples were evaluated as follows:

<Discoloration of the Support>

After the produced unexposed samples were subjected to the following development processing, each sample was irradiated with ultraviolet radiation of 220 to 380 nm at 80° C. for 2 weeks. After the emulsion layer was removed with a gelatin degradation enzyme, the degree of yellowness of the support was visually observed and evaluated as follows:

A: Yellowness was conspicuous.

B: A little yellowness was observed.

C: Little yellowness was observed.

D: Yellowness was not observed.

| Development processing | |
|---|---|
| Processing step | Time |
| Color developing | 3 min 15 sec |
| Bleaching | 6 min 30 sec |
| Water washing | 2 min 10 sec |
| Fixing | 4 min 20 sec |
| Water washing | 3 min 15 sec |
| Stabilizing | 1 min 05 sec |

The composition of each processing solution is as followed, respectively:

| Color-developer | |
|---|---|
| Diethylenetriaminepentaacetic acid | 1.0 g |
| 1-Hydroxyethylidene-1,1-diphosphonic acid | 2.0 g |
| Sodium sulfite | 4.0 g |
| Potassium carbonate | 30.0 g |
| Potassium bromide | 1.4 g |
| Potassium iodide | 1.3 g |
| Hydroxylamine sulfate | 2.4 g |
| 4-(N-Ethyl-N-β-hydroxyethylamino)-2-methylamino]aniline sulfonate | 4.5 g |
| Water to make | 1.0 liter |
| pH | 10.0 |
| Bleaching solution | |
| Iron (III) ammonium ethylenediaminetetraacetate | 100.0 g |
| Disodium ethylenediaminetetraacetate | 10.0 g |
| Ammonium bromide | 150.0 g |
| Ammonium nitrate | 10.0 g |
| Water to make | 1.0 liter |
| pH | 6.0 |
| Fixing solution | |
| Disodium ethylenediaminetetraacetate | 1.0 g |
| Sodium sulfite | 4.0 g |
| Aqueous ammonium thiosulfate solution (70%) | 175.0 ml |
| Sodium bisulfite | 4.6 g |
| Water to make | 1.0 liter |
| pH | 6.6 |
| Stabilizing solution | |
| Formalin (40%) | 2.0 ml |
| Polyoxyethylene-p-monononylphenyl ether (average polymerization degree: 10) | 0.3 g |
| Water to make | 1.0 liter |

(Evaluation of the Fogging)

The produced unexposed samples were subjected to development processing and then were irradiated with light from a xenon lamp (30,000 luxes) for one week, and the difference in the fogging between the samples and the control sample was evaluated. That is, assuming the value of the fogging of Control Sample (1-1) to be 100, it is indicated that the smaller the value of the sample was, the smaller the fogging of the sample was.

Results are shown in Table 2.

TABLE 2

| Sample No. | Ultraviolet-aisorbent (Amount contained) Photosensitive Layer 2nd Layer | 14th Layer | Back Second Layer | Discoloration of Support | Fogging | Remarks |
|---|---|---|---|---|---|---|
| 1-1 | — | — | — | A | 100% | Control |
| 1-1 | I-14 (0.3 g/m²) | I-14 (0.3 g/m²) | — | C | 70 | This Invention |
| 1-2 | I-14 (0.3 g/m²) | I-14 (0.3 g/m²) | I-14 (0.2 g/m²) | D | 55 | This Invention |
| 1-3 | VI-2 (0.3 g/m²) | IV-34 (0.3 g/m²) | — | C | 68 | This Invention |
| 1-4 | I-3 (0.15 g/m²)<br>II-11 (0.15 g/m²)<br>III-9 (0.1 g/m²) | I-7 (0.1 g/m²)<br>V-1 (0.2 g/m²) | IV-2 (0.25 g/m²) | D | 54 | This Invention |
| 1-5 | I-9 (0.01 g/m²)<br>I-1 (0.01 g/m²)<br>I-6 (0.01 g/m²) | II-34 (0.15 g/m²)<br>IV-2 (0.15 g/m²) | — | C | 63 | This Invention |
| 1-6 | I-9 (0.01 g/m²)<br>I-1 (0.01 g/m²)<br>I-6 (0.01 g/m²) | II-34 (0.15 g/m²)<br>IV-2 (0.15 g/m²) | II-6 (0.1 g/m²)<br>V-2 (0.1 g/m²)<br>VI-5 (0.1 g/m²) | D | 53 | This Invention |
| 1-7 | I-14 (0.005 g/m²) | — | — | A | 98 | Comparative Example |
| 1-8 | I-14 (3.5 g/m²) | — | — | B | 91 | Comparative Example |
| 1-9 | — | I-14 (0.005 g/m²) | — | A | 99 | Comparative Example |
| 1-10 | — | — | I-14 (0.005 g/m²) | A | 99 | Comparative Example |

As is shown in Table 2, the control (Sample 1-1), which did not contain the ultraviolet absorbent described in this specification, was poor in the degree of yellowness and fogging, while Samples 1-1 to 1-6 of the present invention that had layers containing the ultraviolet absorbents according to the present invention, were excellent in that they were low in the degree of yellowness and very small in fogging. In particular, Samples 1-2, 1-4, and 1-6, containing ultraviolet absorbents according to the present invention in all of the second photographic layer, the 14th photographic layer, and the second backing layer, were excellent in that they were hardly discolored and were small in fogging. Comparative Samples 1-7 to 1-10, containing ultraviolet absorbents only in a small amount or in a large amount, were not satisfactory in view of both the discoloration and fogging. Additionally, these samples comprising the support of the present invention were very excellent in that core set curl was hardly observed even during the development processing.

EXAMPLE 2

After a backing layer was applied to each support similarly to Example 1, emulsion layers given below were applied, thereby preparing Reversal Color Photographic Materials 2-1 to 2-9.

The figure given represents the added amount per $m^2$. The effect of the added compounds is not restricted to the shown applications.

(Composition of photosensitive layer)

| | |
|---|---|
| **First layer: Halation-preventing layer** | |
| Black colloidal silver | 0.20 g |
| Gelatin | 1.9 g |
| UV-absorbent | see Table 5 |
| High boiling organic solvent Oil-1 | 0.1 g |
| Dispersion of fine crystal solid of Dye E-1 | 0.1 g |
| **Second layer: Intermediate layer** | |
| Gelatin | 0.40 g |
| Compound Cpd-C | 5 mg |
| Compound Cpd-J | 5 mg |
| Compound Cpd-K | 3 mg |
| High boiling organic solvent Oil-3 | 0.1 g |
| Dye D-4 | 0.8 mg |
| **Third layer: Intermediate layer** | |
| Fine particle silver iodobromide emulsion fogged its surface and inner part (average grain diameter: 0.06 μm, deviation coefficient of diameter: 18%, AgI content: 1 mol %) | silver 0.05 g |
| Gelatin | 0.4 g |
| **Fourth layer: Low sensitivity red-sensitive emulsion layer** | |
| Emulsion A | silver 0.3 g |
| Emulsion B | silver 0.2 g |
| Gelatin | 0.8 g |
| Coupler C-1 | 0.15 g |
| Coupler C-2 | 0.05 g |
| Coupler C-3 | 0.05 g |
| Coupler C-9 | 0.05 g |
| Compound Cpd-C | 5 mg |
| Compound Cpd-J | 5 mg |
| High boiling organic solvent Oil-2 | 0.1 g |
| Additive P-1 | 0.1 g |
| **Fifth layer: Medium sensitivity red-sensitive emulsion layer** | |
| Emulsion B | silver 0.2 g |
| Emulsion C | silver 0.3 g |
| Gelatin | 0.8 g |
| Coupler C-1 | 0.2 g |
| Coupler C-2 | 0.05 g |
| Coupler C-3 | 0.2 g |
| High boiling organic solvent Oil-2 | 0.1 g |
| Additive P-1 | 0.1 mg |
| **Sixth layer: High sensitivity red-sensitive emulsion layer** | |
| Emulsion D | silver 0.4 g |
| Gelatin | 1.1 g |
| Coupler C-1 | 0.3 g |
| Coupler C-2 | 0.1 g |
| Coupler C-3 | 0.7 g |
| Additive P-1 | 0.1 g |
| **Seventh layer: Intermediate layer** | |
| Gelatin | 0.6 g |
| Additive M-1 | 0.3 g |
| Color-mix preventing agent Cpd-F | 2.6 mg |
| Additive D-5 | 0.02 g |
| Compound Cpd-J | 5 mg |
| High-boiling organic solvent Oil-1 | 0.02 g |
| **Eighth layer: Intermediate layer** | |
| Fine particle silver iodobromide emulsion fogged its surface and inner part (average grain diameter: 0.06 μm, deviation coefficient of diameter: 16%, AgI content: 0.3 mol %) | silver 0.02 g |

-continued (Composition of photosensitive layer)

| | |
|---|---|
| Gelatin | 1.0 g |
| Additive P-1 | 0.2 g |
| Color-mix preventing agent Cpd-A | 0.1 g |
| Compound Cpd-C | 0.1 g |
| **Ninth layer: Low sensitivity green-sensitive emulsion layer** | |
| Emulsion E-1 | silver 0.1 g |
| Emulsion F-1 | silver 0.2 g |
| Emulsion G-1 | silver 0.2 g |
| Gelatin | 0.5 g |
| Coupler C-4 | 0.1 g |
| Coupler C-7 | 0.05 g |
| Coupler C-8 | 0.20 g |
| Compound Cpd-B | 0.03 g |
| Compound Cpd-D | 0.02 g |
| Compound Cpd-E | 0.02 g |
| Compound Cpd-F | 0.04 g |
| Compound Cpd-J | 10 mg |
| Compound Cpd-L | 0.02 g |
| High-boiling organic solvent Oil-1 | 0.1 g |
| High-boiling organic solvent Oil-2 | 0.1 g |
| **Tenth layer: Medium sensitivity green-sensitive emulsion layer** | |
| Emulsion G-1 | silver 0.3 g |
| Emulsion H-1 | silver 0.1 g |
| Gelatin | 0.6 g |
| Coupler C-4 | 0.1 g |
| Coupler C-7 | 0.2 g |
| Coupler C-8 | 0.1 g |
| Compound Cpd-B | 0.03 g |
| Compound Cpd-D | 0.02 g |
| Compound Cpd-E | 0.02 g |
| Compound Cpd-F | 0.05 g |
| Compound Cpd-L | 0.05 g |
| High-boiling organic solvent Oil-2 | 0.01 g |
| **Eleventh layer: High sensitivity green-sensitive emulsion layer** | |
| Emulsion I-1 | silver 0.5 g |
| Gelatin | 1.0 g |
| Coupler C-4 | 0.3 g |
| Coupler C-7 | 0.1 g |
| Coupler C-8 | 0.1 g |
| Compound Cpd-B | 0.08 g |
| Compound Cpd-D | 0.02 g |
| Compound Cpd-E | 0.04 g |
| Compound Cpd-F | 5 mg |
| Compound Cpd-L | 0.02 g |
| High-boiling organic solvent Oil-1 | 0.02 g |
| High-boiling organic solvent Oil-2 | 0.02 g |
| **Twelfth layer: Intermediate layer** | |
| Gelatin | 0.6 g |
| Compound Cpd-L | 0.05 g |
| High-boiling organic solvent Oil-1 | 0.05 g |
| **Thirteenth layer: Yellow filter layer** | |
| Yellow colloid silver | silver 0.07 g |
| Gelatin | 1.1 g |
| Color-mix inhibitor Cpd-A | 0.01 g |
| Compound Cpd-L | 0.01 g |
| High-boiling organic solvent Oil-1 | 0.01 g |
| Dispersion of fine crystal solid of Dye E-2 | 0.05 g |
| **Fourteenth layer: Intermediate layer** | |
| Gelatin | 0.6 g |
| **Fifteenth layer: Low sensitivity blue-sensitive emulsion layer** | |
| Emulsion J-1 | silver 0.2 g |
| Emulsion K-1 | silver 0.3 g |
| Gelatin | 0.8 g |
| Coupler C-5 | 0.2 g |
| Coupler C-6 | 0.1 g |
| Coupler C-10 | 0.4 g |
| **Sixteenth layer: Medium sensitivity blue-** | |

-continued

| (Composition of photosensitive layer) | |
|---|---|
| sensitive emulsion layer | |
| Emulsion L | silver 0.5 g |
| Gelatin | 0.9 g |
| Coupler C-5 | 0.1 g |
| Coupler C-6 | 0.1 g |
| Coupler C-10 | 0.6 g |
| Seventeenth layer: High sensitivity blue-sensitive emulsion layer | |
| Emulsion M-1 | silver 0.2 g |
| Emulsion N-1 | silver 0.2 g |
| Gelatin | 1.2 g |
| Coupler C-5 | 0.1 g |
| Coupler C-6 | 0.1 g |
| Coupler C-10 | 0.6 g |
| High-boiling organic solvent Oil-2 | 0.1 g |
| Eighteenth layer: First protective layer | |
| Gelatin | 0.7 g |
| UV-absorbent | see Table 5 |

-continued

| (Composition of photosensitive layer) | |
|---|---|
| Formalin scavenger Cpd-H | 0.4 g |
| Dye D-1 | 0.15 g |
| Dye D-2 | 0.05 g |
| Dye D-3 | 0.1 g |
| Nineteenth layer: Second protective layer | |
| Colloidal silver | silver 0.1 mg |
| Fine particle silver iodobromide emulsion (average grain diameter: 0.06 μm, AgI content: 1 mol %) | silver 0.1 g |
| Gelatin | 0.4 g |
| Twentieth layer: Third protective layer | |
| Gelatin | 0.4 g |
| Polymethyl methacrylate (average particle diameter: 2.0 μm) | 0.1 g |
| Copolymer (4:6) of methyl methacrylate and acrylic acid (average particle diameter: 2.0 μm) | 0.1 g |

-continued

| (Composition of photosensitive layer) | |
|---|---|
| Silicone oil (polysiloxane was dispersed in water by sodium dodecylbenzene sulfonate, average particle diameter: 0.02 μm) | 0.03 g |
| Surface-active agent W-11 | 3.0 mg |
| Surface-active agent W-12 | 0.03 g |
| $C_{17}H_{35}COOC_{40}H_{81}/C_{50}H_{101}(CH_2CH_2O)_{16}H$ (4/6 in molar ratio, water dispersion, average particle diameter: 0.002 μm) | 0.03 g |

Further, besides the above compounds, additives F-21 to F-28 were added in all emulsion layers. Further, besides the above compounds gelatin hardener H-1 and surface-active agents for coating and emulsifying W-13, W-14, W-15, and W-16 were added in each layer.

Further, as antiseptic and antimold agents, phenol, 1,2-benzisothiazoline-3-one, 2-phenoxyethanol, phenethyl alcohol, and butyl p-benzoate were added.

Silver iodobromide emulsions used to each Sample were shown in Table 3.

TABLE 3

| Emulsion | Feature of grain | Average sphere-equivalent grain diameter (μm) | Deviation coefficient (%) | AgI content (%) |
|---|---|---|---|---|
| A-1 | Monodisperse tetradecahedral grain | 0.28 | 16 | 4.0 |
| B-1 | Monodisperse cubic internal latent image-type grain | 0.30 | 10 | 4.0 |
| C-1 | Monodisperse cubic grain | 0.38 | 10 | 5.0 |
| D-1 | Monodisperese tabular grain, average aspect ratio: 3.0 | 0.68 | 15 | 2.0 |
| E-1 | Monodisperse cubic grain | 0.20 | 17 | 4.0 |
| F-1 | Monodisperse tetradecahedral grain | 0.23 | 16 | 4.0 |
| G-1 | Monodisperse cubic internal latent image-type grain | 0.28 | 11 | 4.0 |
| H-1 | Monodisperse cubic grain | 0.32 | 9 | 3.5 |
| I-1 | Monodisperese tabular grain, average aspect ratio: 5.0 | 0.80 | 15 | 2.0 |
| J-1 | Monodisperse cubic grain | 0.30 | 18 | 4.0 |
| K-1 | Monodisperse tetradecahedral grain | 0.45 | 17 | 4.0 |
| L-1 | Monodisperese tabular grain, average aspect ratio: 5.0 | 0.55 | 13 | 2.0 |
| M-1 | Monodisperese tabular grain, average aspect ratio; 6.0 | 1.00 | 15 | 1.5 |
| N-1 | Monodisperse tabular grain average aspect ratio: 9.0 | 1.20 | 17 | 1.5 |

Spectral sensitizing dyes and their amounts added to Emulsions A-1 to N-1 were shown in Table 4.

TABLE 4

| Emulsion | Sensitizing dye added | Amount added (g) per mol of silver halide |
|---|---|---|
| A-1 | SE - 2 | 0.025 |
| | SE - 3 | 0.25 |
| | SE - 8 | 0.01 |
| B-1 | SE - 1 | 0.01 |
| | SE - 3 | 0.25 |
| | SE - 8 | 0.01 |
| C-1 | SE - 1 | 0.01 |
| | SE - 2 | 0.01 |
| | SE - 3 | 0.25 |
| | SE - 8 | 0.01 |
| D-1 | SE - 2 | 0.01 |
| | SE - 3 | 0.10 |
| | SE - 8 | 0.01 |
| E-1 | SE - 4 | 0.5 |

TABLE 4-continued
| Emulsion | Sensitizing dye added | Amount added (g) per mol of silver halide |
|---|---|---|
| | SE - 5 | 0.1 |
| F-1 | SE - 4 | 0.3 |
| | SE - 5 | 0.1 |
| G-1 | SE - 4 | 0.25 |
| | SE - 5 | 0.08 |
| | SE - 9 | 0.05 |
| H-1 | SE - 4 | 0.2 |
| | SE - 5 | 0.06 |
| | SE - 9 | 0.05 |
| I-1 | SE - 4 | 0.3 |
| | SE - 5 | 0.07 |
| | SE - 9 | 0.1 |
TABLE 4-continued
| Emulsion | Sensitizing dye added | Amount added (g) per mol of silver halide |
|---|---|---|
| J-1 | SE - 6 | 0.05 |
| | SE - 7 | 0.2 |
| K-1 | SE - 6 | 0.05 |
| | SE - 7 | 0.2 |
| L-1 | SE - 6 | 0.06 |
| | SE - 7 | 0.22 |
| M-1 | SE - 6 | 0.04 |
| | SE - 7 | 0.15 |
| N-1 | SE - 6 | 0.06 |
| | SE - 7 | 0.22 |
C-1
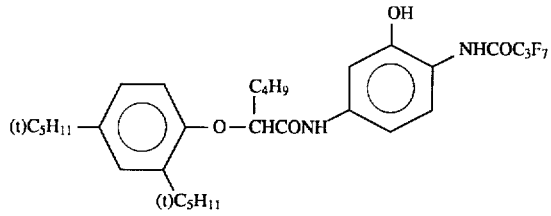
C-2
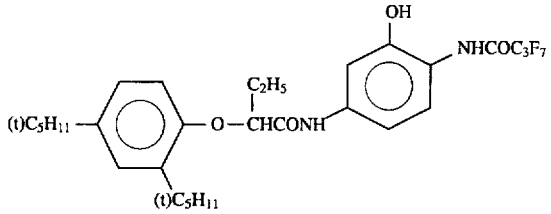
C-3
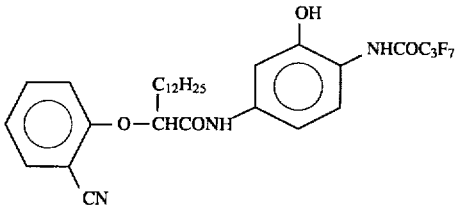
C-4
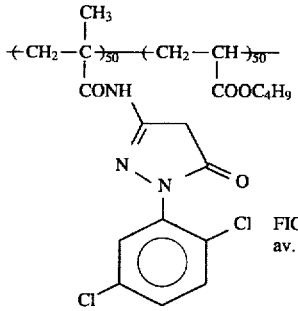
FIGS. in wt%
av. mol. wt.:
ca. 25,000

-continued
C-5
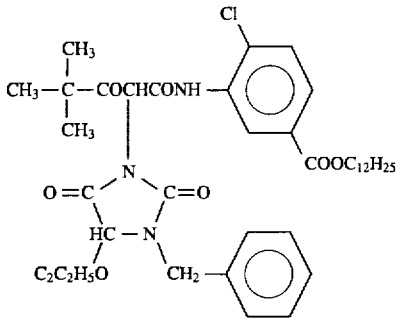
C-6
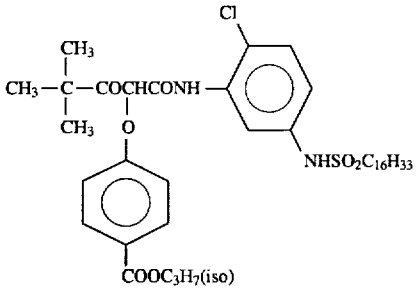
C-7
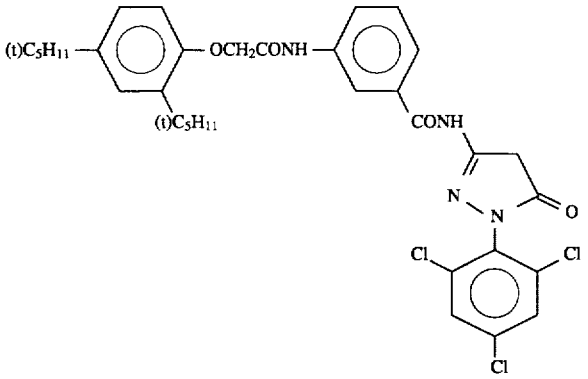
C-8
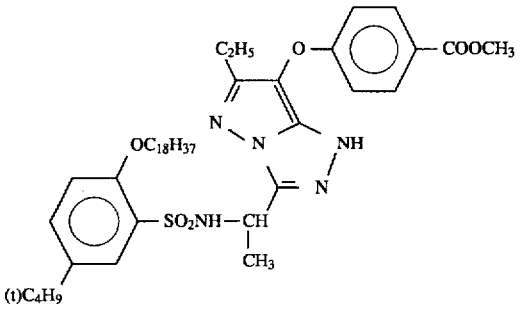
C-9
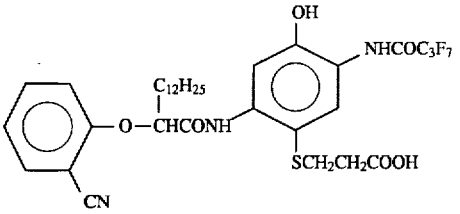

-continued
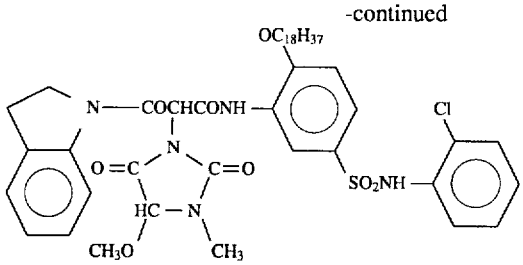
C-10
Dibutyl phthalate
Oil-1
Tricresyl phosphate
Oil-2
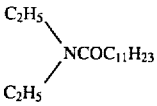
Oil-3
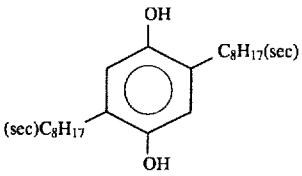
Cpd-A
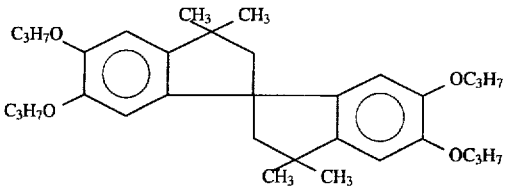
Cpd-B
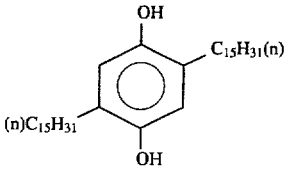
Cpd-C
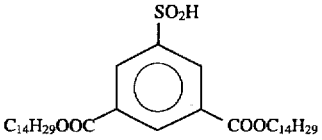
Cpd-D
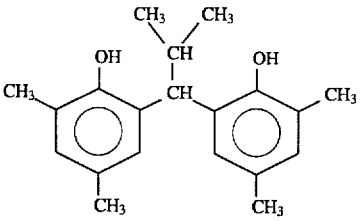
Cpd-E
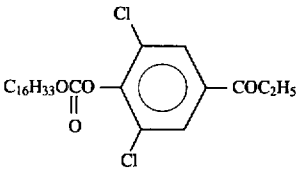
Cpd-F -continued
Cpd-H
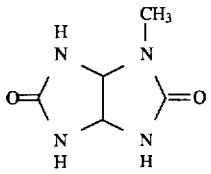
Cpd-I
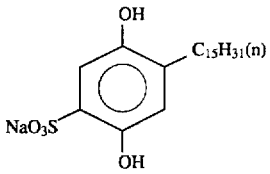
Cpd-J
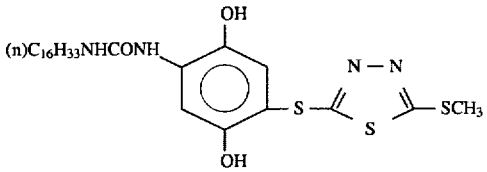
Cpd-K
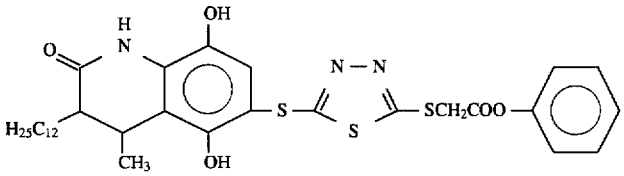
Cpd-L
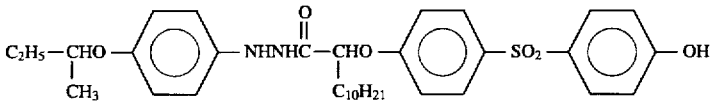
SE-1
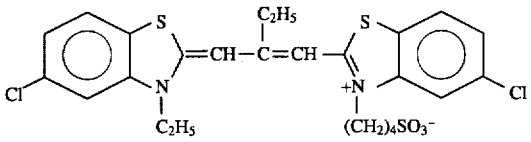
SE-2
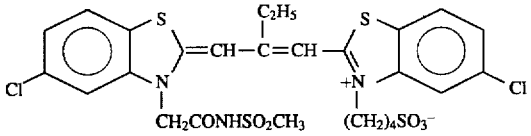
SE-3
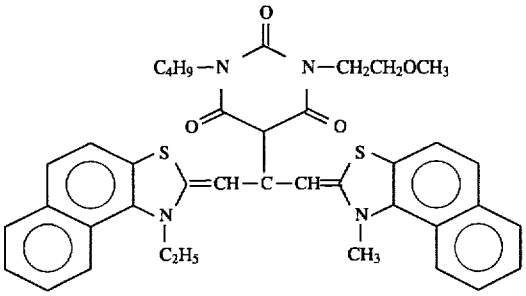
SE-4
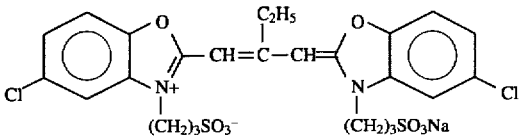

-continued
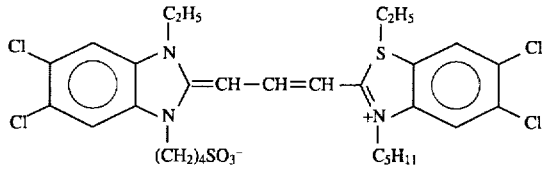
SE-5
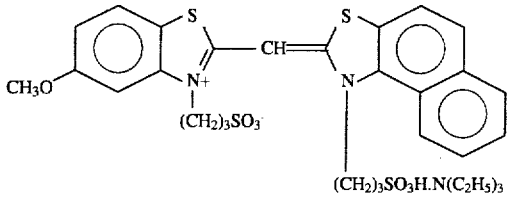
SE-6
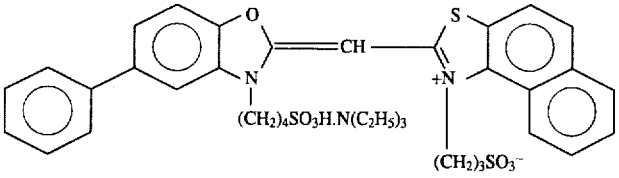
SE-7
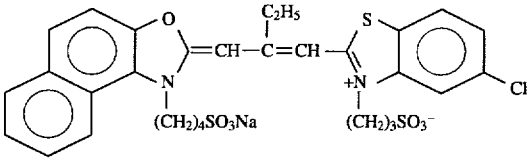
SE-8
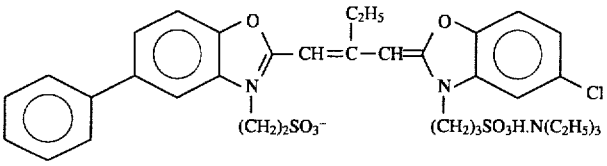
SE-9
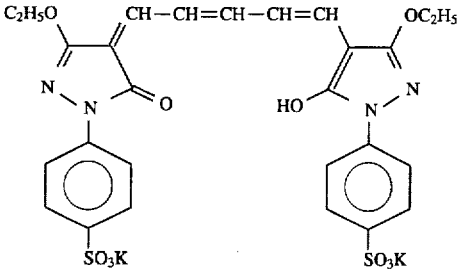
D-1
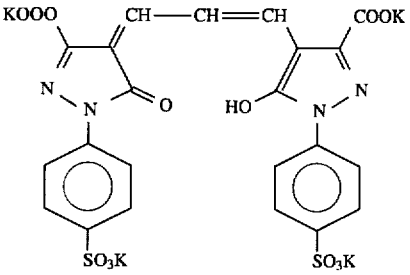
D-2

-continued
D-3
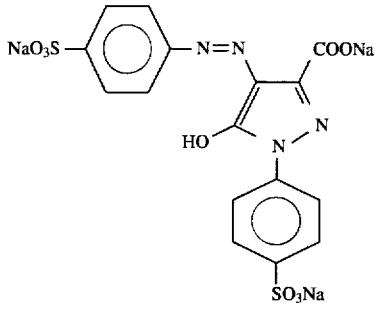
D-4
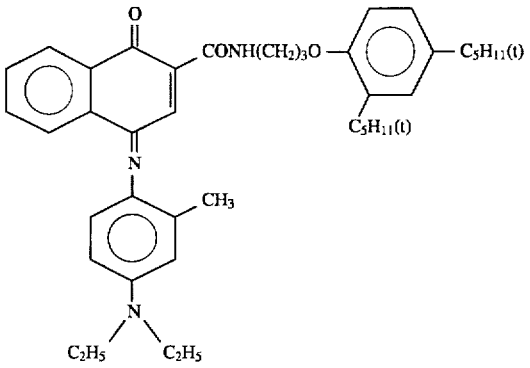
D-5
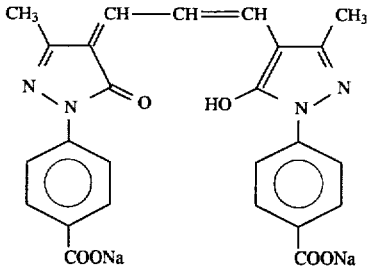
E-1
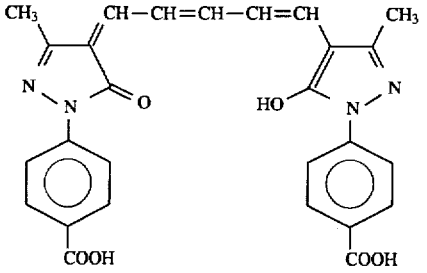
E-2
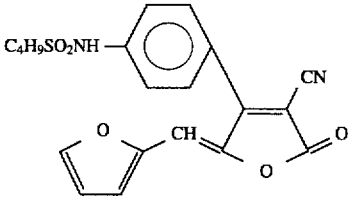
H-1
$CH_2{=}CH{-}SO_2{-}CH_2{-}CONH{-}CH_2$
$CH_2{=}CH{-}SO_2{-}CH_2{-}CONH{-}CH_2$
W-11
$C_8F_{17}SO_2NHCH_2CH_2CH_2OCH_2CH_2\overset{+}{N}(CH_3)_3$
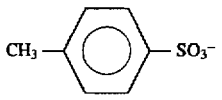

-continued
$C_8F_{17}SO_2N(C_3H_7)CH_2COOK$ W-12
$NaO_3S-CH(CH_2COOCH_2CH(C_2H_5)C_4H_9)COOCH_2CH(C_2H_5)C_4H_9$ W-13
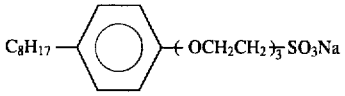
W-14
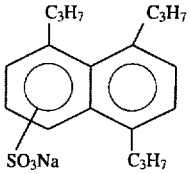
W-15
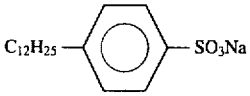
W-16
$(CH_2-CH(CONHC_4H_9(t)))_n$ P-1
$(CH_2-CH(COOC_4H_9))_n$ M-1
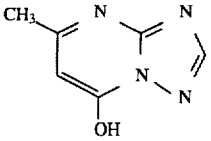
F-21
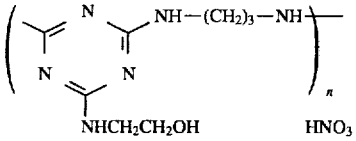
F-22
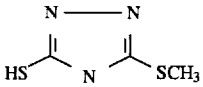
F-23
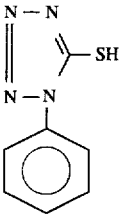
F-24
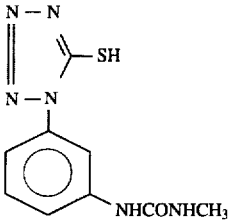
F-25

-continued

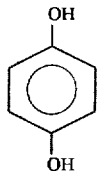

F-26

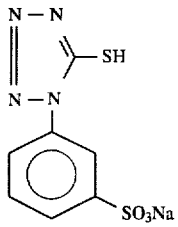

F-27

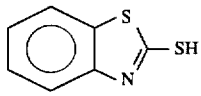

F-28

Obtained Samples 2-1 to 2-9 were evaluated as follows:

<Transparency>

After the obtained samples were adequately exposed to light, the transparency was evaluated, assuming the transparency of Control Sample (2-1) to be 100% at 450 nm, by using CR-56 for color reversal processing, manufactured by Fuji Photo Film Co., Ltd. It is indicated that the smaller the value is, the poorer the transparency is.

<Degree of Yellowness>

After the samples were adequately exposed to light and were subjected to development processing in the same manner as above, both of the surfaces were irradiated with light having 30,000 luxes from a xenon lamp for 2 weeks. The degree of yellowness of the obtained films was evaluated in terms of transparency at 450 nm. The evaluation was made relatively, by assuming the transparency of Control Sample (2-1) before the irradiation to be 100%. It is indicated that the smaller the value is, the higher and poorer the degree of yellowness is.

Results are shown in Table 5.

amount or an excessive amount of an ultraviolet absorbent, could not satisfy the transparency and the prevention of discoloration.

The image produced by using samples of the present invention had excellent graininess and sharpness.

Each sample was slit into a length of 1.5 m, of width 35 mm and the slit was wound around a spool having a 12-mm core; then it was allowed to stand at 80° C. for 1 hour, after which it was subjected to development processing, to examine the flatness. The result showed that Samples 2-1 to 2-6, comprising a polyethylene naphthalate according to the present invention, did not cause any major trouble in the development. In the case of Sample (2-10) (for comparison), which was prepared in the same manner as Sample 2-2 of the present invention, using a polyethylene terephthalate (Tg=80° C.) as a comparative base in place of the polyethylene naphthalate, when Sample (2-10) was subjected to the above wound test, it was observed that the film at the wound core part bent.

As stated above, it can be understood that the present invention is excellent in view of roll set curl.

TABLE 5

| | Ultraviolet-absorbent (Amount contained) | | | | | |
|---|---|---|---|---|---|---|
| Sample No. | 1st Layer: Halation Preventing Layer | 18th Layer: 1st Protective Layer | Back Second Layer | Trans-parency | Degree of Yellowness | Remarks |
| 2-1 | — | — | — | 100% | 70% | Control |
| 2-2 | I-14 (0.3 g/m$^2$) | I-9 (0.3 g/m$^2$) | I-1 (0.2 g/m$^2$) | 98 | 96 | This Invention |
| 2-3 | II-13 (0.3 g/m$^2$) | II-32 (0.15 g/m$^2$)<br>III-11 (0.15 g/m$^2$) | IV-7 (0.05 g/m$^2$)<br>V-5 (0.05 g/m$^2$)<br>VI-7 (0.1 g/m$^2$) | 97 | 95 | This Invention |
| 2-4 | VI-6 (0.3 g/m$^2$) | II-35(0.3 g/m$^2$) | II-6 (0.3 g/m$^2$) | 98 | 95 | This Invention |
| 2-5 | I-6 (0.1 g/m$^2$)<br>I-9 (0.1 g/m$^2$)<br>II-2 (0.1 g/m$^2$) | I-1 (0.3 g/m$^2$) | I-9 (0.3 g/m$^2$) | 97 | 96 | This Invention |
| 2-6 | — | I-1 (0.5 g/m$^2$) | I-9 (0.3 g/m$^2$) | 98 | 92 | This Invention |
| 2-7 | — | I-1 (0.5 g/m$^2$) | — | 99 | 89 | This Invention |
| 2-8 | II-13 (0.008 g/m$^2$) | — | — | 100 | 72 | Comparative Example |
| 2-9 | II-13 (0.003 g/m$^2$) | II-13 (0.003 g/m$^2$) | II-13 (0.003 g/m$^2$) | 100 | 72 | Comparative Example |

As is apparent from Table 5, the photographic material of the present invention was excellent in transparency and the prevention of discoloration. In contrast, Control (Sample 2-1), not containing an ultraviolet absorbent of the present invention, was extremely poor in the degree of yellowness. Comparative Samples 2-8 to 2-9, containing a too-small

EXAMPLE 3

The backed support (Tg=119° C.) prepared in Example 1 (that was not coated with emulsions) was formed into a roll of diameter 10 cm, and it was heated at 110° C. for 2 days.

This sample was coated with emulsions in the same manner as in Example 1, to prepare Samples 3-1 to 3-6.

A photographic material 3-7 for comparison was prepared in the same manner as the above, except that the polyethylene naphthalate was changed to a polyethylene terephthalate (Tg: 80° C.). Incidentally, in the stage of the support having a backing layer, it was similarly heat-treated at 65° C. for 2 days.

<Passability through a Compact Lab>

The above sample was cut into a length of 1.5 m, of width 35 mm, and it was wound firmly around a spool having an outer diameter of 7 mm and a core was set at 80° C. for 2 hours. The sample was subjected to automatic development processing in a compact lab (FP-560B), manufactured by Fuji Photo Film Co., Ltd. At that time, it was checked whether the film folded or not at the core end of the spool in the automatic processor.

Results are shown in Table 6.

TABLE 6

| Sample No. | Ultraviolet-absorbent (Amount contained) Photosensitive Layer 2nd Layer | 14th Layer | Back Second Layer | Discoloration of Support | Passability through a Compact Lab | Remarks |
|---|---|---|---|---|---|---|
| 3-1 | — | — | — | A | Not folded | Control |
| 3-1 | I-14 (0.3 g/m$^2$) | I-14 (0.3 g/m$^2$) | — | C | Not folded | This Invention |
| 3-2 | I-14 (0.3 g/m$^2$) | I-14 (0.3 g/m$^2$) | I-14 (0.2 g/m$^2$) | D | Not folded | This Invention |
| 3-3 | IV-2 (0.3 g/m$^2$) | II-34 (0.3 g/m$^2$) | — | C | Not folded | This Invention |
| 3-4 | I-3 (0.15 g/m$^2$)<br>II-11 (0.15 g/m$^2$)<br>III-9 (0.1 g/m$^2$) | I-7 (0.1 g/m$^2$)<br>V-1 (0.2 g/m$^2$) | IV-2 (0.25 g/m$^2$) | D | Not folded | This Invention |
| 3-5 | I-9 (0.01 g/m$^2$)<br>I-1 (0.01 g/m$^2$)<br>I-6 (0.01 g/m$^2$) | II-34 (0.15 g/m$^2$)<br>IV-2 (0.15 g/m$^2$) | — | C | Not folded | This Invention |
| 3-6 | I-9 (0.01 g/m$^2$)<br>I-1 (0.01 g/m$^2$)<br>I-6 (0.01 g/m$^2$) | II-34 (0.15 g/m$^2$)<br>IV-2 (0.15 g/m$^2$) | II-6 (0.1 g/m$^2$)<br>V-2 (0.1 g/m$^2$)<br>VI-5 (0.1 g/m$^2$) | D | Not folded | This Invention |
| 3-7 | I-14 (0.3 g/m$^2$) | I-14 (0.15 g/m$^2$) | I-14 (0.2 g/m$^2$) | D | Folded | Comparative Example |

As is apparent from Table 6, it can be understood that, since the polyethylene naphthalate according to the present invention is heat-treated, there is no problem of passability through a compact lab and the support is discolored less. In contrast, Control (3-1), not containing any ultraviolet absorbent, is poor in that it was extremely discolored.

It is apparent that the photographic material of the present invention is excellent, because even though Sample 3-7, which contained a polyethylene terephthalate falling outside the present invention, was heat-treated, the passability through a compact lab was not improved.

EXAMPLE 4

Samples 4-1 to 4-7 were prepared in the same manner as in Example 3, except that Ultraviolet Absorber I-13 according to the present invention was contained in the supports (a polyethylene naphthalate and a polyethylene terephthalate) prepared in Example 3, in an amount of 1% based on the weight of the support.

The evaluation was carried out as follows:

<Degree of Discoloration of the Support>

Each of the produced unexposed samples was subjected to development processing in the same way as in Example 1; each was irradiated with ultraviolet light of 220 to 380 nm for 4 weeks; and after the emulsion layers were removed with a gelatin degradation enzyme, the degree of discoloration (yellowness) of the support was visually observed and evaluated as follows:

A: Yellowness was conspicuous.

B: A little yellowness was observed.

C: Little yellowness was observed.

D: Yellowness was not observed.

<Passability through a Compact Lab>

Test and evaluation for the passability through a compact lab was carried out as in the same way as in Example 3.

The results are shown in Table 7.

TABLE 7

| Sample No. | Ultraviolet-absorbent (Amount contained) Photosensitive Layer 2nd Layer | 14th Layer | Back Second Layer | Discoloration of Support | Passability through a Compact Lab | Remarks |
|---|---|---|---|---|---|---|
| 4-1 | — | — | — | B | Not folded | Control |
| 4-1 | I-14 (0.3 g/m$^2$) | I-14 (0.3 g/m$^2$) | — | C | Not folded | This Invention |
| 4-2 | I-14 (0.3 g/m$^2$) | I-14 (0.3 g/m$^2$) | I-14 (0.2 g/m$^2$) | C | Not folded | This Invention |
| 4-3 | IV-2 (0.3 g/m$^2$) | II-34 (0.3 g/m$^2$) | — | C | Not folded | This Invention |
| 4-4 | I-3 (0.15 g/m$^2$)<br>II-11 (0.15 g/m$^2$)<br>III-9 (0.1 g/m$^2$) | I-7 (0.1 g/m$^2$)<br>V-1 (0.2 g/m$^2$) | IV-2 (0.25 g/m$^2$) | D | Not folded | This Invention |
| 4-5 | I-9 (0.01 g/m$^2$)<br>I-1 (0.01 g/m$^2$) | II-34 (0.15 g/m$^2$)<br>IV-2 (0.15 g/m$^2$) | — | C | Not folded | This Invention |

TABLE 7-continued

| Sample No. | Ultraviolet-absorbent (Amount contained) Photosensitive Layer 2nd Layer | 14th Layer | Back Second Layer | Discoloration of Support | Passability through a Compact Lab | Remarks |
|---|---|---|---|---|---|---|
| 4-6 | I-6 (0.01 g/m²)<br>I-9 (0.01 g/m²)<br>I-1 (0.01 g/m²) | II-34 (0.15 g/m²)<br>IV-2 (0.15 g/m²) | II-6 (0.1 g/m²)<br>V-2 (0.1 g/m²) | D | Not folded | This Invention |
| 4-7 | I-6 (0.01 g/m²)<br>I-14 (0.3 g/m²) | I-14 (0.15 g/m²) | VI-5 (0.1 g/m²)<br>I-14 (0.2 g/m²) | C | Folded | Comparative Example |

As is apparent from the results in Table 7, in the case of Samples 4-1 to 4-6, having an ultraviolet absorbent of the present invention in at least one of the constitutional layers and the support, the support was discolored little and the passability through a compact lab was excellent.

In contrast, the Control Sample was unsatisfactory in the degree of discoloration and the Comparative Sample, of a polyethylene terephthalate, was poor in passability through a compact lab, which is a practical serious problem.

As described above, when an ultraviolet absorbent was additionally used in the support, as in Example 4, the support was not discolored, even under harsh irradiation with ultraviolet light.

EXAMPLE 5

To polyethylene naphthalate prepared from ethylene glycol and dimethyl 2,6-naphthalenedicarboxylate ultraviolet absorbent was added, as shown in Table 8, respectively, and the melted film thereof at 280° C. was stretched to film-forming direction and cross direction, successively, in each 3.2 magnification, thereby preparing polyethylene naphthalate films having a thickness of 80 μm (Tg was 119° C.). Each sample film thus prepared was irradiated with a xenon lamp of 30,000 luxes at 100° C. for 2 weeks, and then the degree of yellowness (discoloration to yellow) of the film was visually observed and was evaluated as follows:

A: Yellowness was conspicuous.

B: A little yellowness was observed.

C: Little yellowness was observed.

D: Yellowness was not observed.

Results are shown in Table 8.

TABLE 8

| Sample No. | UV-absorbent (content: g/m²) | Degree of Yellowness | Remarks |
|---|---|---|---|
| 5-1 | None | A | Control |
| 5-2 | I-14 (1) | D | This Invention |
| 5-3 | II-10 (1) | C | This Invention |
| 5-4 | III-15 (1) | C | This Invention |
| 5-5 | IV-2 (1.5) | C | This Invention |
| 5-6 | V-6 (2.0) | C | This Invention |
| 5-7 | VI-7 (1) | C | This Invention |
| 5-8 | I-14 (0.015) | A | Comparative Example |
| 5-9 | I-14 (12) | A | Comparative Example |

As is shown in Table 8, Sample 5-1 (control) of which support did not contain ultraviolet absorbent was remarkably poor in the degree of yellowness. On the contrary, Samples 5-2 to 5-7 of the present invention each of which support contained ultraviolet absorbent were excellent in that they were low in the yellow discoloration.

Further, Comparative Example 5-8 of which support contains too small amount of ultraviolet absorbent and Comparative Example 5-9 of which support contains too much amount of ultraviolet absorbent both were poor in the prevention of yellow discoloration. Thus, the results shows that the present invention is excellent.

EXAMPLE 6

6-1) Preparation of Support

After adding ultraviolet absorbent, as shown in Table 9, each polyethylene naphthalate was melt and brought to film, followed by uniaxial stretching. On the both sides of the film, an aqueous dispersion of poly(vinylidene chloride)/acrylonitrile/itaconic acid (92:5:3 in molar ratio)(coated amount after restretching of film: 0.1 g/m²), sodium dodecylbenzene-sulfonate (2 mg/m²), silica particles (average particle diameter: 0.3 μm, 9 mg/m²), polystyrene/divinylbenzene particles (average particle diameter: 1.0 μm, 2 mg/m²), 2-hydroxy-4,6-dichloro-1,3,5-triazine (35 mg/m²), and trimethylolpropanetriazilidine (10 mg/m²) were coated, and the coated film was subjected to restretching treatment in the course of drying, thereby preparing a support having first undercoated layers of poly(vinilidene chloride) on the both sides thereof. The thickness of polyethylene naphthalate prepared was 75 μm.

Then, on one side of the film, after a glow discharge treatment, gelatin (0.2 g/m²), polyoxyethylene dodecylether (polymerization degree: 10)(2 mg/m²), and $(CH_2{=}CH{-}SO_2NHCH_2)_2$ (10 mg/m²) were coated so as to be a second undercoated layer for emulsion coating side of the support. Another side was regarded as back side.

6-2) preparation of back surface

First and second backing layers having compositions shown below were given on the back side of the undercoated support prepared in 6-1).

| | |
|---|---|
| (a) First backing layer | |
| Gelatin | 0.02 g/m$^2$ |
| $SnO_2/Sb_2O_3/SiO_2$ (90/10/0.7 in wt. ratio) (average particle diameter: 0.05 μm) | 0.2 g/m$^2$ |
| $V_2O_5$ (needle, length: 2 μm, width: 0.01 μm) | 0.05 g/m$^2$ |
| Condensation product of 3 mol of toluenediisocyanate and 1 mol of trimethylolpropane | 0.005 g/m$^2$ |
| (b) Second backing layer | |
| Cellulose diacetate | 1.2 g/m$^2$ |
| Condensation product of 3 mol of toluenediisocyanate and 1 mol of trimethylolpropane | 0.24 g/m$^2$ |
| S-1 | 0.01 g/m$^2$ |
| S-4 | 0.005 g/m$^2$ |
| $C_{18}H_{35}OCO—(CH_2)_{18}—COOC_{18}H_{35}$ | 0.005 g/m$^2$ |
| $C_{21}H_{43}COO—[(CH_2)_{10}—OOC—(CH_2)_6—COO(CH_2)_{10}O]_2—OCC_{21}H_{43}$ | 0.005 g/m$^2$ |

Thus prepared each support having backing layer was wound around a stainless roll of diameter 30 cm, and allowed to stand for 2 days at 105° C. (Thereafter each support was kept at a temperature lower than 80° C. before preparation of photographic material using it.)

6-3) Preparation of emulsion layer surface

Samples were prepared by coating photographic material shown below on the undercoated layer of emulsion coating side prepared in 6-1). That is, multilayer color photographic material samples 6-1 to 6-7 were prepared by multicoating of each layers having composition shown below.

(Compositions of photosensitive layers)

Main materials used in each layer were classified as follows:

| | | | |
|---|---|---|---|
| ExC: | cyan coupler, | HBS: | high-boiling organic solvent, |
| ExM: | magenta coupler, | | |
| ExY: | yellow coupler, | H: | gelatin hardening agent |
| ExS: | sensitizing dye, | | |

Figures corresponding to each component represents the coating amount in terms of g/m$^2$, and for silver halide in terms of silver. With respect to sensitizing dyes, the coating amount is shown in mol per mol of silver halide in the same layer.

| | |
|---|---|
| First layer (Halation-preventing layer) | |
| Black colloidal silver | silver 0.18 |
| Gelatin | 1.40 |
| ExM-1 | 0.18 |
| ExF-1 | $2.0 \times 10^{-3}$ |
| HBS-1 | 0.20 |
| Second layer (Intermediate layer) | |
| Emulsion G | silver 0.065 |
| 2,5-di-t-pentadecylhydroquinone | 0.18 |
| ExC-2 | 0.020 |
| HBS-1 | 0.10 |
| HBS-2 | 0.020 |
| Gelatin | 1.04 |
| Third layer (Low sensitivity red-sensitive emulsion layer) | |
| Emulsion A | silver 0.25 |
| Emulsion B | silver 0.25 |
| ExS-1 | $6.9 \times 10^{-5}$ |
| ExS-2 | $1.8 \times 10^{-5}$ |
| ExS-3 | $3.1 \times 10^{-4}$ |
| ExC-1 | 0.17 |
| ExC-3 | 0.030 |
| ExC-4 | 0.10 |
| ExC-5 | 0.020 |
| ExC-7 | 0.0050 |

-continued

| | |
|---|---|
| ExC-8 | 0.010 |
| Cpd-2 | 0.025 |
| HBS-1 | 0.10 |
| Gelatin | 0.87 |
| Fourth layer (Medium sensitivity red-sensitive emulsion layer) | |
| Emulsion D | silver 0.70 |
| ExS-1 | $3.5 \times 10^{-4}$ |
| ExS-2 | $1.6 \times 10^{-5}$ |
| ExS-3 | $5.1 \times 10^{-4}$ |
| ExC-1 | 0.13 |
| ExC-2 | 0.060 |
| ExC-3 | 0.0070 |
| ExC-4 | 0.090 |
| ExC-5 | 0.025 |
| ExC-7 | 0.0010 |
| ExC-8 | 0.0070 |
| Cpd-2 | 0.023 |
| HBS-1 | 0.10 |
| Gelatin | 0.75 |
| Fifth layer (High sensitivity red-sensitive emulsion layer) | |
| Emulsion E | silver 1.40 |
| ExS-1 | $2.4 \times 10^{-4}$ |
| ExS-2 | $1.0 \times 10^{-4}$ |
| ExS-3 | $3.4 \times 10^{-4}$ |
| ExC-1 | 0.12 |
| ExC-3 | 0.045 |
| ExC-6 | 0.020 |
| ExC-8 | 0.025 |
| Cpd-2 | 0.050 |
| HBS-1 | 0.22 |
| HBS-2 | 0.10 |
| Gelatin | 1.20 |
| Sixth layer (Intermediate layer) | |
| Cpd-1 | 0.10 |
| HBS-1 | 0.50 |
| Gelatin | 1.10 |
| Seventh layer (Low sensitivity green-sensitive emulsion layer) | |
| Emulsion C | silver 0.35 |
| ExS-4 | $3.0 \times 10^{-5}$ |
| ExS-5 | $2.1 \times 10^{-4}$ |
| ExS-6 | $8.0 \times 10^{-4}$ |
| ExM-1 | 0.010 |
| ExM-2 | 0.33 |
| ExM-3 | 0.086 |
| ExY-1 | 0.015 |
| HBS-1 | 0.30 |
| HBS-3 | 0.010 |
| Gelatin | 0.73 |
| Eighth layer (Medium sensitivity green-sensitive emulsion layer) | |

-continued

| | |
|---|---|
| Emulsion D | silver 0.80 |
| ExS-4 | $3.2 \times 10^{-5}$ |
| ExS-5 | $2.2 \times 10^{-4}$ |
| ExS-6 | $8.4 \times 10^{-4}$ |
| ExM-2 | 0.13 |
| ExM-3 | 0.030 |
| ExY-1 | 0.018 |
| HBS-1 | 0.16 |
| HBS-3 | $8.0 \times 10^{-3}$ |
| Gelatin | 0.90 |
| Ninth layer (High sensitivity green-sensitive emulsion layer) | |
| Emulsion E | silver 1.25 |
| ExS-4 | $3.7 \times 10^{-5}$ |
| ExS-5 | $8.1 \times 10^{-5}$ |
| ExS-6 | $3.2 \times 10^{-4}$ |
| ExC-1 | 0.010 |
| ExM-1 | 0.030 |
| ExM-4 | 0.040 |
| ExM-5 | 0.019 |
| Cpd-3 | 0.040 |
| HBS-1 | 0.25 |
| HBS-2 | 0.10 |
| Gelatin | 1.44 |
| Tenth layer (Yellow filter layer) | |
| Yellow colloidal silver | silver 0.030 |
| Cpd-1 | 0.16 |
| HBS-1 | 0.60 |
| Gelatin | 0.60 |
| Eleventh layer (Low sensitivity blue-sensitive emulsion layer) | |
| Emulsion C | silver 0.18 |
| ExS-7 | $8.6 \times 10^{-4}$ |
| ExY-1 | 0.020 |
| ExY-2 | 0.22 |
| ExY-3 | 0.50 |
| ExY-4 | 0.020 |
| HBS-1 | 0.28 |
| Gelatin | 1.10 |
| Twelfth layer (Medium sensitivity blue-sensitive emulsion layer) | |
| Emulsion D | silver 0.40 |
| ExS-7 | $7.4 \times 10^{-4}$ |
| ExC-7 | $7.0 \times 10^{-3}$ |
| ExY-2 | 0.050 |
| ExY-3 | 0.10 |
| HBS-1 | 0.050 |
| Gelatin | 0.78 |
| Thirteenth layer (High sensitivity blue-sensitive emulsion layer) | |
| Emulsion F | silver 1.00 |
| ExS-7 | $4.0 \times 10^{-4}$ |
| ExY-2 | 0.10 |
| ExY-3 | 0.10 |
| HBS-1 | 0.070 |
| Gelatin | 0.86 |
| Fourteenth layer (First protective layer) | |
| Emulsion G | silver 0.20 |
| HBS-1 | $5.0 \times 10^{-2}$ |
| Gelatin | 1.00 |
| Fifteenth layer (Second protective layer) | |
| H-1 | 0.40 |
| B-1 (diameter: 2.3 μm) | $5.0 \times 10^{-2}$ |
| B-2 (diameter: 2.3 μm) | 0.10 |
| B-3 | 0.10 |
| SS-1 | 0.20 |
| Gelatin | 1.20 |

Further, in order to improve preservability, processability, pressure resistance, antimold and antibacterial properties, antistatic property, and coating property, compounds of W-1 to W-3, B-4 to B-6, and F-1 to F-17, and salts of iron, lead, gold, platinum, iridium, and rhodium were suitably added in each layer.

Emulsions and compounds used in this Example were the same as those in Example 1.

The thus prepared samples were evaluated as follows:

<Discoloration of the Support>

After the produced samples were subjected to the following development processing, each sample was irradiated from the back side with ultraviolet radiation of 220 to 380 nm at 80° C. for 2 weeks. After the emulsion was removed with a gelatin degradation enzyme, the degree of yellowness of the support was visually observed and evaluated as follows:

A: Yellowness was conspicuous.

B: A little yellowness was observed.

C: Little yellowness was observed.

D: Yellowness was not observed.

Development processing

| Processing step | Time |
|---|---|
| Color developing | 3 min 15 sec |
| Bleaching | 6 min 30 sec |
| Water washing | 2 min 10 sec |
| Fixing | 4 min 20 sec |
| Water washing | 3 min 15 sec |
| Stabilizing | 1 min 05 sec |

The composition of each processing solution is as followed, respectively:

| | |
|---|---|
| Color-developer | |
| Diethylenetriaminepentaacetic acid | 1.0 g |
| 1-Hydroxyethylidene-1,1-diphosphonic acid | 2.0 g |
| Sodium sulfite | 4.0 g |
| Potassium carbonate | 30.0 g |
| Potassium bromide | 1.4 g |
| Potassium iodide | 1.3 g |
| Hydroxylamine sulfate | 2.4 g |
| 4-(N-Ethyl-N-β-hydroxyethylamino)-2-methylaminoaniline sulfonate | 4.5 g |
| Water to make | 1.0 liter |
| pH | 10.0 |
| Bleaching solution | |
| Iron (III) ammonium ethylenediaminetetraacetate | 100.0 g |
| Disodium ethylenediaminetetraacetate | 10.0 g |
| Ammonium bromide | 150.0 g |
| Ammonium nitrate | 10.0 g |
| Water to make | 1.0 liter |
| pH | 6.0 |
| Fixing solution | |
| Disodium ethylenediaminetetraacetate | 1.0 g |
| Sodium sulfite | 4.0 g |
| Aqueous ammonium thiosulfate solution (70%) | 175.0 ml |
| Sodium bisulfite | 4.6 g |
| Water to make | 1.0 liter |
| pH | 6.6 |
| Stabilizing solution | |
| Formalin (40%) | 2.0 ml |
| Polyoxyethylene-p-monononylphenyl ether (average polymerization degree: 10) | 0.3 g |
| Water to make | 1.0 liter |

(Evaluation of the Fogging)

The produced unexposed samples were subjected to development processing and then the difference in the fogging between the samples and the control sample was evaluated. That is, assuming the value of the fogging of Control Sample (6-1) to be 100, it is indicated that the smaller the value of the sample was, the smaller the fogging of the sample was.

Results are shown in Table 9.

TABLE 9

| Sample No. | UV-absorbent (content: g/m²) | Degree of Yellowness | Fogging | Remarks |
|---|---|---|---|---|
| 6-1 | None | A | 100% | Control |
| 6-2 | I-14 (1) | D | 60 | This Invention |
| 6-3 | II-10 (1) | C | 70 | This Invention |
| 6-4 | III-15 (1) | C | 75 | This Invention |
| 6-5 | IV-2 (1.5) | C | 65 | This Invention |
| 6-6 | V-6 (2.0) | C | 70 | This Invention |
| 6-7 | VI-7 (1) | C | 65 | This Invention |
| 6-8 | II-14 (0.015) | A | 93 | Comparative Example |
| 6-9 | II-14 (12) | A | 85 | Comparative Example |

As is shown in Table 9, the control (Sample 6-1), which did not contain the ultraviolet absorbent described in this specification, was poor in the degree of yellowness and fogging, while Samples 6-2 to 6-7 that contain ultraviolet absorbents according to the present invention were excellent in that they were low in the degree of yellowness and very small in fogging. Further, with regard to Comparative Samples, the discoloration and the fogging were bad and higher because of containing ultraviolet absorbent only in a too small amount or in a too large amount, respectively.

Additionally, Samples 6-1 to 6-7 were excellent in that core set curl did hardly undergo and there was no trouble during processing in compact lab with excellent evenness, because they had been subjected a heat-treatment for 2 days at 105° C. previously.

On the contrary, sample prepared in the same manner as the above Example 5, except that the support was not heat-treated at 105° C. for 2 days, was apt to undergo core set curl so as to be needed careful handling.

EXAMPLE 7

After a backing layer was applied to each support similarly to Example 6 (except that the content of ultraviolet absorbent was different), emulsion layers given below were applied, thereby preparing Reversal Color Photographic Materials 7-1 to 7-9.

The figure given represents the added amount per m². The effect of the added compounds is not restricted to the shown applications.

| | | |
|---|---|---|
| **First layer: Halation-preventing layer** | | |
| Black colloidal silver | | 0.20 g |
| Gelatin | | 1.9 g |
| High boiling organic solvent Oil-1 | | 0.1 g |
| Dispersion of fine crystal solid of Dye E-I | | 0.1 g |
| **Second layer: Intermediate layer** | | |
| Gelatin | | 0.40 g |
| Compound Cpd-C | | 5 mg |
| Compound Cpd-J | | 5 mg |
| Compound Cpd-K | | 3 mg |
| High-boiling organic solvent Oil-3 | | 0.1 g |
| Dye D-4 | | 0.8 mg |

-continued

| | | |
|---|---|---|
| **Third layer: Intermediate layer** | | |
| Fine particle silver iodobromide emulsion fogged its surface and inner part (average grain diameter: 0.06 μm, deviation coefficient of diameter: 18%, AgI content: 1 mol %) | silver | 0.05 g |
| Gelatin | | 0.4 g |
| **Fourth layer: Low sensitivity red-sensitive emulsion layer** | | |
| Emulsion A | silver | 0.3 g |
| Emulsion B | silver | 0.2 g |
| Gelatin | | 0.8 g |
| Coupler C-1 | | 0.15 g |
| Coupler C-2 | | 0.05 g |
| Coupler C-3 | | 0.05 g |
| Coupler C-9 | | 0.05 g |
| Compound Cpd-C | | 5 mg |
| Compound Cpd-J | | 5 mg |
| High-boiling organic solvent Oil-2 | | 0.1 g |
| Additive P-1 | | 0.1 g |
| **Fifth layer: Medium sensitivity red-sensitive emulsion layer** | | |
| Emulsion B | silver | 0.2 g |
| Emulsion C | silver | 0.3 g |
| Gelatin | | 0.8 g |
| Coupler C-1 | | 0.2 g |
| Coupler C-2 | | 0.05 g |
| Coupler C-3 | | 0.2 g |
| High-boiling organic solvent Oil-2 | | 0.1 g |
| Additive P-1 | | 0.1 mg |
| **Sixth layer: High sensitivity red-sensitive emulsion layer** | | |
| Emulsion D | silver | 0.4 g |
| Gelatin | | 1.1 g |
| Coupler C-1 | | 0.3 g |
| Coupler C-2 | | 0.1 g |
| Coupler C-3 | | 0.7 g |
| Additive P-1 | | 0.1 g |
| **Seventh layer: Intermediate layer** | | |
| Gelatin | | 0.6 g |
| Additive M-1 | | 0.3 g |
| Color-mix preventing agent Cpd-F | | 2.6 mg |
| Additive D-5 | | 0.02 g |
| Compound Cpd-J | | 5 mg |
| High-boiling organic solvent Oil-1 | | 0.02 g |
| **Eighth layer: Intermediate layer** | | |
| Fine particle silver iodobromide emulsion fogged its surface and inner part (average grain diameter: 0.06 μm, deviation coefficient of diameter: 16%, AgI content: 0.3 mol %) | silver | 0.02 g |
| Gelatin | | 1.0 g |
| Additive P-1 | | 0.2 g |
| Color-mix preventing agent Cpd-A | | 0.1 g |
| Compound Cpd-C | | 0.1 g |
| **Ninth layer: Low sensitivity green-sensitive emulsion layer** | | |
| Emulsion E-1 | silver | 0.1 g |
| Emulsion F-1 | silver | 0.2 g |
| Emulsion G-1 | silver | 0.2 g |
| Gelatin | | 0.5 g |
| Coupler C-4 | | 0.1 g |
| Coupler C-7 | | 0.05 g |
| Coupler C-8 | | 0.20 g |
| Compound Cpd-B | | 0.03 g |
| Compound Cpd-D | | 0.02 g |
| Compound Cpd-E | | 0.02 g |
| Compound Cpd-F | | 0.04 g |
| Compound Cpd-J | | 10 mg |
| Compound Cpd-L | | 0.02 g |
| High-boiling organic solvent Oil-1 | | 0.1 g |
| High-boiling organic solvent Oil-2 | | 0.1 g |
| **Tenth layer: Medium sensitivity green-sensitive emulsion layer** | | |
| Emulsion G-1 | silver | 0.3 g |
| Emulsion H-1 | silver | 0.1 g |
| Gelatin | | 0.6 g |

| | | |
|---|---|---|
| Coupler C-4 | | 0.1 g |
| Coupler C-7 | | 0.2 g |
| Coupler C-8 | | 0.1 g |
| Compound Cpd-B | | 0.03 g |
| Compound Cpd-D | | 0.02 g |
| Compound Cpd-E | | 0.02 g |
| Compound Cpd-F | | 0.05 g |
| Compound Cpd-L | | 0.05 g |
| High-boiling organic solvent Oil-2 | | 0.01 g |
| Eleventh layer: High sensitivity green-sensitive emulsion layer | | |
| Emulsion I-1 | silver | 0.5 g |
| Gelatin | | 1.0 g |
| Coupler C-4 | | 0.3 g |
| Coupler C-7 | | 0.1 g |
| Coupler C-8 | | 0.1 g |
| Compound Cpd-B | | 0.08 g |
| Compound Cpd-D | | 0.02 g |
| Compound Cpd-E | | 0.04 g |
| Compound Cpd-F | | 5 mg |
| Compound Cpd-L | | 0.02 g |
| High-boiling organic solvent Oil-1 | | 0.02 g |
| High-boiling organic solvent Oil-2 | | 0.02 g |
| Twelfth layer: Intermediate layer | | |
| Gelatin | | 0.6 g |
| Compound Cpd-L | | 0.05 g |
| High-boiling organic solvent Oil-1 | | 0.05 g |
| Thirteenth layer: Yellow filter layer | | |
| Yellow colloid silver | silver | 0.07 g |
| Gelatin | | 1.1 g |
| Color-mix inhibitor Cpd-A | | 0.01 g |
| Compound Cpd-L | | 0.01 g |
| High-boiling organic solvent Oil-1 | | 0.01 g |
| Dispersion of fine crystal solid of Dye E-2 | | 0.05 g |
| Fourteenth layer: Intermediate layer | | |
| Gelatin | | 0.6 g |
| Fifteenth layer: Low sensitivity blue-sensitive emulsion layer | | |
| Emulsion J-1 | silver | 0.2 g |
| Emulsion K-1 | silver | 0.3 g |
| Gelatin | | 0.8 g |
| Coupler C-5 | | 0.2 g |
| Coupler C-6 | | 0.1 g |
| Coupler C-10 | | 0.4 g |
| Sixteenth layer: Medium sensitivity blue-sensitive emulsion layer | | |
| Emulsion L | silver | 0.5 g |
| Gelatin | | 0.9 g |
| Coupler C-5 | | 0.1 g |
| Coupler C-6 | | 0.1 g |
| Coupler C-10 | | 0.6 g |
| Seventeenth layer: High sensitivity blue-sensitive emulsion layer | | |
| Emulsion M-1 | silver | 0.2 g |
| Emulsion N-1 | silver | 0.2 g |
| Gelatin | | 1.2 g |
| Coupler C-5 | | 0.1 g |
| Coupler C-6 | | 0.1 g |
| Coupler C-10 | | 0.6 g |
| High-boiling organic solvent Oil-2 | | 0.1 g |
| Eighteenth layer: First protective layer | | |
| Gelatin | | 0.7 g |
| Formalin scavenger Cpd-H | | 0.4 g |
| Dye D-1 | | 0.15 g |
| Dye D-2 | | 0.05 g |
| Dye D-3 | | 0.1 g |
| Nineteenth layer: Second protective layer | | |
| Colloidal silver | silver | 0.1 mg |
| Fine grain silver iodobromide emulsion (average grain diameter: 0.06 μm, AgI content: 1 mol %) | silver | 0.1 g |
| Gelatin | | 0.4 g |
| Twentieth layer: Third protective layer | | |
| Gelatin | | 0.4 g |

| | |
|---|---|
| Poly(methyl methacrylate) (average particle diameter: 2.0 μm) | 0.1 g |
| Copolymer (4:6) of methyl methacrylate and acrylic acid (average particle diameter: 2.0 μm) | 0.1 g |
| Silicone oil | 0.03 g |
| Surface-active agent W-11 | 3.0 mg |
| Surface-active agent W-12 | 0.03 g |

Further, besides the above compounds, additives F-21 to F-28 were added in all emulsion layers. Further, besides the above compounds gelatin hardener H-1 and surface-active agents for coating and emulsifying W-13, W-14, W-15, and W-16 were added in each layer.

Further, as antiseptic and antimold agents, phenol, 1,2-benzisothiazoline-3-one, 2-phenoxyethanol, phenethyl alcohol, and butyl p-benzoate were added.

Emulsions and compounds used were the same as those in Example 2.

Obtained Samples 7-1 to 7-7 were evaluated as follows:

<Transparency>

After the obtained samples were adequately exposed to light, the transparency was evaluated, assuming the transparency of Control Sample (7-1) to be 100% at 450 nm, by using CR-56 for color reversal processing, manufactured by Fuji Photo Film Co., Ltd. It is indicated that the smaller the value is, the poorer the transparency is.

<Degree of Yellowness>

After the samples were adequately exposed to light and were subjected to development processing in the same manner as above, both of the surfaces were irradiated with light having 30,000 luxes from a xenon lamp for 2 weeks. The degree of yellowness of the obtained films was evaluated in terms of transparency at 450 nm. The evaluation was made relatively, by assuming the transparency of Control Sample (7-1) before the irradiation to be 100%. It is indicated that the smaller the value is, the higher and poorer the degree of yellowness is.

Results are shown in Table 10.

TABLE 10

| Sample No. | UV-absorbent (content: g/m$^2$) | Trans-parency | Degree of Yellowness | Remarks |
|---|---|---|---|---|
| 7-1 | None | 100% | 72% | Control |
| 7-2 | I-14 (2) | 99 | 96 | This Invention |
| 7-3 | II-10 (1.5) | 98 | 94 | This Invention |
| 7-4 | III-15 (1) | 98 | 95 | This Invention |
| 7-5 | IV-2 (1) | 99 | 96 | This Invention |
| 7-6 | V-6 (1) | 99 | 95 | This Invention |
| 7-7 | VI-7 (0.03) | 100 | 90 | This Invention |
| 7-8 | IV-2 (0.015) | 100 | 78 | Comparative Example |
| 7-9 | IV-2 (12) | 20 | 99 | Comparative Example |

As is apparent from Table 10, the photographic material of the present invention was excellent in transparency and the prevention of yellow discoloration. In contrast, Control (Sample 7-1), not containing an ultraviolet absorbent according to the present invention, was poor in prevention of yellow discoloration. Comparative Samples 7-8 and 7-9 containing an ultraviolet absorbent in an amount of out side of the content of ultraviolet absorbent according to the present invention could not satisfy the transparency and the prevention of yellow discoloration at the same time.

The image produced by using samples of the present invention had excellent graininess and sharpness.

EXAMPLE 8

The backed support (Tg=119° C.) prepared in Example 6 (that was not coated with emulsions) was formed into a roll of diameter 10 cm, and it was heated at 110° C. for 2 days.

This sample was coated with emulsions in the same manner as in Example 6, respectively, to prepare Samples 8-1 to 8-7.

A photographic material 8-10 for comparison was prepared in the same manner as the above, except that the polyethylene naphthalate was changed to a polyethylene terephthalate (Tg: 69° C.). Incidentally, in the stage of the support having a backing layer, it was similarly heat-treated at 65° C. for 2 days.

<Passability through a Compact Lab>

The above sample was cut into a length of 1.5 m, of width 35 mm, and it was wound firmly around a spool having an outer diameter of 7 mm and a core was set at 80° C. for 2 hours. The sample was subjected to automatic development processing in a compact lab (FP-560B), manufactured by Fuji Photo Film Co., Ltd. At that time, it was checked whether the film folded or not at the core end of the spool in the automatic processor.

Results are shown in Table 11.

TABLE 11

| Sample No. | UV-absorbent (content: g/m$^2$) | Degree of Yellowness | Passability through a compact lab | Remarks |
|---|---|---|---|---|
| 8-1 | None | A | Not folded | Control |
| 8-2 | I-14 (2) | D | Not folded | This Invention |
| 8-3 | II-10 (1.5) | C | Not folded | This Invention |
| 8-4 | III-15 (1) | C | Not folded | This Invention |
| 8-5 | IV-2 (1) | C | Not folded | This Invention |
| 8-6 | V-6 (1) | C | Not folded | This Invention |
| 8-7 | VI-7 (0.03) | C | Not folded | This Invention |
| 8-8 | IV-2 (0.015) | A | Not folded | Comparative Example |
| 8-9 | IV-2 (12) | B | Not folded | Comparative Example |
| 8-10 | I-14 (2) | C | Folded | Comparative Example |

As is apparent from Table 11, it can be understood that, since the polyethylene naphthalate according to the present invention is heat-treated, there is no problem of passability through a compact lab and the support is discolored less. In contrast, Control (8-1), not containing any ultraviolet absorbent, is poor in that it was extremely discolored.

Comparative Samples 8-8 and 8-9, whose ultraviolet absorbent content of support was too small and too large, respectively, were remarkably worse in abilities.

It is apparent that the photographic material of the present invention is excellent, because even though Sample 8-10, which used a polyethylene terephthalate falling outside the present invention, was heat-treated, the passability through a compact lab was not improved.

Example 9

Samples 9-1 to 9-7 were prepared in the same manner as in Example 6, except that polyethylene naphthalate for support was changed to Exemplified Compound PBC-5 or PBB-6 of the present invention, and they were evaluated. Samples 9-2 to 9-7 according to the present invention were excellent in the prevention of discoloration of support and fogging compared with Control sample 9-1.

Having described our invention as related to the present embodiments, it is our intention that the invention not be limited by any of the details of the description, unless otherwise specified, but rather be construed broadly within its spirit and scope as set out in the accompanying claims.

What I claim is:

1. A silver halide photographic material having a support and at least one silver halide emulsion layer on at least one side of the support, which comprises at least one photographic constitutional layer containing at least one ultraviolet absorbent on one or both surfaces of the support, the total content of the ultraviolet absorbent in the at least one photographic constitutional layer being 0.01 to 3 g/m$^2$, and the support being made of a polyethylene naphthalate compound.

2. The silver halide photographic material as claimed in claim 1, wherein the ultraviolet absorbent is at least one of compounds represented by the following formula (I), (II), (III), (IV), (V), or (VI):

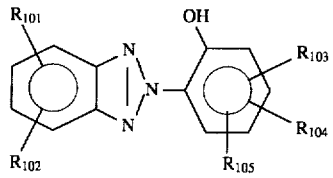

wherein $R_{101}$, $R_{102}$, $R_{103}$, $R_{104}$, and $R_{105}$, which are the same or different, each represent a hydrogen atom, a halogen atom, an alkyl group, a cycloalkyl group, an alkoxy group, an aryl group, an aryloxy group, an alkenyl group, a nitro group, a carboxyl group, a sulfonic group, or a hydroxyl group;

formula (II)

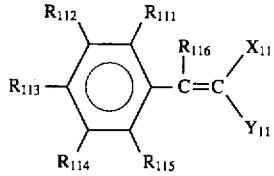

wherein $R_{111}$, $R_{112}$, $R_{113}$, $R_{114}$, and $R_{115}$, which are the same or different, each represent a hydrogen atom, a halogen atom, an alkyl group, an aryl group, an alkoxy group, an aryloxy group, an alkylthio group, an arylthio group, an amino group, a hydroxyl group, a cyano group, a nitro group, a carbamoyl group, a sulfonyl group, a sulfamoyl group, a sulfonamido group, a carboxyl group, a sulfonic group, an acyloxy group, or an oxycarbonyl group, $R_{116}$ represents a hydrogen atom or an alkyl group, $X_{11}$ and $Y_{11}$ each represent a cyano group, —$COOR_{117}$, —$CONHR_{117}$, —$COR_{117}$, —$SO_2R_{117}$, or —$SO_2NHR_{117}$, wherein $R_{117}$ represents an alkyl group or an aryl group, and $X_{11}$ and $Y_{11}$ may bond together to form a 5- to 7-membered ring;

formula (III)

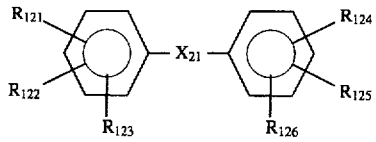

wherein $R_{121}$, $R_{122}$, $R_{123}$, $R_{124}$, $R_{125}$, and $R_{126}$, which are the same or different, each represent a hydrogen atom, a halogen atom, an alkyl group, an aryl group, an alkoxy group, an aryloxy group, an alkylthio group, an arylthio group, an amino group, a hydroxyl group, a cyano group, a nitro group, a carbonamido group, a carbamoyl group, a sulfonamido group, a sulfamoyl group, a carboxyl group, a sulfonic group, an acyloxy group, or an oxycarbonyl group, and $X_{21}$ represents —CO— or —COO—;

formula (IV)

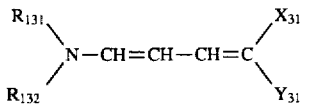

wherein $R_{131}$ and $R_{132}$, which are the same or different, each represent a hydrogen atom, an alkyl group, an aryl group, or a group of nonmetallic atoms required to form a 5- or 6-membered ring by bonding together, and $X_{31}$ and $Y_{31}$, which are the same or different, have the same meanings as those of $X_{11}$ and $Y_{11}$ in formula (II);

formula (V)

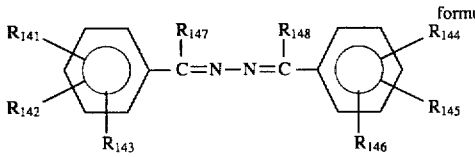

wherein $R_{141}$, $R_{142}$, $R_{143}$, $R_{144}$, $R_{145}$, and $R_{146}$, which are the same or different, have the same meaning as those of $R_{111}$ to $R_{115}$ in formula (II), $R_{147}$ and $R_{148}$, which are the same or different, each represent a hydrogen atom, an alkyl group, or an aryl group, and $R_{147}$ and $R_{148}$ may bond together to form a 5- or 6-membered ring;

formula (VI)

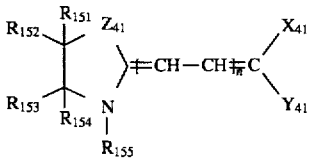

wherein $R_{151}$, $R_{152}$, $R_{153}$, and $R_{154}$, which are the same or different, each represent a hydrogen atom, an alkyl group, or an aryl group, $R_{151}$ and $R_{154}$ may bond together to form a double bond, and when $R_{151}$ and $R_{154}$ bond together to form a double bond, $R_{152}$ and $R_{153}$ may bond together to form a benzene ring or a naphthalene ring, $R_{155}$ represents an alkyl group or an aryl group, $Z_{41}$ represents an oxygen atom, a sulfur atom, a methylene group, an ethylene group,

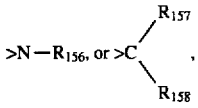

wherein $R_{156}$ represents an alkyl group or an aryl group, and $R_{157}$ and $R_{158}$, which are the same or different, each represent a hydrogen atom or an alkyl group, $X_{41}$ and $Y_{41}$, which are the same or different, have the same meaning as those of $X_{11}$ and $Y_{11}$ in formula (II), and n is 0 or 1.

3. The silver halide photographic material as claimed in claim 1, wherein the polyethylene naphthalate compound is a polyester made from an acid component comprising naphthalenedicarboxylic acid, wherein the naphthalenedicarboxylic acid accounts for at least 50 mol % of the acid component.

4. The silver halide photographic material as claimed in claim 1, wherein the glass transition temperature of the polyethylene naphthalate compound is 90° C. or higher.

5. The silver halide photographic material as claimed in claim 1, wherein the polyethylene naphthalate compound is heat-treated at a temperature lower than the heat transition temperature of the polyethylene naphthalate compound.

6. The silver halide photographic material as claimed in claim 1, wherein the support contains at least one ultraviolet absorbent.

7. The silver halide photographic material as claimed in claim 6, wherein the ultraviolet absorbent is at least one of compounds represented by formula (I), (II), (III), (IV), (V), or (VI):

formula (I)

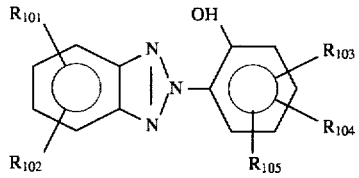

wherein $R_{101}$, $R_{102}$, $R_{103}$, $R_{104}$, and $R_{105}$, which are the same or different, each represent a hydrogen atom, a halogen atom, an alkyl group, a cycloalkyl group, an alkoxy group, an aryl group, an aryloxy group, an alkenyl group, a nitro group, a carboxyl group, a sulfonic group, or a hydroxyl group;

formula (II)

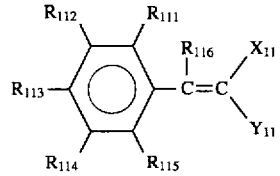

wherein $R_{111}$, $R_{112}$, $R_{113}$, $R_{114}$, and $R_{115}$, which are the same or different, each represent a hydrogen atom, a halogen atom, an alkyl group, an aryl group an alkoxy group, an aryloxy group, an alkylthio group, an arylthio group, an amino group, a hydroxyl group, a cyano group, a nitro group, a carbamoyl group, a sulfonyl group, a sulfamoyl group, a sulfonamido group, a carboxyl group, a sulfonic group, an acyloxy group, or an oxycarbonyl group, $R_{116}$ represents a hydrogen atom or an alkyl group, $X_{11}$ and $Y_{11}$ each represent a cyano group, —$COOR_{117}$, —$CONHR_{117}$, —$COR_{117}$, —$SO_2R_{117}$, or —$SO_2NHR_{117}$, wherein $R_{117}$ represents an alkyl group or an aryl group, and $X_{11}$ and $Y_{11}$ may bond together to form a 5- to 7-membered ring;

formula (III)

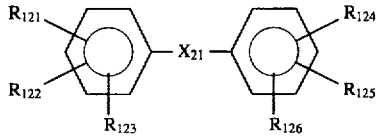

wherein $R_{121}$, $R_{122}$, $R_{123}$, $R_{124}$, $R_{125}$, and $R_{126}$, which are the same or different, each represent a hydrogen atom, a halogen atom, an alkyl group, an aryl group, an alkoxy group, an aryloxy group, an alkylthio group, an arylthio group, an amino group, a hydroxyl group, a cyano group, a nitro group, a carbonamido group, a carbamoyl group, a sulfonamido group, a sulfamoyl group, a carboxyl group, a sulfonic group, an acyloxy group, or an oxycarbonyl group, and $X_{21}$ represents —CO— or —COO—;

formula (IV)

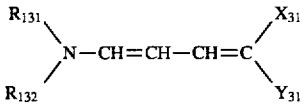

wherein $R_{131}$ and $R_{132}$, which are the same or different, each represent a hydrogen atom, an alkyl group, an aryl group, or a group of nonmetallic atoms required to form a 5- or 6-membered ring by bonding together, and $X_{31}$ and $Y_{31}$, which are the same or different, have the same meanings as those of $X_{11}$ and $Y_{11}$ in formula (II);

formula (V)

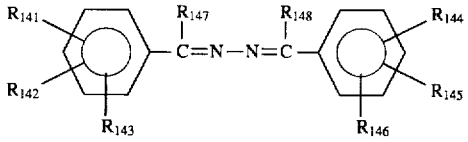

wherein $R_{141}$, $R_{142}$, $R_{143}$, $R_{144}$, $R_{145}$, and $R_{146}$, which are the same or different, have the same meaning as those of $R_{111}$ to $R_{115}$ in formula (II), $R_{147}$ and $R_{148}$, which are the same or different, each represent a hydrogen atom, an alkyl group, or an aryl group, and $R_{147}$ and $R_{148}$ may bond together to form a 5- or 6-membered ring;

formula (VI)

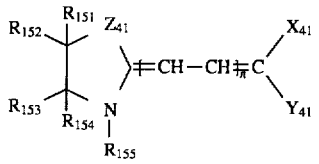

wherein $R_{151}$, $R_{152}$, $R_{153}$, and $R_{154}$, which are the same or different, each represent a hydrogen atom, an alkyl group, or an aryl group, $R_{151}$ and $R_{154}$ may bond together to form a double bond, and when $R_{151}$ and $R_{154}$ bond together to form a double bond, $R_{152}$ and $R_{153}$ may bond together to form a benzene ring or a naphthalene ring, $R_{155}$ represents an alkyl group or an aryl group, $Z_{41}$ represents an oxygen atom, a sulfur atom, a methylene group, an ethylene group,

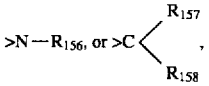

wherein $R_{156}$ represents an alkyl group or an aryl group, and $R_{157}$ and $R_{158}$, which are the same or different, each represent a hydrogen atom or an alkyl group, $X_{41}$ and $Y_{41}$, which are the same or different, have the same meaning as those of $X_{11}$ and $Y_{11}$ in formula (II), and n is 0 or 1.

8. The silver halide photographic material as claimed in claim 3, wherein the compound having two alcoholic hydroxyl groups is selected from the group consisting of an aliphatic glycol, a cycloaliphatic glycol, and an aromatic diol.

9. The silver halide photographic material as claimed in claim 4, wherein the glass transition temperature of the polyethylene naphthalate compound is 90° C. or over but 200° C. or below.

10. The silver halide photographic material as claimed in claim 5, wherein the polyethylene naphthalate compound is heat-treated at a temperature in the range of from 50° C. to the glass transition temperature of the polyethylene naphthalate compound for a time period from 0.5 to 1,500 hours.

11. A silver halide photographic material having a support and at least one silver halide emulsion layer on at least one side of the support, wherein the support is made of a polyethylene naphthalate compound and contains 0.02 to 10 g/m$^2$ of at least one ultraviolet absorbent, with the support having a thickness of 40 to 500 μm.

12. The silver halide photographic material as claimed in claim 11, wherein the ultraviolet absorbent is at least one of compounds represented by the following formula (I), (II), (III), (IV), (V), or (VI):

formula (I)

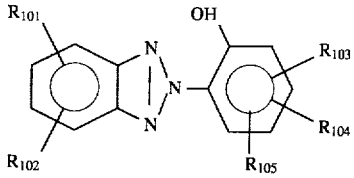

wherein $R_{101}$, $R_{102}$, $R_{103}$, $R_{104}$, and $R_{105}$, which are the same or different, each represent a hydrogen atom, a halogen atom, an alkyl group, a cycloalkyl group, an alkoxy group, an aryl group, an aryloxy group, an alkenyl group, a nitro group, a carboxyl group, a sulfonic group, or a hydroxyl group;

formula (II)

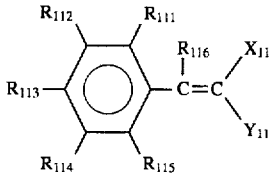

wherein $R_{111}$, $R_{112}$, $R_{113}$, $R_{114}$, and $R_{115}$, which are the same or different, each represent a hydrogen atom, a halogen atom, an alkyl group, an aryl group, an alkoxy group, an aryloxy group, an alkylthio group, an arylthio group, an amino group, a hydroxyl group, a cyano group, a nitro group, a carbamoyl group, a sulfonyl group, a sulfamoyl group, a sulfonamido group, a carboxyl group, a sulfonic group, an acyloxy group, or an oxycarbonyl group, $R_{116}$ represents a hydrogen atom or an alkyl group, $X_{11}$ and $Y_{11}$ each represent a cyano group, —$COOR_{117}$, —$CONHR_{117}$, —$COR_{117}$, —$SO_2R_{117}$, or —$SO_2NHR_{117}$, wherein $R_{117}$ represents an alkyl group or an aryl group, and $X_{11}$ and $Y_{11}$ may bond together to form a 5- to 7-membered ring;

formula (III)

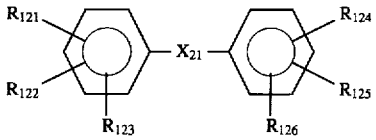

wherein $R_{121}$, $R_{122}$, $R_{123}$, $R_{124}$, $R_{125}$, and $R_{126}$, which are the same or different, each represent a hydrogen atom, a halogen atom, an alkyl group, an aryl group, an alkoxy group, an aryloxy group, an alkylthio group, an arylthio group, an amino group, a hydroxyl group, a cyano group, a nitro group, a carbonamido group, a carbamoyl group, a sulfonamido group, a sulfamoyl group, a carboxyl group, a sulfonic group, an acyloxy group, or an oxycarbonyl group, and $X_{21}$ represents —CO— or —COO—;

formula (IV)

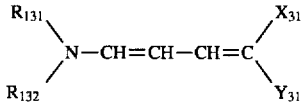

wherein $R_{131}$ and $R_{132}$, which are the same or different, each represent a hydrogen atom, an alkyl group, an aryl group, or a group of nonmetallic atoms required to form a 5- or 6-membered ring by bonding together, and $X_{31}$ and $Y_{31}$, which are the same or different, have the same meanings as those of $X_{11}$ and $Y_{11}$ in formula (II);

formula (V)

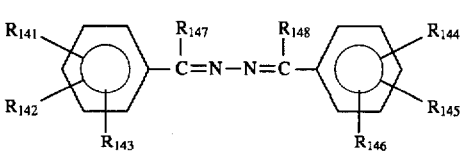

wherein $R_{141}$, $R_{142}$, $R_{143}$, $R_{144}$, $R_{145}$, and $R_{146}$, which are the same or different, have the same meaning as those of $R_{111}$ to $R_{115}$ in formula (II), $R_{147}$ and $R_{148}$, which are the same or different, each represent a hydrogen atom, an alkyl group, or an aryl group, and $R_{147}$ and $R_{148}$ may bond together to form a 5- or 6-membered ring;

formula (VI)

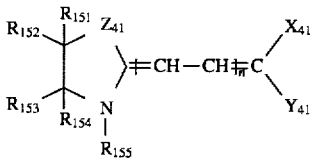

wherein $R_{151}$, $R_{152}$, $R_{153}$, and $R_{154}$, which are the same or different, each represent a hydrogen atom, an alkyl group, or an aryl group, $R_{151}$ and $R_{154}$ may bond together to form a double bond, and when $R_{151}$ and $R_{154}$ bond together to form a double bond, $R_{152}$ and $R_{153}$ may bond together to form a benzene ring or a naphthalene ring, $R_{155}$ represents an alkyl group or an aryl group, $Z_{41}$ represents an oxygen atom, a sulfur atom, a methylene group, an ethylene group,

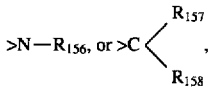

wherein $R_{156}$ represents an alkyl group or an aryl group, and $R_{157}$ and $R_{158}$, which are the same or different, each represent a hydrogen atom or an alkyl group, $X_{41}$ and $Y_{41}$, which are the same or different, have the same meaning as those of $X_{11}$ and $Y_{11}$ in formula (II), and n is 0 or 1.

13. The silver halide photographic material as claimed in claim 11, wherein the polyethylene naphthalate compound is a polyester made from an acid component comprising naphthalenedicarboxylic acid, wherein the naphthalenedicarboxylic acid accounts for at least 50 mol % of the acid component.

14. The silver halide photographic material as claimed in claim 11, wherein the glass transition temperature of the polyethylene naphthalate compound is 90° C. or higher.

15. The silver halide photographic material as claimed in claim 11, wherein the polyethylene naphthalate compound is heat-treated at a temperature lower than the heat transition temperature of the polyethylene naphthalate compound.

16. The silver halide photographic material as claimed in claim 13, wherein the compound having two alcoholic hydroxyl groups is selected from the group consisting of an aliphatic glycol, a cycloaliphatic glycol, and an aromatic diol.

17. The silver halide photographic material as claimed in claim 14, wherein the glass transition temperature of the polyethylene naphthalate compound is 90° C. or over but 200° C. or below.

18. The silver halide photographic material as claimed in claim 15, wherein the polyethylene naphthalate compound is heat-treated at a temperature in the range of from 50° C. to the glass transition temperature of the polyethylene naphthalate compound for a time period from 0.5 to 1,500 hours.

19. The silver halide photographic material as claimed in claim 3, wherein the polyethylene naphthalate compound is polyethylene-2,6-naphthalate.

20. The silver halide photographic material as claimed in claim 13, wherein the polyethylene naphthalate compound is polyethylene-2,6-naphthalate.

* * * * *